US011013970B1

(12) United States Patent
Roach et al.

(10) Patent No.: US 11,013,970 B1
(45) Date of Patent: May 25, 2021

(54) MULTI-COMPONENT GOLF CLUB HEAD HAVING A HOLLOW BODY FACE

(71) Applicant: Cobra Golf Incorporated, Carlsbad, CA (US)

(72) Inventors: Ryan L. Roach, Carlsbad, CA (US); Tim A. Beno, San Diego, CA (US); Andrew Curtis, La Jolla, CA (US); Bryce Hobbs, Carlsbad, CA (US); Collin Lervick, Carlsbad, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 16/723,082

(22) Filed: Dec. 20, 2019

Related U.S. Application Data

(63) Continuation of application No. 16/116,039, filed on Aug. 29, 2018, now Pat. No. 10,512,825, which is a continuation of application No. 15/292,940, filed on Oct. 13, 2016, now Pat. No. 10,086,238, which is a continuation-in-part of application No. 15/213,315, filed on Jul. 18, 2016, now Pat. No. 9,849,356, which is a continuation of application No. 14/145,305, filed on Dec. 31, 2013, now Pat. No. 9,393,470, which is a continuation of application No. 12/902,053, filed on Oct. 11, 2010, now Pat. No. 8,616,997, which is a continuation of application No. 11/960,809, filed on Dec. 20, 2007, now Pat. No. 7,811,179, which is a (Continued)

(51) Int. Cl.

| | |
|---|---|
| ***A63B 60/02*** | (2015.01) |
| ***A63B 53/04*** | (2015.01) |
| ***A63B 60/42*** | (2015.01) |

(52) U.S. Cl.
CPC ..... *A63B 60/02* (2015.10); *A63B 53/04* (2013.01); *A63B 53/047* (2013.01); *A63B 60/42* (2015.10); *A63B 53/042* (2020.08); *A63B 53/0425* (2020.08); *A63B 53/0433* (2020.08); *A63B 53/0437* (2020.08); *A63B 53/0475* (2013.01); *A63B 53/0487* (2013.01); *A63B 2053/0491* (2013.01)

(58) Field of Classification Search
CPC .... A63B 2053/0425; A63B 2053/0491; A63B 2053/0437; A63B 2053/042; A63B 2053/0433; A63B 53/04; A63B 53/047; A63B 53/0475; A63B 53/0487; A63B 60/02; A63B 60/42
USPC ..... 473/324–350, 287–292
See application file for complete search history.

(56) References Cited

U.S. PATENT DOCUMENTS

| | | | |
|---|---|---|---|
| 819,900 | A | 5/1906 | Martin |
| 1,253,700 | A | 1/1918 | Mclaughlin |

(Continued)

OTHER PUBLICATIONS

AAC Web Forum: "Anodizing, What is it?," http://www.anodizing.org/defintions.html, Downloaded Jun. 26, 2006, 11 pages.

(Continued)

*Primary Examiner* — Sebastiano Passaniti
(74) *Attorney, Agent, or Firm* — Quarles & Brady LLP

(57) ABSTRACT

A golf club head includes a body having a heel and a toe. The golf club head further comprises a sole plate configured to be attached to the body and an interlocking structure formed on a rear surface of the body. The sole plate engages with the interlocking structure to properly align the sole plate with the body.

20 Claims, 31 Drawing Sheets

Related U.S. Application Data continuation-in-part of application No. 11/534,724, filed on Sep. 25, 2006, now Pat. No. 7,811,180.

(56) References Cited

U.S. PATENT DOCUMENTS 1,289,192 A * 12/1918 Klin ..... A63B 53/04 473/343
1,322,182 A * 11/1919 Duncan ..... A63B 53/04 473/344
1,538,312 A * 5/1925 Beat ..... A63B 53/08 473/337
2,332,342 A * 10/1943 Reach ..... A63B 53/04 473/248
2,530,446 A 11/1950 Beardsley
3,220,733 A 11/1965 Saleeby
3,419,275 A * 12/1968 Winkleman ..... A63B 53/0487 473/335
3,659,855 A 5/1972 Hardesty
3,664,888 A 5/1972 Oga
3,836,153 A 9/1974 Dance, Jr.
3,975,023 A 8/1976 Inamori
3,983,014 A 9/1976 Newman et al.
3,989,248 A 11/1976 Campau
4,330,128 A 5/1982 Morelli
4,506,888 A 3/1985 Nardozzi, Jr.
4,573,685 A 3/1986 Young, IV et al.
4,618,149 A 10/1986 Maxel
4,630,825 A 12/1986 Schmidt et al.
4,792,140 A 12/1988 Yamaguchi et al.
4,884,808 A 12/1989 Retzer
4,884,812 A 12/1989 Nagasaki et al.
5,154,424 A 10/1992 Lo
5,190,290 A 3/1993 Take
5,221,087 A 6/1993 Fenton et al.
5,230,509 A 7/1993 Chavez
5,303,922 A 4/1994 Lo
5,358,249 A 10/1994 Mendralla
5,405,136 A 4/1995 Hardman
5,407,202 A 4/1995 Igarashi
5,425,535 A 6/1995 Gee
5,437,447 A 8/1995 Rigutto
5,439,223 A * 8/1995 Kobayashi ..... A63B 60/00 473/334
5,439,712 A 8/1995 Hattori et al.
5,489,094 A 2/1996 Pritchett
5,499,814 A 3/1996 Lu
5,509,660 A 4/1996 Elmer
5,522,593 A 6/1996 Kobayashi et al.
5,531,439 A 7/1996 Azzarella
5,536,011 A 7/1996 Gutowski
5,616,088 A 4/1997 Aizawa et al.
5,669,829 A 9/1997 Lin
5,713,800 A 2/1998 Su
5,720,673 A 2/1998 Anderson
5,766,094 A 6/1998 Mahaffey et al.
5,776,010 A * 7/1998 Helmstetter ..... A63B 53/04 473/334
5,788,584 A 8/1998 Parente et al.
5,807,186 A * 9/1998 Chen ..... A63B 53/04 473/248
5,807,189 A 9/1998 Martin et al.
5,833,551 A 11/1998 Vincent et al.
5,863,262 A 1/1999 Donofrio
5,947,840 A 9/1999 Ryan
6,030,293 A 2/2000 Takeda
6,149,534 A * 11/2000 Peters ..... A63B 60/00 473/345
6,183,381 B1 2/2001 Grant et al.
6,200,228 B1 3/2001 Takeda
6,238,302 B1 5/2001 Helmstetter et al.
6,410,197 B1 6/2002 Bellino et al.
6,443,853 B1 9/2002 Bouquet
6,443,854 B1 9/2002 Calboreanu
6,488,595 B1 12/2002 Grace
6,569,029 B1 * 5/2003 Hamburger ..... A63B 53/047 473/238
6,648,773 B1 11/2003 Evans
6,676,533 B1 1/2004 Hsien
6,679,786 B2 1/2004 McCabe
6,739,983 B2 5/2004 Helmstetter et al.
6,769,998 B2 8/2004 Clausen et al.
6,860,818 B2 * 3/2005 Mahaffey ..... A63B 60/02 473/256
6,863,625 B2 3/2005 Reyes et al.
6,878,073 B2 4/2005 Takeda
6,884,336 B2 4/2005 Kia et al.
6,893,358 B2 5/2005 Dewanjee et al.
6,966,846 B2 11/2005 Bloom, Jr.
6,971,960 B2 12/2005 Dewanjee et al.
6,986,715 B2 1/2006 Mahaffey
7,048,648 B2 5/2006 Breier et al.
7,060,176 B2 6/2006 Rasmussen
7,101,290 B2 9/2006 Tucker, Sr.
7,160,204 B2 1/2007 Huang
7,232,380 B2 6/2007 Nakahara
7,258,628 B2 8/2007 Huang et al.
7,261,644 B2 8/2007 Burrows
7,267,620 B2 9/2007 Chao et al.
7,338,387 B2 3/2008 Nycum et al.
7,364,513 B2 4/2008 Krumme
7,371,188 B2 5/2008 Chen
7,431,662 B2 10/2008 Tucker, Sr. et al.
7,604,550 B1 10/2009 Currie
7,651,413 B1 1/2010 Chen
7,662,051 B2 2/2010 Chen
7,691,006 B1 4/2010 Burke
7,722,479 B2 5/2010 Soracco
D618,743 S 6/2010 Roach et al.
D618,750 S 6/2010 Roberts et al.
D618,752 S 6/2010 Morris et al.
7,798,916 B2 9/2010 Matsunaga et al.
7,803,064 B2 9/2010 Roach et al.
7,803,068 B2 9/2010 Clausen et al.
D624,979 S 10/2010 Morris et al.
7,811,179 B2 10/2010 Roach et al.
7,811,180 B2 10/2010 Roach et al.
7,819,757 B2 10/2010 Soracco et al.
8,043,167 B2 * 10/2011 Boyd ..... A63B 53/04 473/334
8,616,997 B2 12/2013 Roach et al.
8,740,722 B2 * 6/2014 Sato ..... A63B 53/047 473/334
8,753,219 B2 * 6/2014 Gilbert ..... A63B 53/0475 473/291
8,961,336 B1 2/2015 Parsons et al.
9,033,814 B2 * 5/2015 Stites ..... A63B 53/06 473/244
9,061,186 B2 6/2015 Larson
9,393,470 B2 7/2016 Roach et al.
9,669,272 B2 6/2017 Park et al.
9,987,532 B2 * 6/2018 Sander ..... A63B 53/047
10,086,238 B1 * 10/2018 Roach ..... A63B 53/047
10,307,650 B2 * 6/2019 Sander ..... A63B 53/06
10,512,825 B1 * 12/2019 Roach ..... A63B 53/047
10,661,128 B2 * 5/2020 Ripp ..... A63B 53/047
2002/0193176 A1 12/2002 Grace
2003/0139226 A1 * 7/2003 Cheng ..... A63B 60/00 473/334
2003/0207726 A1 11/2003 Lee
2004/0058747 A1 3/2004 Clausen et al.
2004/0235584 A1 11/2004 Chao et al.
2004/0245762 A1 12/2004 Joseph et al.
2005/0022633 A1 2/2005 Rozo et al.
2005/0164800 A1 7/2005 Wood et al.
2005/0239576 A1 10/2005 Stites et al.
2006/0025235 A1 2/2006 Nakahara et al.
2006/0040762 A1 2/2006 Chupka et al.
2006/0052184 A1 3/2006 Soracco et al.
2006/0084527 A1 4/2006 Nycum et al.
2006/0199661 A1 9/2006 Deng et al.
2007/0026205 A1 2/2007 Anton et al.
2007/0042836 A1 2/2007 Best et al.
2007/0178990 A1 8/2007 Tsai

(56) References Cited

U.S. PATENT DOCUMENTS

| | | | | |
|---|---|---|---|---|
| 2007/0293345 | A1 | 12/2007 | Serrano et al. | |
| 2008/0051220 | A1 | 2/2008 | Soracco et al. | |
| 2008/0318705 | A1 | 12/2008 | Clausen et al. | |
| 2009/0118037 | A1 | 5/2009 | Roach et al. | |
| 2009/0221382 | A1 | 9/2009 | Soracco et al. | |
| 2009/0291772 | A1 | 11/2009 | Boyd et al. | |
| 2010/0041493 | A1 | 2/2010 | Clausen et al. | |
| 2010/0048318 | A1 | 2/2010 | Clausen | |
| 2010/0056297 | A1 | 3/2010 | Roach et al. | |
| 2010/0069172 | A1 | 3/2010 | Roach | |
| 2010/0151964 | A1 | 6/2010 | Soracco | |
| 2010/0261540 | A1 | 10/2010 | Roach | |
| 2010/0285899 | A1 | 11/2010 | Soracco | |
| 2010/0298065 | A1 | 11/2010 | Soracco et al. | |
| 2012/0071259 | A1* | 3/2012 | Clausen | A63B 60/54 473/290 |
| 2013/0324299 | A1* | 12/2013 | Clausen | A63B 53/0466 473/335 |
| 2016/0332043 | A1 | 11/2016 | Cardani et al. | |

OTHER PUBLICATIONS

Alpha Metal Finishing Co.: "Hardcoat Anodizing", http://www.alphametal.com/hardcoat.htm. Copyright 2000-2002, Downloaded Aug. 30, 2006, 8 pages.

Danford, M.D.: "The Corrosion Protection of 6061-T6 Aluminum by a Polyurethane-Sealed Anodized Coat," NASA Technical Memorandum, NASA TM—100394, Apr. 1990, 2 pages.

Duralectra: "Sanford Hardlube," http://www.duralectra.com/af/sh.asp, Downloaded Jun. 30, 2006, 1 page.

Engineers Edge: "Hard Anodizing Finish Specification—Engineers Edge," http://www.engineersedge.com/mil_a_8625.htm, Copyright 2000-2006, Downloaded Jun. 30, 2006, 1 page.

Furukawa-Sky Aluminum Corp.: "Coating and Surface Treatment," http://www.furukawa- sky.co.jp/english/produce/en_coating.htm, Downloaded Jun. 26, 2006, 2 pages.

Tiodize Company: "Tiodize Proces," http://www.tiodize.com/tiodizeborchurepdf#search=%22titanium%20design%20consideration%20tiodize%20processes%22, 6 pages.

U.S. Appl. No. 12/556,608, filed Sep. 10, 2009, 33 pages.

U.S. Appl. No. 12/570,725, filed Sep. 30, 2009, 29 pages.

U.S. Appl. No. 12/643,154, filed Dec. 21, 2009, 17 pages.

U.S. Appl. No. 12/644,051, filed Dec. 22, 2009, 21 pages.

U.S. Appl. No. 12/694,955, filed Jan. 27, 2010, 14 pages.

U.S. Appl. No. 12/709,679, filed Feb. 22, 2010, 27 pages.

U.S. Appl. No. 12/761,377, filed Apr. 15, 2010, 17 pages.

Non-Final Office Action, dated Jun. 18, 2009, U.S. Appl. No. 11/534,724, 14 pages.

Final Office Action, dated Dec. 15, 2009, U.S. Appl. No. 11/534,724, 7 pages.

Alpha Metal Finishing Co.: "About Anodizing," http://www.alphametal.com/anodizing.htm, Copyright 2000-2002, Dated Aug. 30, 2006 (Retrieved from web.archive.org on Apr. 8, 2020), 2 pages.

* cited by examiner

MULTI-COMPONENT GOLF CLUB HEAD HAVING A HOLLOW BODY FACE

CROSS REFERENCE TO RELATED APPLICATIONS

This application is a continuation of U.S. patent application Ser. No. 16/116,039, filed Aug. 29, 2018, which is a continuation of U.S. patent application Ser. No. 15/292,940, filed Oct. 13, 2016 (now U.S. Pat. No. 10,086,238), which is a continuation-in-part of U.S. patent application Ser. No. 15/213,315, filed Jul. 18, 2016 (now U.S. Pat. No. 9,849,356), which is a continuation of U.S. patent application Ser. No. 14/145,305, filed Dec. 31, 2013 (now U.S. Pat. No. 9,393,470), which is a continuation of U.S. patent application Ser. No. 12/902,053, filed on Oct. 11, 2010 (now U.S. Pat. No. 8,616,997), which is a continuation of U.S. patent application Ser. No. 11/960,809, filed on Dec. 20, 2007 (now U.S. Pat. No. 7,811,179), which is a continuation-in-part of U.S. patent application Ser. No. 11/534,724, filed on Sep. 25, 2006 (now U.S. Pat. No. 7,811,180), the contents of each of which are incorporated herein by reference in their entirety.

REFERENCE REGARDING FEDERALLY SPONSORED RESEARCH OR DEVELOPMENT

Not applicable.

SEQUENCE LISTING

Not applicable.

BACKGROUND OF THE DISCLOSURE

1. Field of the Disclosure

The present invention relates to golf clubs, and more specifically to a multi-component golf club head.

2. Description of the Background of the Disclosure

Perimeter weighting in a golf club distributes the mass of the club toward the perimeter, minimizing the effects of off-center hits on the face of the golf club away from the sweet spot and producing more accurate and consistent golf ball trajectories. Perimeter weighting is achieved by creating a cavity in the back of the golf club opposite the face or hitting surface. The material weight saved by creating this cavity is redistributed around the perimeter of the golf club head. In general, larger cavity volumes correspond to increased amounts of mass distributed around the perimeter. Additionally, more of the perimeter weight is moved to the sole of the club to move the center of gravity downward and rearward.

Alternative approaches for moving the center of gravity of a golf club head rearward and downward in the club head utilize composite structures. These composite structures utilize two, three, or more materials that have different physical properties including different densities. By positioning materials that provide the desired strength characteristics with less weight near the crown or top line of a golf club head, a larger percentage of the overall weight of the golf club head is shifted towards the sole of the club head. This results in the center of gravity being moved downward and rearward. This approach is advantageously applicable to muscle back iron clubs or fairway woods, as this will help to generate loft and power behind and below the ball.

Additionally, to improve ball speed and distance in club head design, particularly in the construction of irons, designers and manufacturers may opt to use a cup face structure. A thin cup face and return combination results in an increase in flexing of the face and sole, which, in turn, results in a decrease in the deformation of the ball upon impact and an overall decrease in the loss of energy in the collision. The reduced energy loss is due to the fact that metals generally exhibit more elastic behavior in a collision than viscoelastic materials such as rubber, urethanes, and other polymers that are typically used to make golf balls. To further enhance performance, current iron club head designs take advantage of certain materials for the ball-striking face, such as titanium, that provide higher compliance (i.e., relatively low modulus) than other metal materials and are relatively lightweight when compared to typical club head metals, such as steel.

However, there are limitations when using multiple materials for the construction of a club head, as club head designs may often be constrained by the manufacturing requirements associated with using multiple materials. For example, weld lines, swage geometry, adhesive bonding ledges, and the like, all must be taken into account. Manufacturers must be able to join two dissimilar materials with sufficient strength, which can be particularly difficult depending on the materials being joined to one another. For example, some materials must be bonded together by welding, swaging, or using bonding agents such as epoxy. However, such bonds may be subject to delamination or corrosion over time, and may further limit the potential of the materials and restrict performance. For example, current methods for creating a cup-faced iron club head from titanium generally involve brazing a titanium cup to a steel body, wherein the swage joint or glue joint is required to be built up with body material to attain a correct bonding surface and/or joint durability. However, such a manufacturing method generally requires a lip for encasing the titanium cup to the body, which can have a negative impact on performance of the cup face, such as restricting the club head's ability to flex and take advantage of the combination of high strength and low modulus that titanium possesses.

Therefore, there remains a need for a composite golf club head that utilizes components having different materials and/or densities designed in such a way as to minimize the problems associated with delamination, corrosion, or separation of the components while further maximizing the performance potential of each component.

SUMMARY OF THE INVENTION

The present invention is directed to golf club heads constructed from multiple components formed of different materials. In particular, a club head of the present disclosure includes a club head body, such as a cast or forged body portion, made from a first metal, and at least one removable component configured to be releasably attached to the club head body, the removable component being made from a second metal that is different than the first metal. The golf club head includes a semi-hollow, or completely hollow-bodied, ball-striking face cartridge made from at least titanium.

In some embodiments, the face cartridge is formed as part of the club head body. Accordingly, the club head body may generally include a top line, sole, heel, toe, and hosel extending from the heel, wherein the face cartridge includes at least the top line, sole, and toe portions. The face cartridge furthers include an interlocking structure formed on a rear surface thereof and configured to interlock with at least one removable component, such as a weight. This interlocking structure includes at least a protrusion extending from the rear surface of the face cartridge and extends along a length of the face cartridge in a heel-toe direction and substantially parallel with the top line and/or sole. The removable component is configured to be removed from and re-attached to a rear portion of the club head body at least by way of the interlocking structure. The removable component includes, for example, a recess configured to receive and retain the protrusion of the interlocking structure within. Upon attachment, the protrusion is interlocked with the channel providing sufficient and stable attachment between the removable component and the club head body, specifically the face cartridge. The channel is shaped to further enhance the connection between the two components. These shapes include, but are not limited to, rectangular cross-sections and cross-sections having overhangs such as dovetail cross-sections. It should be noted that, in some embodiments, the removable component may include the interlocking structure and the rear surface of the face cartridge may include the corresponding recess. To further strengthen the connection, a fastening mechanism, such as fasteners (e.g., screws or bolts), adhesive, cam-lock assembly, or the like, may be used to fasten the removable component to the club head body.

In some embodiments, the removable component may generally include, for example, a removable weight made of the second metal that is denser and/or heavier than the first metal (e.g., formed of tungsten or the like) and forms a back of the club head body and a portion of the sole (e.g., a sole plate). The removable sole plate may be interchangeable with other removable sole plates to thereby allow adjustability of playing characteristics of the club head. For example, each of a plurality of different interchangeable sole plates may include a different material composition or arrangement to thereby provide adjustment of mass properties, or other properties, of the golf club head when coupled to the club head body. For example, different sole plates may be used to adjust a variety of different club head characteristics, including, but not limited to, center of gravity (CG), moment of inertia (MOI), sole bounce, sole width, overall club head weight, and the like, which can impact, among other things, launch angle, ball speed, and ball spin. Accordingly, a player may use the interchangeable sole plates to adjust the club head playing characteristics to meet their needs for any given shot.

In another aspect, the face cartridge is formed separately from the club head body and is removably couplable thereto by way of an interlocking structure. For example, the club head body may include at least a portion of the heel and the hosel extending therefrom, as well as a mounting portion upon which the face cartridge can be removed from and re-attached to. The mounting portion may generally serve as a rear portion of the club head and further form a portion of the sole. Accordingly, the club head body may be arranged in such a way such that a majority of weight is concentrated in the mounting portion so as to lower the CG and further allow for improved perimeter weighting. The face cartridge may include the interlocking structure on a rear surface thereof. The interlocking structure may include at least a protrusion extending from the rear surface of the face cartridge and configured to interlock with a recess defined on a front surface of the mounting portion, wherein the channel is shaped to further enhance the connection between the two components, such as a dovetail cross-section.

In some embodiments, the face cartridge may be interchangeable with other removable face cartridges to thereby allow adjustability of playing characteristics of the club head. For example, each of a plurality of different interchangeable face cartridges may include a different design which provides different playing characteristics. For example, a first face cartridge may be designed to provide a soft feel in lieu of distance, while a second face cartridge may be designed to provide increase distance in lieu of feel. Furthermore, face cartridges may have different loft settings, or other physical attributes. Accordingly, a player may use the interchangeable face cartridges to adjust the club head playing characteristics to meet their needs for any given shot. Furthermore, construction of a hollow face cartridge that is separate from the club head body allows for more options as far as club head design and assembly, as well as greater latitude in the type of manufacturing used to create the cartridge, as the remainder of the club head body is not involved.

The hollow face cartridge is designed in such a way so as to maximize performance of the club face while overcoming the drawbacks of typical titanium face club heads. For example, the face cartridge may be made from a single sheet of titanium or multiple sheets of titanium in such a manner so as to form a semi-hollow component (e.g., three sides, including a top line, sole, and ball-striking face with/without capped ends) or a completely hollow-bodied component (e.g., hollow interior cavity enclosed by top line, sole, backing, ball-striking face, and capped ends). As generally understood, titanium material has high strength and low modulus, such that it is able to flex more than a stiffer material of the same thickness. Accordingly, the hollow ball-striking face can be constructed in such a manner so as to achieve a relatively thin face portion including thin perimeter returns (similar to a cup face), thereby allowing the face and sole portions of the hollow ball-striking face to offer maximum flex, which can result in higher launch angle, as well as increasing contact time between the face and the ball during impact, which can result in less back spin to be generated, resulting in increased shot distance.

Furthermore, the hollow titanium face cartridge construction allows for the club head to have a lower CG location (e.g., removal of heavier material from front of club head and relocating to the rear and sole) that provides a more efficient impact with the ball, increasing ball speed and providing higher launch, as the ball impact will be relatively close to the CG location, and CG is closer to the ground. The hollow titanium face cartridge further has potential to realize significant dynamic loft effects (e.g., increased loft of the club head at impact) due to a significantly deeper CG location (back from the face) that is difficult to achieve in other designs of similar head dimension, which results in higher launce angle.

In one aspect, a golf club head comprises a body that includes a heel and a toe. The golf club head further comprises a sole plate configured to be attached to the body and an interlocking structure formed on a rear surface of the body. The sole plate engages with the interlocking structure to properly align the sole plate with the body.

In related embodiments, the sole plate includes a recess positioned on a top portion of the sole plate. The interlocking structure includes a protrusion that extends from the rear surface of the body. Additionally, the protrusion that extends from the rear surface of the body mates with the recess of the sole plate to attach the sole plate to the body. In some embodiments, the sole plate comprises a different material than the body. In other embodiments, the body further comprises a sole, a face, and a hosel that extends from the heel. In further embodiments, the golf club head is an iron-type club head.

In another aspect, a golf club head comprises a body that includes a heel and a toe. The golf club head further comprises a removable sole plate that comprises a recess and the removable sole plate is configured to be removed from and re-attached to the body. Further, the golf club head comprises an interlocking structure formed on a rear surface of the body. The recess of the removable sole plate engages with the interlocking structure to properly align the removable sole plate with the body.

In some embodiments, the golf club head comprises a first fastener on a heel-side portion of the body. The removable sole plate includes the first fastener, and the removable sole plate is pivotable about an axis defined by the first fastener. Further, the golf club head comprises a second fastener on a toe-side portion of the body. The first fastener is positioned on the rear surface of the body and the second fastener is positioned on a bottom surface of the body. In other embodiments, the recess of the removable sole plate is positioned on a top portion of the removable sole plate. The removable sole plate further includes a plurality of grooves that extend through at least one surface of the removable sole plate. In further embodiments, the interlocking structure includes a protrusion that extends from the rear surface of the body. Additionally, the protrusion that extends from the rear surface of the body mates with and is received by the recess of the removable sole plate to attach the removable sole plate to the body. In some embodiments, the removable sole plate further comprises a different material than the body.

In a further aspect, the present disclosure provides a golf club head that has a body that includes a heel and a toe. The golf club head further includes a removable sole plate that is configured to be removed from and re-attached to the body. Further, the golf club head comprises an interlocking structure formed on a rear surface of the body. Furthermore, the golf club head comprises a fastener configured on a first end of the removable sole plate and a heel-side portion of the body. The removable sole plate is pivotable about an axis defined by the fastener, and the fastener allows for the removable sole plate to pivot into and out of engagement with the body.

In related embodiments, the removable sole plate comprises a different material than the body. In other embodiments, the protrusion that extends from a rear surface of the body mates with and is received by a recess formed on the removable sole plate to attach the removable sole plate to the body.

DETAILED DESCRIPTION OF THE DRAWINGS

Figure 1:
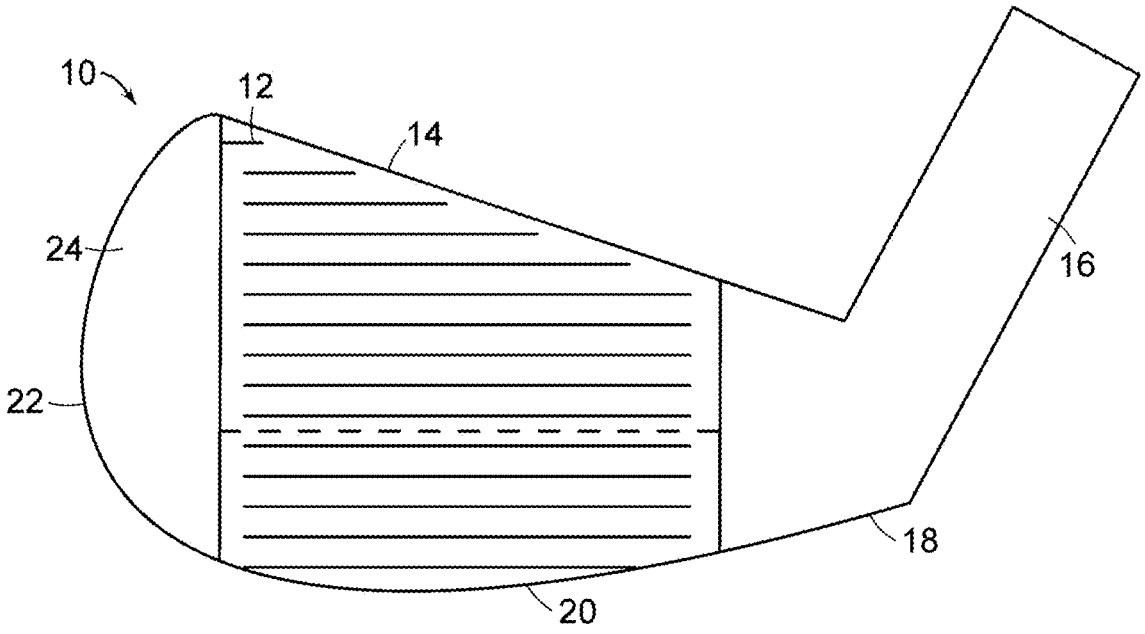
FIG. 1 is a front view of an embodiment of a golf club head in accordance with the present invention.
Figure 2:
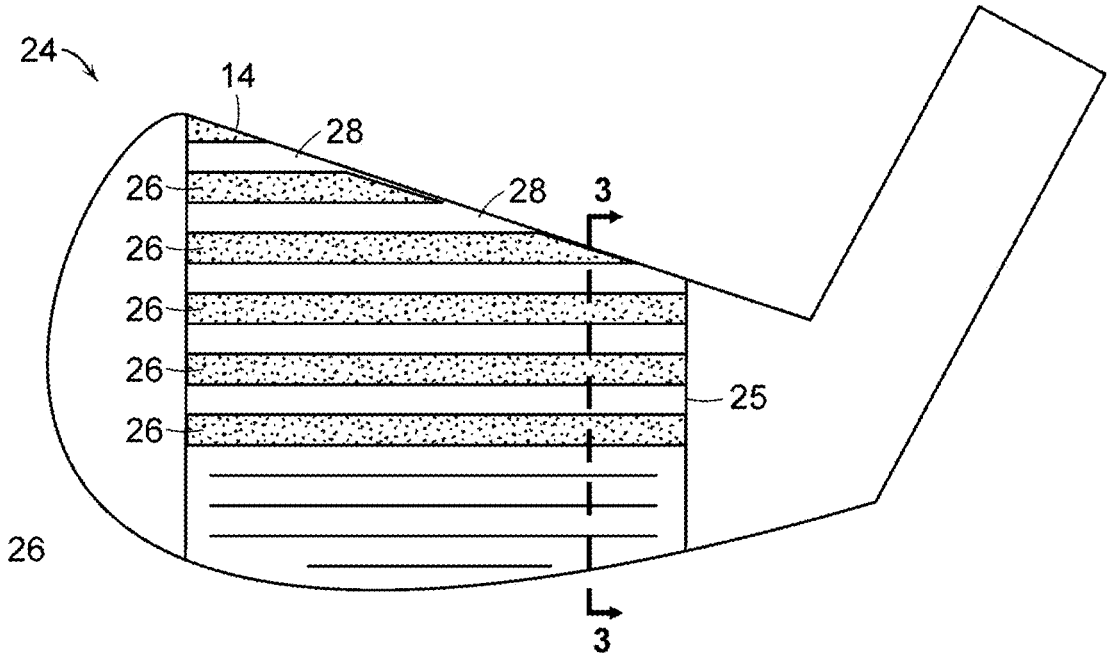
FIG. 2 is a front view of an embodiment of a body portion without the face insert of the present invention.
Figure 4:
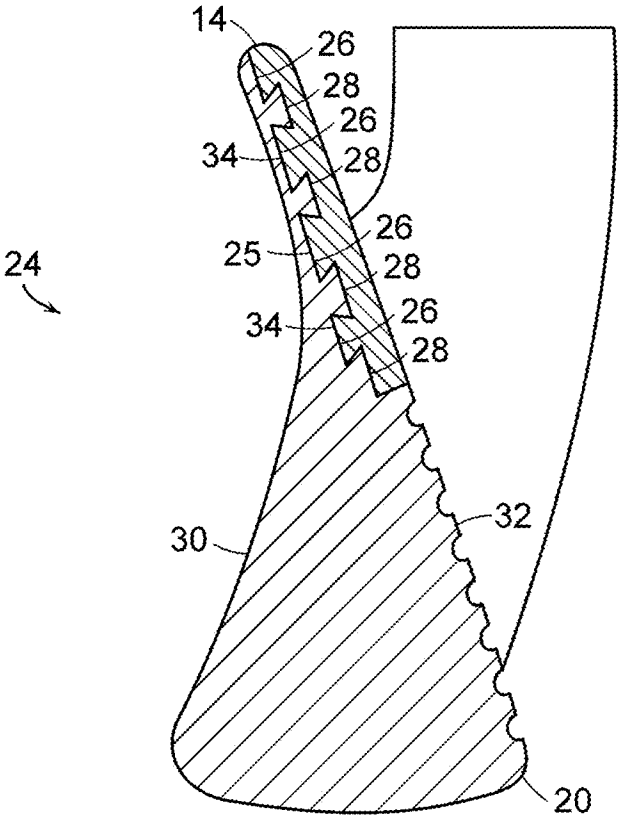
FIG. 4 is a cross-section view of the body portion showing another embodiment of the interlocking structure of the present invention.

The present invention is directed to golf club heads constructed from multiple components formed of different materials. In particular, a club head of the present disclosure includes a club head body, such as a cast or forged body portion, made from a first metal, and at least one removable component configured to be releasably attached to the club head body, the removable component being made from a second metal that is different than the first metal. The golf club head includes a semi-hollow, or completely hollow-bodied, ball-striking face cartridge made from at least titanium.

As will be described in greater detail herein, the face cartridge may be formed as part of the club head body itself, or may be formed separately. For example, in one embodiment, the hollow face cartridge may be formed integrally with the club head body, such that the club head body may generally include a top line, sole, heel, toe, and hosel extending from the heel, wherein the face cartridge includes at least the top line, sole, and toe portions. The face cartridge may further include an interlocking structure formed on a rear surface thereof and configured to interlock with at least one removable component, such as a weight. This interlocking structure includes at least a protrusion extending from the rear surface of the face cartridge and extends along a length of the face cartridge in a heel-toe direction and substantially parallel with the top line and/or sole. The removable component is configured to be removed from and re-attached to a rear portion of the club head body at least by way of the interlocking structure. The removable component includes, for example, a recess configured to receive and retain the protrusion of the interlocking structure within. Upon attachment, the protrusion is interlocked with the channel providing sufficient and stable attachment between the removable component and the club head body, specifically the face cartridge. The channel is shaped to further enhance the connection between the two components. These shapes include, but are not limited to, rectangular cross-sections and cross-sections having overhangs such as dovetail cross-sections.

In another embodiment, the face cartridge is formed separately from the club head body and is removably couplable thereto by way of an interlocking structure. For example, the club head body may include at least a portion of the heel and the hosel extending therefrom, as well as a mounting portion upon which the face cartridge can be removed from and re-attached to. The mounting portion may generally serve as a rear portion of the club head and further form a portion of the sole. Accordingly, the club head body may be arranged in such a way such that a majority of weight is concentrated in the mounting portion so as to lower the CG and further allow for improved perimeter weighting. The face cartridge may include the interlocking structure on a rear surface thereof. The interlocking structure may include at least a protrusion extending from the rear surface of the face cartridge and configured to interlock with a recess defined on a front surface of the mounting portion, wherein the channel is shaped to further enhance the connection between the two components, such as a dovetail cross-section.

The hollow face cartridge is designed in such a way so as to maximize performance of the club face while overcoming the drawbacks of typical titanium face club heads. For example, the face cartridge may be made from a single sheet of titanium or multiple sheets of titanium in such as manner so as to form a semi-hollow component (e.g., three sides, including a top line, sole, and ball-striking face with/without capped ends) or a completely hollow-bodied component (e.g., hollow interior enclosed by top line, sole, backing, ball-striking face, and capped ends). As generally understood, titanium material has high strength and low modulus, such that it is able to flex more than a stiffer material of the same thickness. Accordingly, the hollow ball-striking face can be constructed in such as manner so as to achieve a relatively thin face portion including thin perimeter returns (similar to a cup face), thereby allowing the face and sole portions of the hollow ball-striking face to offer maximum flex, which can result in higher launch angle, as well as increasing contact time between the face and the ball during impact, which can result in less back spin to be generated, resulting in increased shot distance.

Furthermore, the hollow titanium face cartridge construction allows for the club head to have a lower CG location (e.g., removal of heavier material from front of club head and relocating to the rear and sole) that provides a more efficient impact with the ball, increasing ball speed and providing higher launch, as the ball impact will be relatively close to the CG location, and CG is closer to the ground. The hollow titanium face cartridge further has potential to realize significant dynamic loft effects (e.g., increased loft of the club head at impact) due to a significantly deeper CG location (back from the face) that is difficult to achieve in other designs of similar head dimension, which results in higher launch angle.

The following description of FIGS. 1-18 refer to exemplary embodiments of a golf club head constructed from multiple materials, and, in some embodiments, multiple components. It should be noted that the face inserts of the club heads illustrated in FIGS. 1-18 are generally solid. However, as will be described in greater detail herein and further illustrated in FIGS. 19-47, some golf club heads consistent with the present disclosure include a semi-hollow or completely hollow ball-striking face (hereinafter referred to as "hollow face cartridge"), at least a majority of which is constructed from a titanium material. The hollow face cartridge may either be formed integrally with the club head body or formed separately and configured to be removed from and re-attached to the club head body.

Referring now to FIGS. 1-7, exemplary embodiments of a golf club head 10 in accordance with the present invention include a face insert 12 and body portion 24, which is attached to hosel 16. Hosel 16 is adapted to receive a shaft (not shown). Club head 10 is preferably cast or forged from suitable material such as stainless steel, carbon steel, or titanium. In one embodiment, body portion 24 is a cast body portion. Body portion 24 includes crown or top line 14, toe 22, sole 20 and heel 18 that form the perimeter of body portion 24. Hosel 16 extends generally from heel 18 of body portion 24. In one embodiment, club head 10 is arranged as muscle-back iron-type club head that has a thicker bottom back portion. Body portion 24 also includes front 32 forming the hitting surface.

Improvement in the location of the center of gravity of golf club heads in accordance with the present invention is achieved through the use of a composite construction that utilizes various materials having varying weights or densities. In particular, golf club head 10 utilizes two materials. Body portion 24 is constructed of a first material, for example a first metal, having a first weight or density. Suitable materials for the body portion 24 include, but are not limited to, stainless steel, carbon steel, beryllium copper, titanium and metal matrix composites (MMC). Preferably, body portion 24 is made from a higher density metal such as stainless steel or titanium. Club head 10 also includes face insert 12 attached to front 32 of body portion 24. Face insert 12 is constructed of a second material, i.e., a second metal having a second density. Suitable materials for face insert 12 include titanium, aluminum and alloys thereof. In one embodiment, the first weight or the first density is greater than the second weight or second density.

In order to move the center of gravity of club head 10 downward and to the rear, lightweight face insert 12 is attached to body portion 24 so that face insert 12 is disposed on front 32 of body portion 24 adjacent crown or top line 14. Therefore, face insert 12 forms a part of the club face or hitting surface of club head 10. To minimize delamination of face insert 12 from body portion 24, body portion 24 includes interlocking structure 25 formed on at least a portion of front 32 of body portion 24 adjacent top line 14. When face insert 12 is attached to or press fit on front 32 of body portion 24, face insert 12 is secured and anchored in interlocking structure 25. Optionally, adhesives, welds or other bonding agents can be used to help secure face insert 12 into interlocking structure 25. The interaction and meshing of face insert 12 with interlocking structure 25 is sufficient to fixedly secure face insert 12 to body portion 24.

In one embodiment, interlocking structure 25 contains at least one channel 26 running through a top of front 32 of body portion 24. Alternatively, a plurality of parallel channels 26 are formed in front 32 of body portion 24, further defining a plurality of associated ridges or raised portions 28. In one embodiment, the plurality of parallel channels 26 are arranged substantially parallel to top line 14 or sole 20 of body portion 24. In one embodiment, face insert 12 is pressed onto body portion 24, such that the second metal of face insert 12 substantially fills each channel 26 when face insert 12 is attached to body portion 24. Although channel 26 can be arranged as any shape including curves and annular shapes, preferably, channel 26 is a generally rectilinear line arranged parallel to sole 20.

Figure 3:
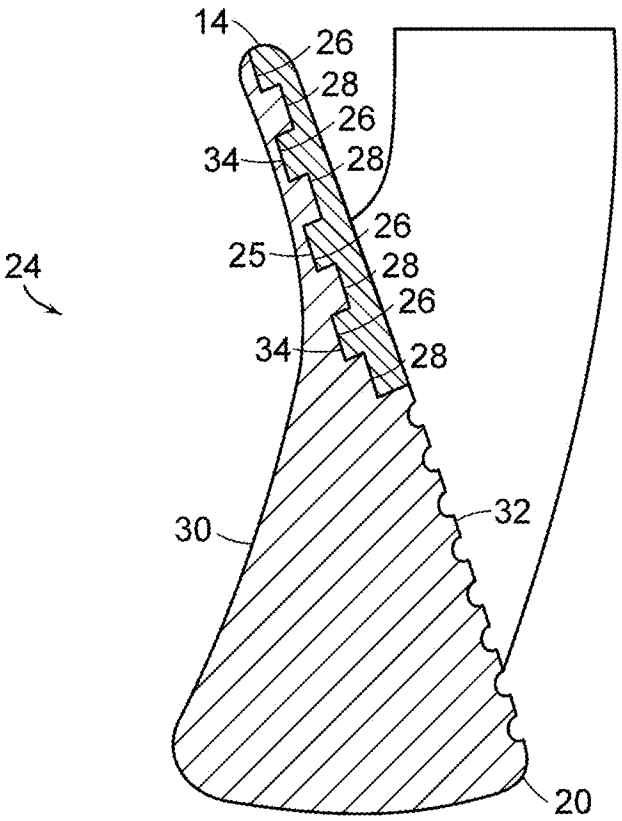
FIG. 3 is a view through line 3-3 of FIG. 2.
Figure 6:
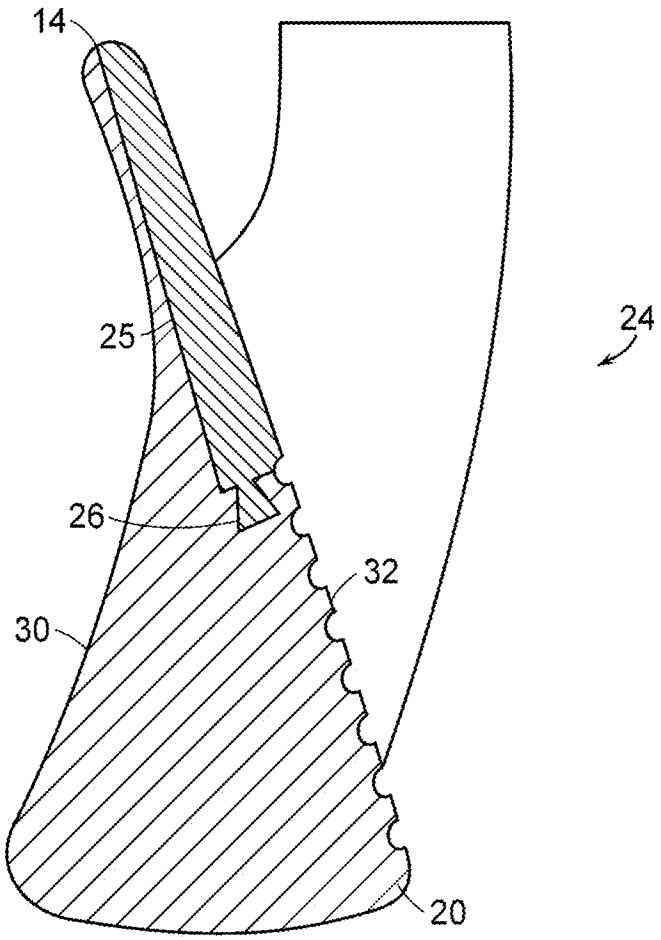
FIG. 6 is a cross-section of the body portion showing another embodiment of the interlocking structure of the present invention.
Figure 5:
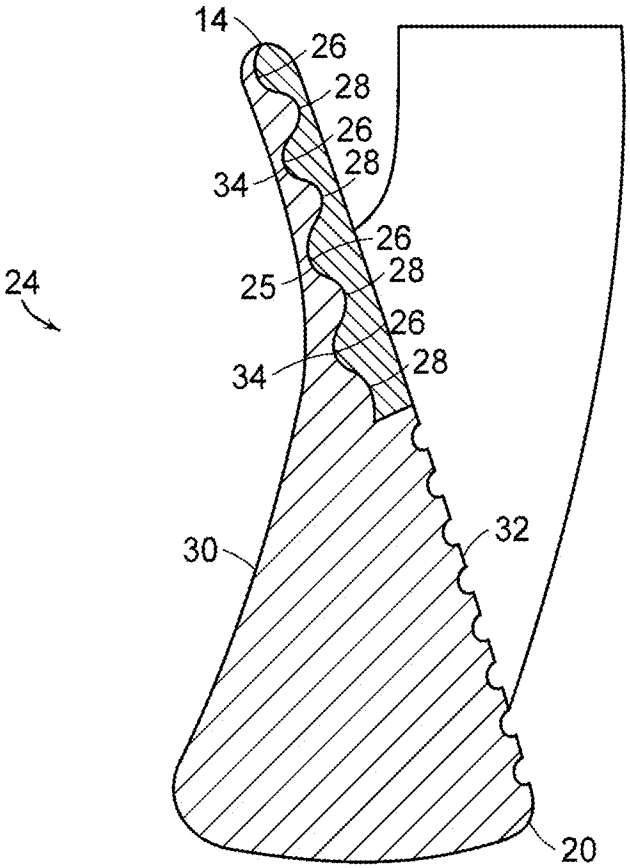
FIG. 5 is a cross-section of the body portion showing another embodiment of the interlocking structure of the present invention.

By embedding face insert 12 in interlocking member 25 having channel 26, a stronger more resilient bond is formed between face insert 12 and body portion 24. Depending on the shape, and in particular the profile in cross section, of the channel, both increased surface area contact and increased mechanical binding is achieved between body portion 24 and face insert 12 when press fit together. In one embodiment as illustrated in FIG. 3, each channel has a generally rectangular cross section. In another embodiment, at least one and preferably two undercuts 34 (FIG. 4) are provided in each channel. Undercut 34 is formed by making channel 26 narrow as it approaches its open end. In one embodiment, channel 26 has a dove tail shaped cross section. Alternatively, channel 26 has a generally rounded cross section (FIG. 5), for example circular or oval. Also ridge portion 28 can be rounded or curved outward to facilitate easier engagement between face insert 12 and body portion 24 when the two components are press fit together. Although in these embodiments, each channel 26 opens toward front 32 of body portion 24, other arrangements are also possible. For example, as illustrated in FIG. 6, channel 26 can open towards crown or top line 14 of body portion 24. Preferably, channel 26 has a dove tail shaped cross section in this embodiment. Face insert 26 will become embedded in this upwardly opening channel when attached to body portion 24, preferably with adhesives.

Figure 7:
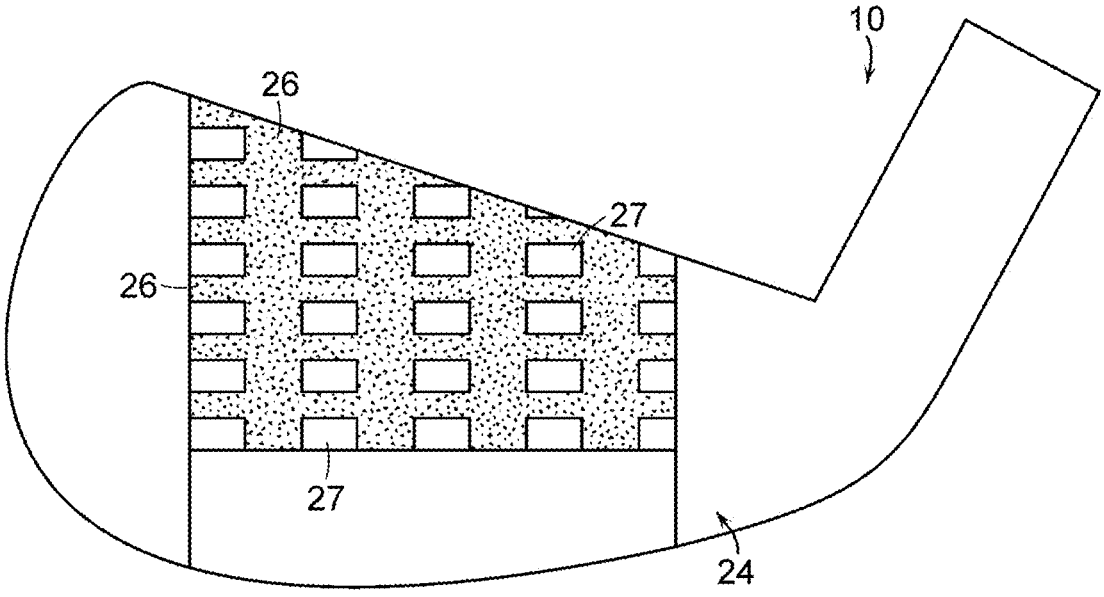
FIG. 7 is another embodiment of FIG. 2.

In another embodiment, interlocking member 25 comprises a plurality of upstanding posts 27 formed by intersecting channels 26, e.g., one set of horizontal channels 26 and another set of vertical channels 26 as shown in FIG. 7. Face insert 12 can be hammered or pressed onto body portion 24, for example by swaging or cold-forging. This method can also be used with the embodiments shown in FIGS. 4 and 5.

In one embodiment, in order to form the interlocking structure on the front of the body portion, at least one channel is formed that runs through the portion of the front of the case body. Alternatively, a plurality of parallel channels is formed in the front of the body such that each channel is parallel to at least one of the top lines or the sole of the body portion. The channel can be formed to have a generally rectangular cross section. Alternatively, the channel is formed to have a dove tail shaped cross section. Having formed the interlocking structure in the front of the body, the face insert is pressed onto the front of the cast body to secure a portion of the face insert in the interlocking structure.

Exemplary embodiments in accordance with the present invention include a method for making a golf club head by forming an interlocking structure on at least a portion of the front of the body portion of golf club head adjacent a top line thereof. As was described above, the body includes the top line, sole, toe, heel, front and back opposite the front opposite, and the body is made from a first metal. A face insert is attached to the front of the cast body by securing a portion of the face insert in the interlocking structure of the body. The face insert is constructed of a second metal. The first and second metals are selected such that the first metal has a greater density or weight than the second metal. For example, the first metal is selected to be titanium or a titanium alloy, and the second metal is selected to be aluminum or an aluminum alloy. The face insert 12 can occupy between 10% and 40% of the volume of the club head.

Low-density, high-strength alloys such as those made from aluminum are particularly suitable for the present invention. The following table illustrates the masses and thickness of corresponding typical face inserts for iron-type golf clubs:

| Face Insert Material | Typical Face Insert Thickness | Approx. Mass of Face Insert |
|---|---|---|
| High Strength Steel | 0.090 in. | 50 g |
| Titanium | 0.120 in. | 40 g |
| High Strength Aluminum | 0.140 in. | 30 g |

The differences in the thickness of the face inserts for the different materials are necessary due to the varying material strengths; these face inserts have substantially similar strengths. Of the three materials, steel is the strongest, and thus can have the thinnest face, but it has a higher density than both aluminum and titanium. Consequently, even a thinner steel face has a mass greater than either of the titanium or high-strength aluminum faces. Furthermore, the high-strength aluminum face insert's low density allows more mass to be redistributed for an improved center of gravity location and size of the sweet spot.

When a low-density metal such as a high-strength aluminum alloy is used for a face insert, it should be an alloy with suitable material strength and mechanical properties such as yield strength, tensile strength, hardness, elongation, etc., to avoid club failure or performance deterioration. Preferably, a high-strength aluminum alloy such as an alloy containing Scandium and 7-series high strength aluminum alloy ("Sc-7") or an aluminum alloy containing a percentage of ceramic ("MSC") is used. Material properties for these alloys, as well as suitable alloys MMC-7 and 13A, are listed in the table below.

| Alloy: | MMC-7 | Sc-7 | 13A | M5C |
|---|---|---|---|---|
| Al Series: | 7xxx | 7xxx | 6xxx | 5xxx |
| Chemical Composition: | Al—1.5Mg—4.0Zn + 6SiC | Al—1.5Mg—4.0Zn + Sc | Al—0.9Mg + Sc | Al—5.0Mg + ceramic (approx. 0.8%) |
| Hardness: | 56 HRB | 81 HRB | 80 HRB | 65 HRB |
| Tensile Strength: | 49 ksi | 70 ksi | 62 ksi | 51 ksi |
| Yield Strength: | 45 ksi | 62 ksi | 54 ksi | 37 ksi |
| Elongation: | 11% | 10% | 11% | 14% |
| Face Thickness Preferred: | 3.2 mm (0.1260 in.) | 3.2 mm (0.1260 in.) | 3.2 mm (0.1260 in.) | 3.2 mm (0.1260 in.) |

However, aluminum alloys, including high-strength aluminum alloys such as Sc-7 and MSC, can be susceptible to corrosion, and in some cases more than traditional stainless steel or titanium materials. When aluminum alloys are in contact with steel alloys, galvanic corrosion can also adversely affect the aluminum.

In accordance with an embodiment of the present invention, the metals of the inventive golf club are oxidized, more preferably anodized, to improve its strength and corrosion resistance. Oxidation of many untreated metals such as aluminum occurs naturally as the metal undergoes prolonged contact with air. Anodization is a process used to modify the surface of a metal, and it produces a much more uniform, more dense, and harder oxidation layer than what is formed by natural oxidation. It can be used to protect the metal from abrasion or corrosion, create a different surface topography, alter the crystal structure, or even color the metal surface. During anodization, a chemical reaction occurs, producing an oxide layer bonded to the surface of the metal. For example, to anodize an aluminum or aluminum alloy object, the object is first pre-treated by an ordinary degreasing. Then the surface is freed of scratches or existing oxides, preferably by an etching process. The object is submerged in a chromic acid or more preferably a sulfuric acid solution. Next, an aluminum oxide layer is made on the object by passing a DC current through the chromic acid or sulfuric acid solution, with the aluminum object serving as the anode. The current releases hydrogen at the cathode and oxygen at the surface of the aluminum anode, creating a buildup of aluminum oxide. Anodizing at 12 volts DC, a piece of aluminum with an area of about 15.5 square inches can consume roughly 1 ampere of current. In commercial applications the voltage used is usually in the range of about 15 to 21 volts. Conditions such as acid concentration, solution temperature and current are controlled to allow the formation of a consistent oxide layer, which can be many times thicker than would otherwise be formed. This oxide layer increases both the hardness and the corrosion resistance of the aluminum surface. The oxide forms as microscopic hexagonal "pipe" crystals of corundum, each having a central hexagonal pore, which is also the reason that an anodized part can take on color in the dyeing process. Following the formation of a satisfactory oxide coating, the anodized object is often sealed to maximize the degree of abrasion resistance. Sealing can be accomplished by immersing the object in a sealing medium, such as a 5% aqueous solution of sodium or potassium chromate (pH 5.0 to 6.0) for 15 minutes at a temperature from about 90° C. to 100° C., boiling de-ionized water, cobalt or nickel acetate, or other suitable chemical solutions.

Different types of anodizing, Type I, II, and III, are explained in MIL-Spec MIL-A-8625F (Anodic Coatings for Aluminum and Aluminum Alloys), which is hereby incorporated by reference. Most preferably, the face insert is hard-anodized with a Type III coating according to MIL-A-8625F. This hard anodic coating is thicker than standard Type I or Type II anodic coatings by up to 0.0035 inches, and penetrates deeper within the coated metal than standard Type I or Type II anodic coatings. The following table from MIL-A-8625F shows the common thickness ranges among the types of anodic coatings.

| Coating Type | Thickness Range (Inches) |
|---|---|
| Type I, IB, IC, IIB | 0.00002 to 0.0007 |
| Type II | 0.00007 to 0.0010 |
| Type III | 0.0005 to 0.0045 |

Commercial examples of Type III-compliant anodizing processes include the Sanford Hardcoat® process by Duralectra of Natick, Mass. and hardcoat anodizing done by Alpha Metal Finishing Co. of Dexter, Mich., both of which are hereby incorporated by reference. The Type III hard-anodizing process is similar to Type I and II processes, but Type III uses a sulfuric acid bath at a lower temperature, approaching 0° C., as well higher currents. In accordance with MIL-A-8625F, Type III coatings are generally not applied to aluminum alloys having a nominal copper content in excess of 5% or nominal silicon content in excess of 8%. Alloys which have a porosity of greater than about 5% less preferred for Type III coatings. In addition, Because Type III coatings have increased abrasion resistance, sealing or infusing the coating with a polymer in the same manner as Type I and II, as discussed in more detail below, is not required, and the coating can remain somewhat porous. Furthermore, having a porous unsealed structure allows the hard-anodic coating to be infused with a colored dye to change the appearance of the object, or a polymer such as polytetrafluoroethylene (PTEE) or a polyepoxide (epoxy) or polyurethane-based resin to adjust the frictional characteristics of the object.

A method for infusing a hard-anodic coating with a polymer is disclosed in U.S. Pat. No. 5,439,712 to Hattori et al. entitled "Method for Making a Composite Aluminum Article," the entirety of which is hereby incorporated by reference. Once the hard-anodization process is complete, the anodized object is immersed in an infusion solution. This infusion solution contains positively-charged polymer particles dispersed into the solution using a nonionic active agent. The solution and the aluminum object are heated to a temperature ranging from 40° C. to 80° C., and a voltage of 2 to 10 volts is applied. The aluminum object acts as an anode, and the positively-charged polymer particles become absorbed into the hard anodic coating to form a uniform monomolecular layer. As can be appreciated by those skilled in the art, any positively-charged polymer particles can be used, and depending upon the type of alloy or polymer that is used, the temperature and voltage may vary.

Figure 8:
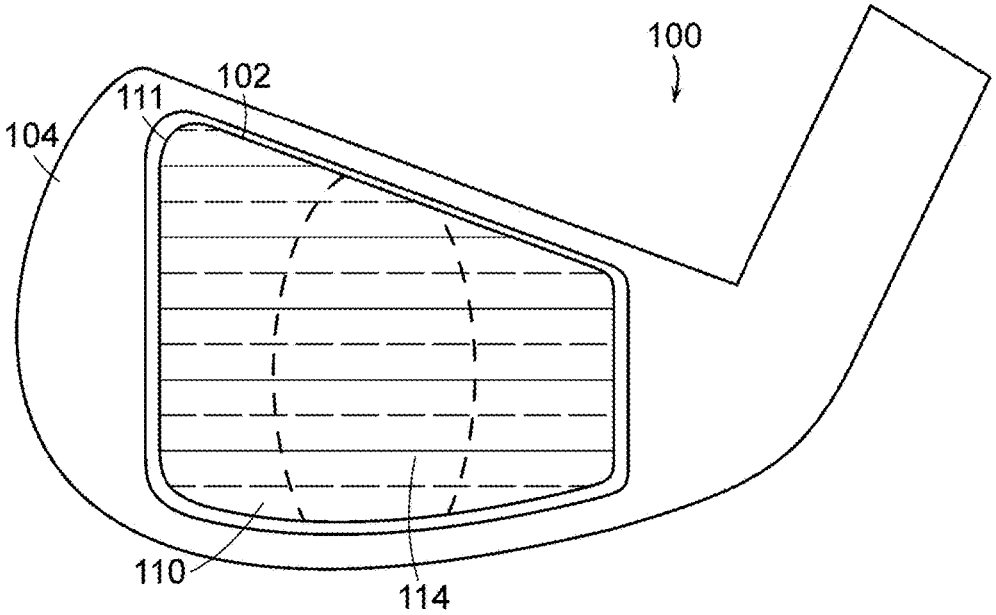
FIG. 8 is a front view of an embodiment of a club head of the present invention.
Figure 9:
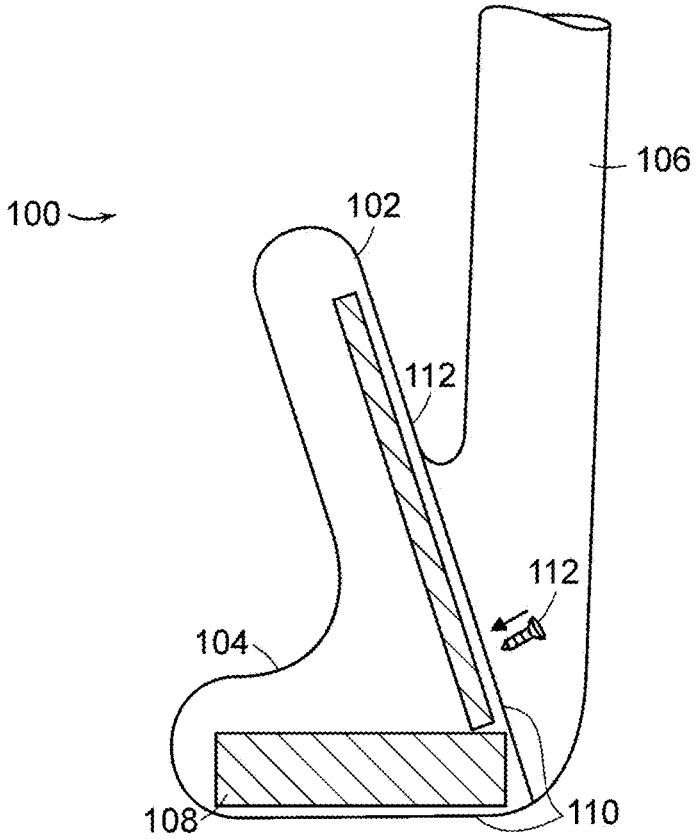
FIG. 9 is a cross-sectional view of an embodiment of a club head of the present invention.
Figure 9B:
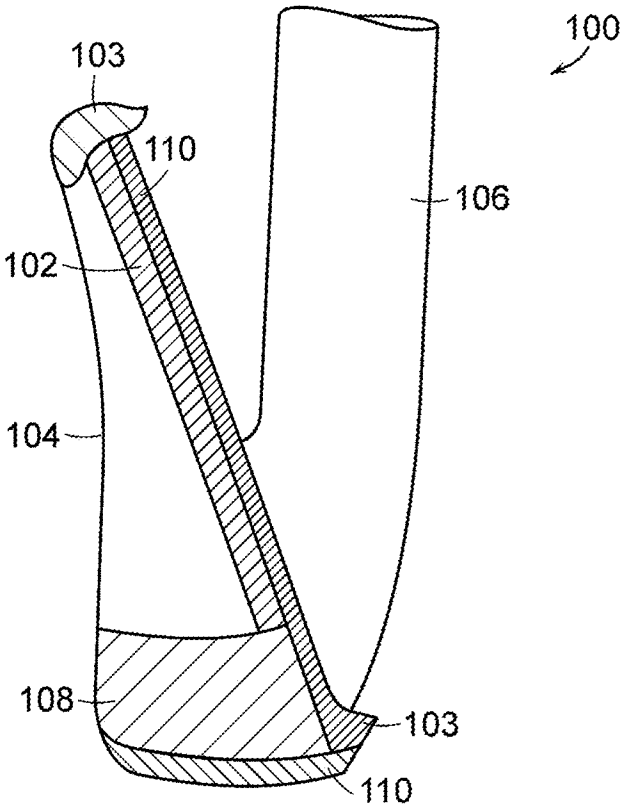
FIG. 9B is a cross-sectional view of another embodiment of a club head of the present invention.

FIGS. 8 and 9 show an embodiment of the present invention, with face insert 102 attached to body 104 of club head 100. Face insert 102 is preferably hard-anodized, i.e., Type III, before attachment so that it is coated with hard-anodic coating 110. After the face insert is hard-anodized, it is preferably attached to the body of the club head via a resin 111 such as epoxy or urethane, with the perimeter of face insert 102 supported on the reverse side by a ledge (not shown) that is part of club head body 104. However, various other methods of attachment may be envisioned by those skilled in the art, including the attachment methods mentioned in previous embodiments. Other methods of attachment include, but are not limited to, using screws 112 as shown in FIG. 9, or cold-forging or swaging a portion 103 of body 104 over face insert 102 shown in FIG. 9B to retain face 102. Insert 102 may have a thin ledge around its periphery sized and dimensioned to receive portion 103, so that the hitting face is flat. In addition, it may be advantageous to drill larger than normal holes in face insert 102 for screws 112, as coating 110 will fill in some of the area during the anodizing process, or else use smaller sized screws.

Although hard-anodic coatings are often uncolored, gray, or clear, the face insert may be hard-anodized with a colored or dyed coating to create an improved aesthetic effect. The Sanford Hardcoat® process by Duralectra mentioned above has the capability of applying a hard-anodic coat with color to aluminum. Coloring can also be accomplished through a two-step electrolytic method, an integral coloring process which combines anodizing and coloring, organic or inorganic dyeing through polymer infusion as mentioned above, interference coloring, etc. Such a colored coating could be used to effectively outline or shade a hitting area or "sweet spot" on the club head. Sweet spot 114 in FIG. 8 is an example of such a colored region on the face insert. Coloring only a portion of an object can be done by masking the parts of the object that are not to be anodized with a protective coating mask. Such a coating or masking is often made from vinyl or other polymers and is usually made to be easily applied and removed. A commercially available peelable mask appropriate for hard-anodizing procedures is the PlateOff Mask 4210, available from General Chemical Corp. of Detroit, Mich.

Figure 9A:
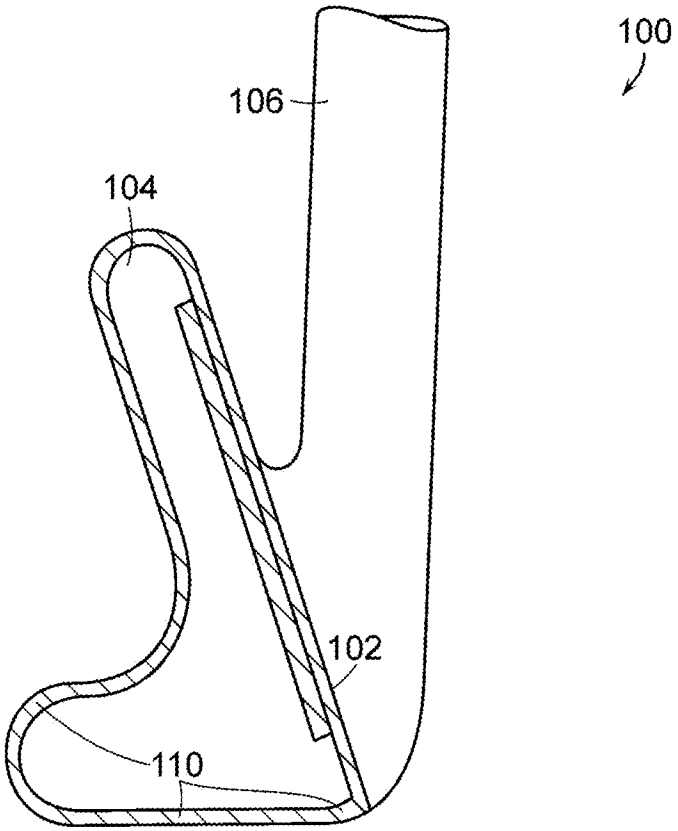
FIG. 9A is a cross-sectional view of another embodiment of a club head of the present invention.

The present invention is not limited to examples wherein only the face insert is hard-anodized. Although face insert 102 is preferably constructed from a lighter, less dense material than club head body 104, it is possible to attach the face insert to club head body 104 prior to the anodization process. As shown in FIG. 9A, once face insert 102 is attached, then the entire club head 100, including body 104 and face insert 102, may be substantially coated by hard-anodic coating 110. This is especially preferable when face insert 102 is made from aluminum or aluminum alloy, and when club head body 104 is made from titanium or titanium alloy, as these materials may easily be anodized. Whereas aluminum is anodized according to MIL-A-8625F, titanium is anodized according to AMS-2488 or MIS-23545, both of which are hereby incorporated by reference. The Tiodize® Company of Huntington Beach, Calif. processes titanium and titanium alloys according to these specifications under the name of the Tiodize® Processes, all of which are hereby incorporated by reference. The Tiodize® Company produces a brochure titled "Tiodize Process" explaining their processes, which is also hereby incorporated by reference. Titanium is generally anodized in a similar manner as aluminum, by immersing a titanium object in a solution and running an electric current through the solution. However, titanium is typically immersed in an alkaline solution at room temperature, unlike aluminum and its alloys. Although the processes for anodization of aluminum and titanium are not the same, masking may be done during the counterpart anodizing process to avoid interference between the coatings or metals. This embodiment also provides club designers with a wider range of options for attachment methods than if face insert 102 is hard-anodized prior to attachment to club head body 104 to minimize any possible damage to the hard-anodic coating 110 during the attachment process when body 104 and insert 102 have been connected prior to anodization.

Figure 11:
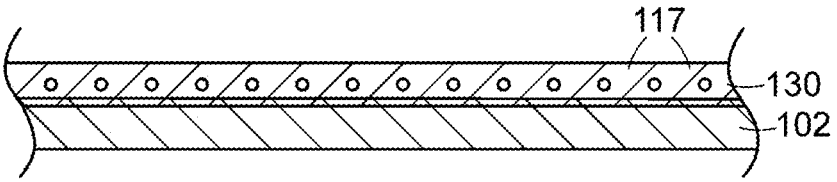
FIG. 11 is a cross-sectional view of an infused hard-anodic coating applied to a face insert according to the present invention.

In yet another embodiment, as shown in FIG. 11, a hard-anodic coating may be infused or impregnated with a polymer 117, preferably a fluorinated polymer such as polytetrafluoroethylene (PTFE), commonly known and available as Teflon® from DuPont, to form low-friction coating 130. Such a process is commercially available as the Sanford Hardlube® process by Duralectra, which is hereby incorporated by reference. The anodized object is immersed in a solution that contains positive PTFE ions and an electrical current is applied. The positive ions become attracted to the object, which acts as an anode, and become infused into the pores of low-friction coating 130. Impregnating the hard-anodic coating with PTFE is especially advantageous when low-friction coating 130 is applied to the faces of golf clubs such as drivers or fairway woods, shown in FIGS. 12-13, where reduced spin is desired, because PTFE has one of the lowest known coefficients of friction.

Figure 10:
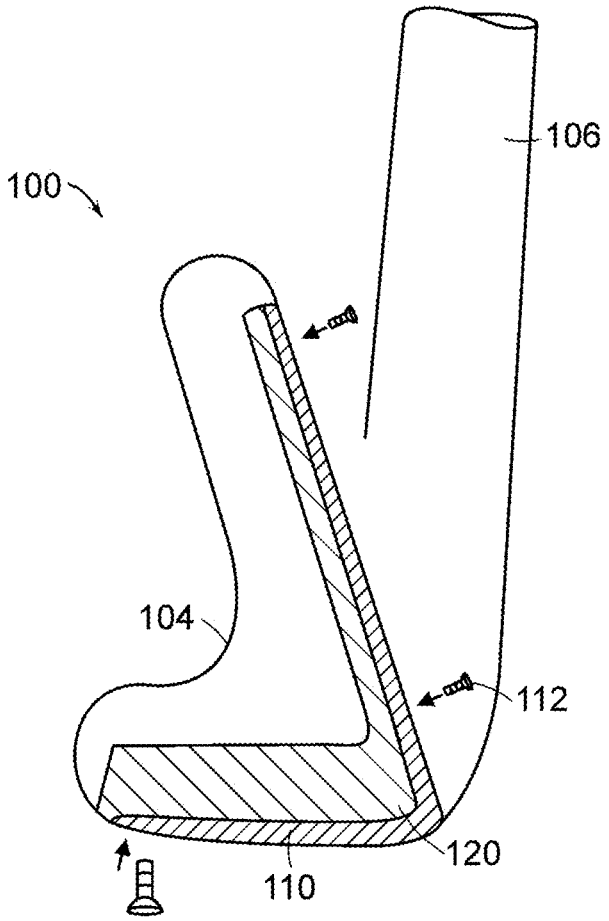
FIG. 10 is a cross-sectional view of another embodiment of a club head of the present invention.

An optional sole plate 108 may be hard-anodized with regular hard-anodic coating 110 or with a low-friction coating 130 impregnated by a polymer such as PTFE, the latter of which provides a further benefit in fairway woods in that the club will have more protection and encounter less friction when sole plate 108 makes contact with the ground, increasing swing speed and club longevity. The hard-anodic sole plate 108 is also advantageous as applicable to drivers, especially when hitting off a standard plastic driving range mat, due to the reduced friction and extra protection provided by the PTFE-infused coating. This is further applicable to iron-type club heads (as shown in FIG. 9) or putter clubs. As shown in FIG. 10, in an alternative to a separate sole plate 108, a unitary face/sole piece 120 may be provided by the current invention, with said unitary piece 120 preferably being hard-anodized with a low-friction coating 130 infused with PTFE. Unitary piece 120 may act to provide much of the same benefits of the separate inventive face insert and sole plate as seen in previous embodiments, but adds further protection and reduced friction to the lower portion of the club head 100.

Figure 11A:
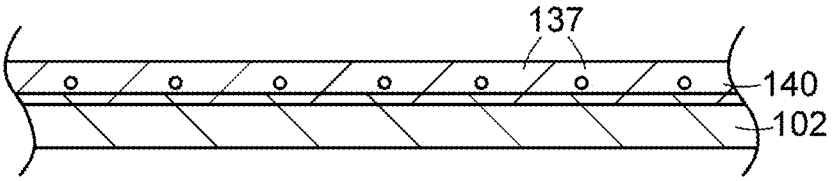
FIG. 11A is a cross-sectional view of another infused hard-anodic coating applied to a face insert according to the present invention.
Figure 12:
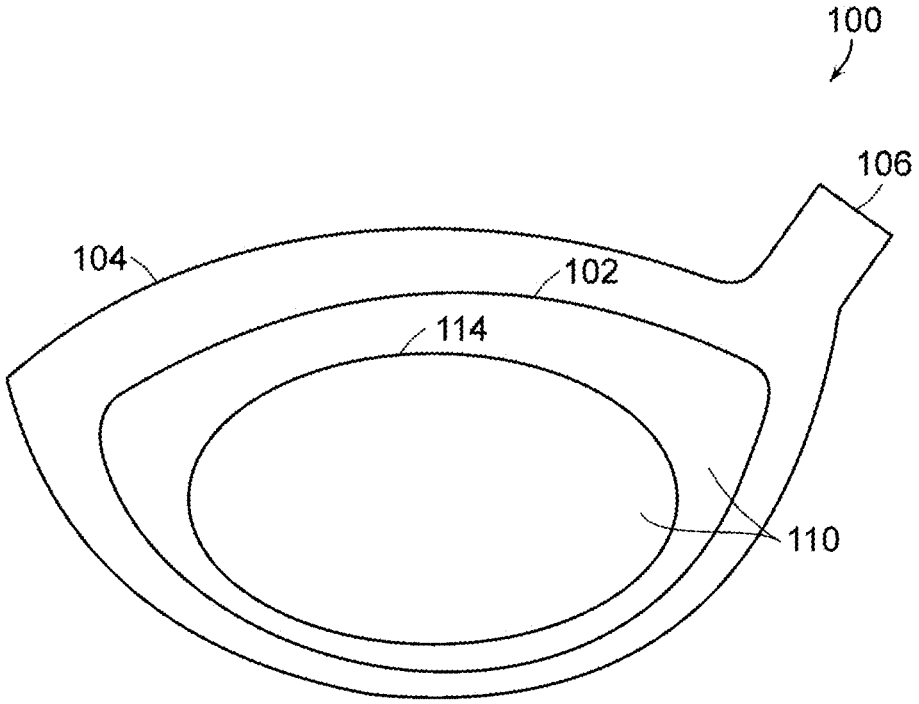
FIG. 12 is a front view of an embodiment of a driver-type club head of the present invention.
Figure 13:
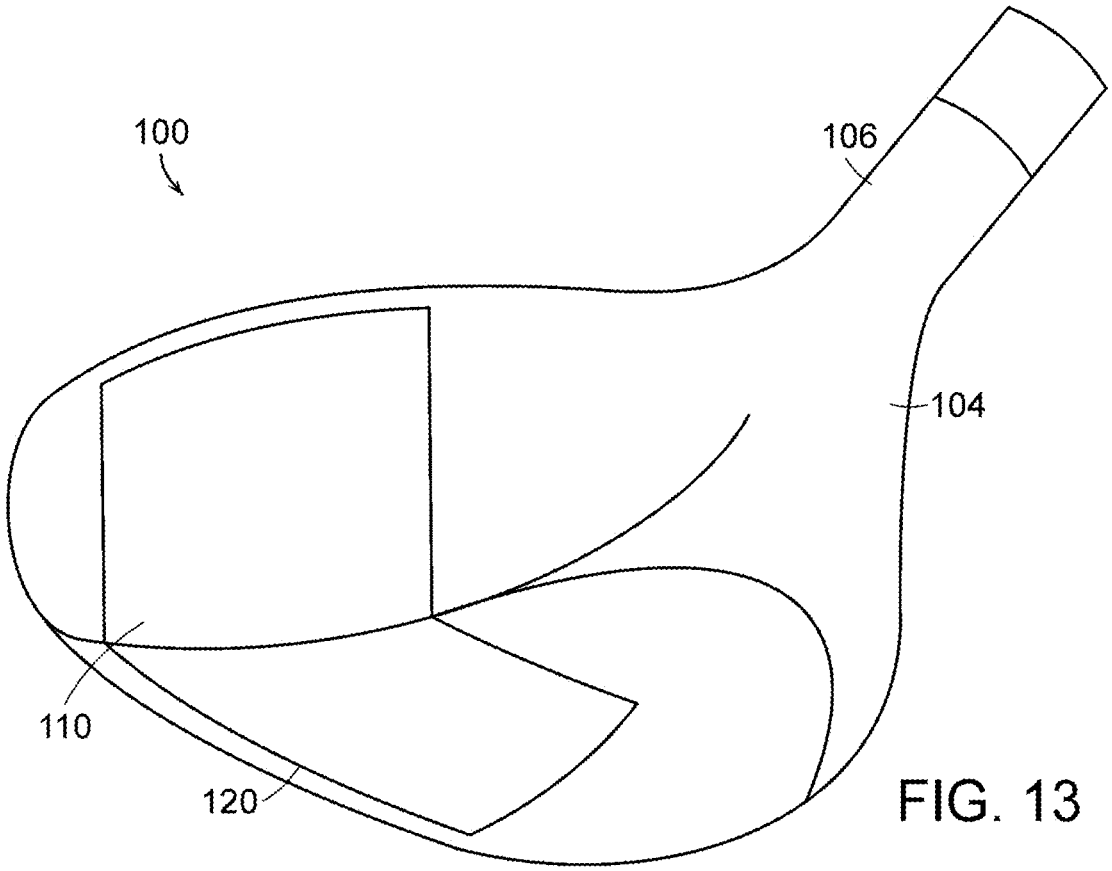
FIG. 13 is a perspective view of another embodiment of a driver-type club head of the present invention.

As shown in FIG. 11A, in another embodiment, when increased spin is desired, i.e., in iron-type clubs, the hard anodic coating over the face insert 102 may be sealed with a higher-friction polymer material 137 such as an epoxy-based resin, polyurethane, or polyurea to become hard-anodize increased-friction coating 140. This is advantageous for highly skilled golfers who desire increased control of the ball when hitting approach shots into greens, because it will increase the friction between the ball and face insert 102, allowing more control and "workability" for whatever type of shot is desired. The process for infusing the coating with high-friction polymers is similar to the process used for PTFE above. The anodized object is immersed in a solution that contains positive polymer ions and an electrical current is applied. The positive ions become attracted to the object, which acts as an anode, and become infused into the pores of increased-friction coating 140, sealing the structure. In one example, selected iron-type clubs from a set, such as the short irons and wedges, are constructed with increased-friction coating 140 to increase ball spin and control to the short game.

Figure 14A:
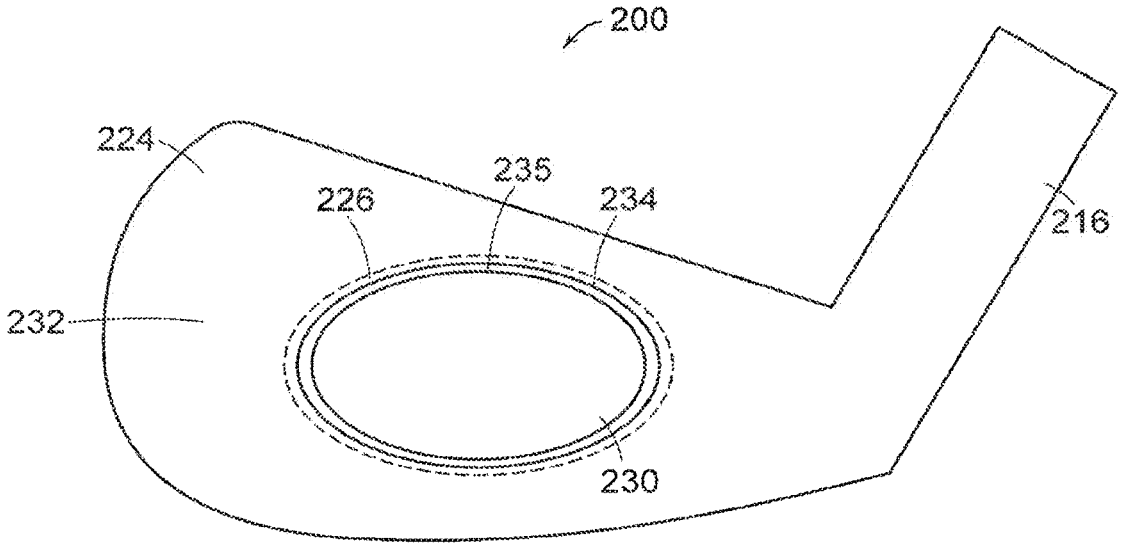
FIG. 14A is a front plan view of a golf club head of the present invention, shown without a face insert.
Figure 16:
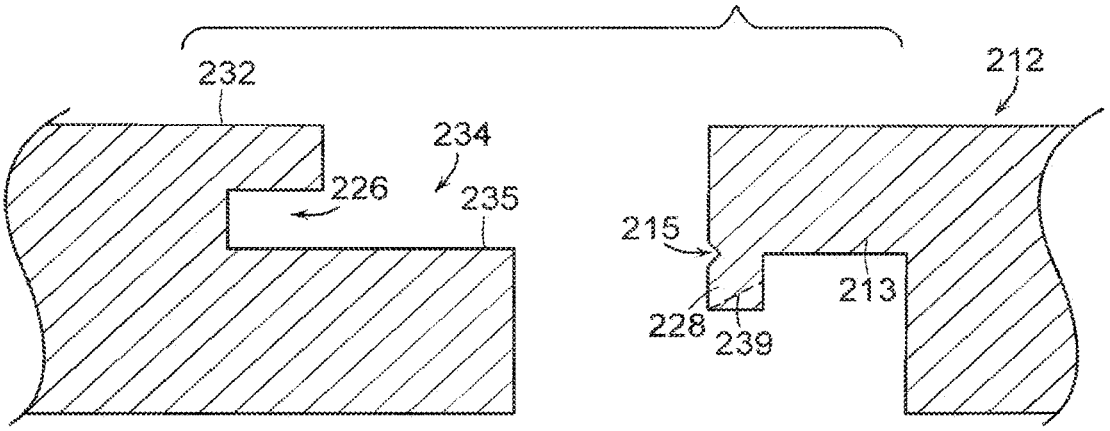
FIG. 16 is a cross-sectional view of a portion of the front of a golf club head and a portion of a face insert of the present invention.

Another embodiment of the present invention is shown in FIGS. 14A-16. Golf club head 200 comprises hosel 216, body portion 224 and face insert 212. Body portion 224 includes a crown, a skirt, a sole and front 232 having cutout 230, sized and dimensioned to receive face insert 212. Cutout 230 can further comprise stepped edge 234 and pocket 226. Stepped edge 234 comprises a lower ledge 235 positioned between 3.0 and 5.0 millimeters below the surface of front 232, as shown in FIG. 14A. More preferably, lower ledge 235 is positioned between 3.5 and 4.0 millimeters below the surface of front 232. Pocket 226 is preferably machined into front 232 around the circumference of stepped edge 234 and underneath front 232, so that their openings are not visible from a front plan view of the golf club head. Face insert 212 has upper ledge 213 adapted to be received on top of lower ledge 235 on stepped edge 234, as best shown in FIG. 16.

Figure 14B:
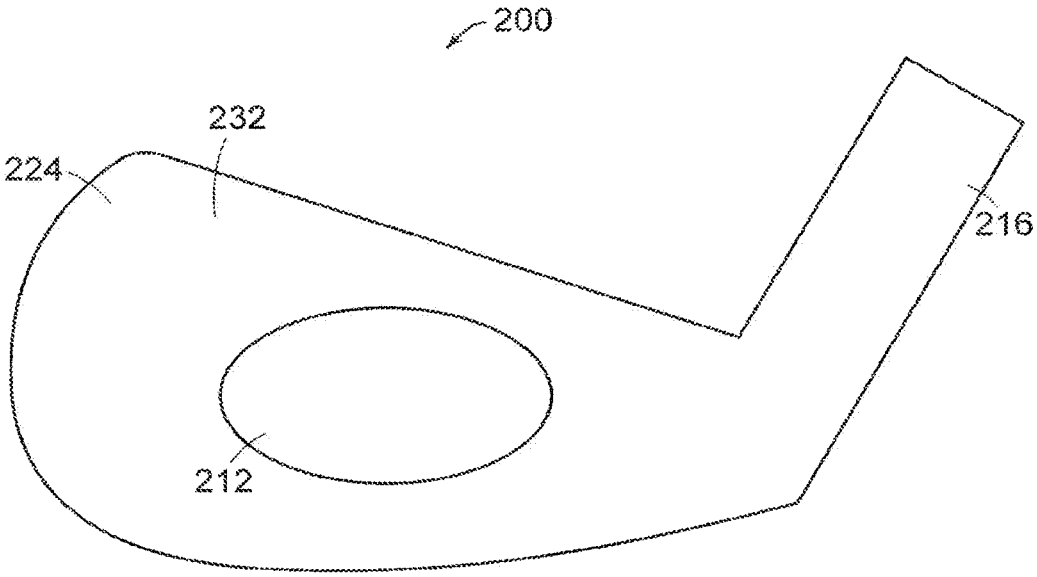
FIG. 14B is a front plan view of the golf club head of FIG. 14A, shown with a face insert.
Figure 15A:
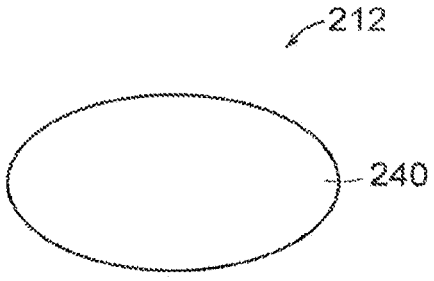
FIGS. 15A and 15B are a top plan and bottom plan views, respectively, of a face insert of the present invention.
Figure 15B:
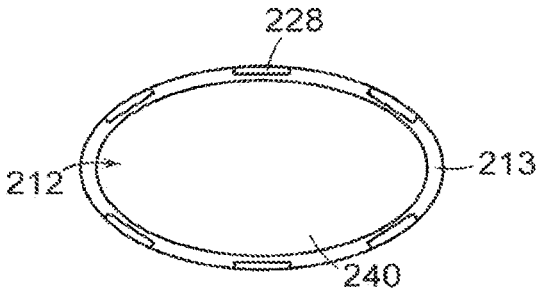

In accordance with this embodiment, face insert 212 is attached to front 232 at cutout 230 so that the top surface of face insert 212 is flush with the surface of front 232. Preferably, the thickness of face insert 212 is substantially the same as the thickness of front 232. To retain face insert 212 to front 232, upper ledge 213 and feet 228 of face insert 212 rest on lower ledge 235 of stepped edge 234 and feet 228 are inserted into pocket 226. As shown in FIG. 16, feet 228 are positioned substantially downward and pocket 226 is oriented substantially sideways. To ensure proper attachment, feet 228 are at least partially plastically deformed into pocket 226. Optionally, some residual elasticity in feet 228 after being bent can ensure a tight fit. To assist the bending of feet 228 in the proper direction, feet 228 can be initially oriented outward toward pocket 226 (not shown). Alternatively, to assist in the outward bending of feet 228 notch(es) 215 or other weakened sections can be included on feet 228 to assist the bending, or angled surface 239 can be used. Preferably, feet 228 are securely disposed in pocket 226 by swaging or cold-forging, causing feet 228 to plastically deform to fit pocket 226. More preferably, feet 228 are inserted into pocket 226 by the process of micro-swaging, wherein approximately 15 tons of force are used to bend said feet into said pocket. This process requires significantly less force than typical swaging processes, which require about 80 tons of force to plastically deform a part. Feet 228 may have a substantially rectangular shape or may have any shape suitable for swaging. Pocket 226 may comprise a plurality of pockets having a substantially similar shape to feet 228. Main portion 240 of face insert 212 may have a substantially oval shape or any suitable shape to create a hitting surface on front 232. After insertion and swaging, feet 228 are preferably not visible from any exterior view of club head 200, as is illustrated in FIG. 14B.

To further secure face insert 212 to front 232, an adhesive or glue, such as 3M® Scotch-Weld® Epoxy Adhesive DP420, may be used to adhere upper ledge 213 of face insert 212 to lower ledge 235 of front 232. The addition of glue to the face insert-body portion subassembly not only enhances the attachment of said components, but also improves the sound and feel of the impact between club head and ball. Furthermore, the sound at impact can be controlled (hard vs. soft) by controlling the amount of glue used. It should be noted that during testing, a model club head made according to the present invention without the use of glue or adhesive was subjected to 3000 hits and produced no adverse feel or sound (rattling, looseness, etc.).

Figure 17:
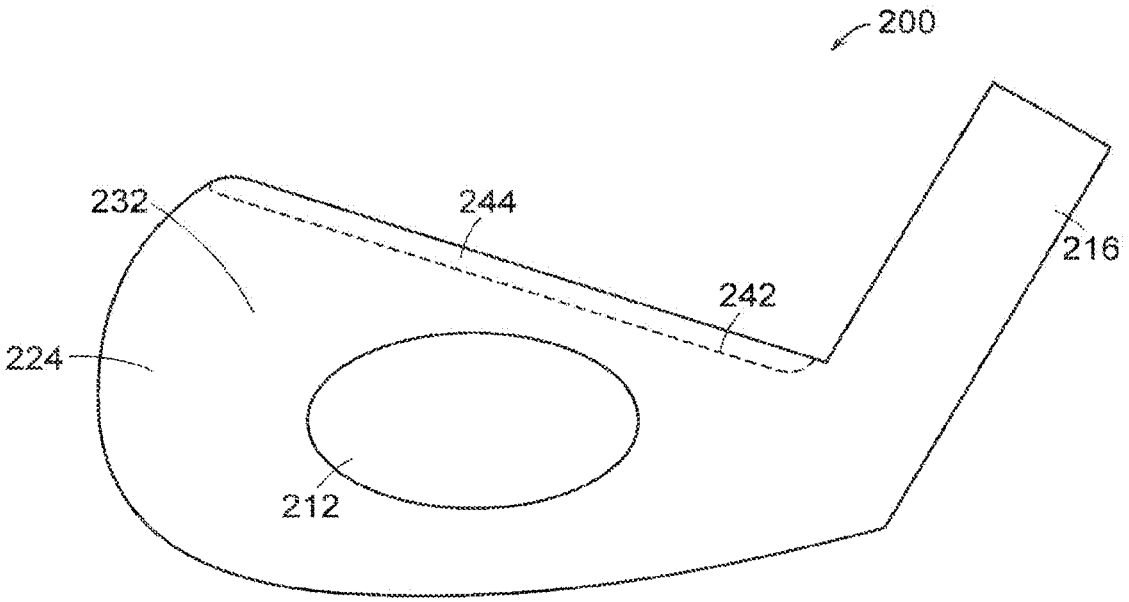
FIG. 17 is a front plan view of a golf club head of the present invention including a top line insert.

Golf club head 200 may further comprise top line insert 244, as shown in FIG. 17. Cavity 242 may be machined into or otherwise created in the top line of golf club 200 such that insert 244 may be received into cavity 242. Top line insert 244 preferably comprises a material having a density less than the density of face insert 212 and may have any shape suitable for positioning at the top line of an iron-type golf club head. For example, top line insert 244 may comprise aluminum, an aluminum alloy or a polymer. More preferably, top line insert 244 comprises a material having a density less than 2.85 g/cm3. The placement of the lightweight insert at the top line of golf club head 200 causes the center of gravity of the golf club head to move downward to a more optimal position.

Figure 18:
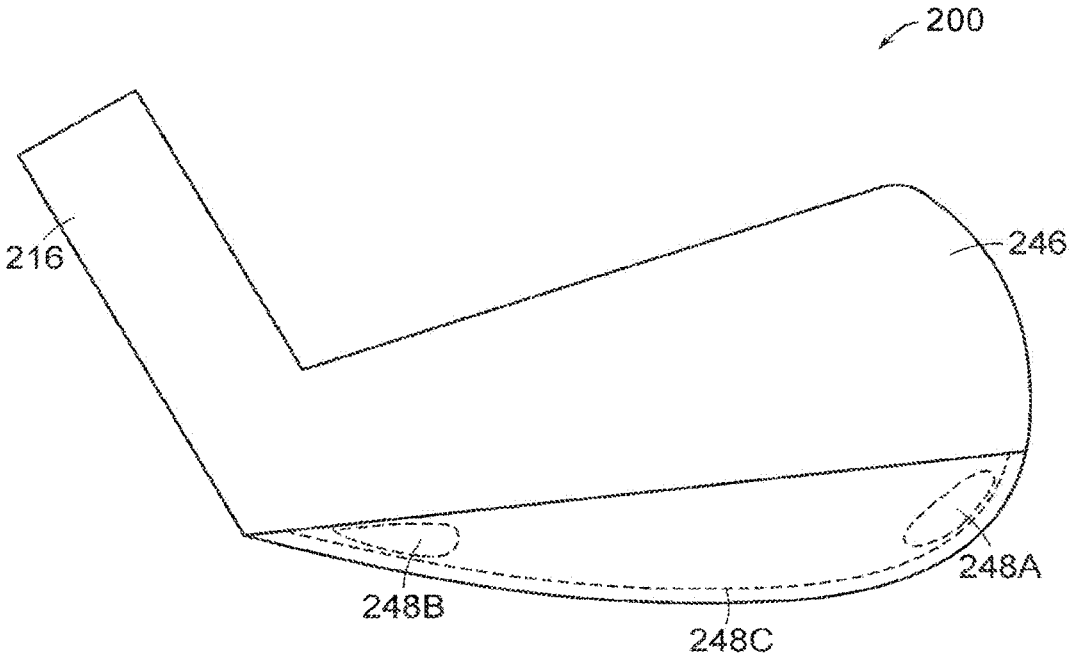
FIG. 18 is a back plan view of the golf club head of FIG. 17 including a plurality of weight members disposed on the back of the club head.

In addition to top line insert 244, golf club head 200 may also include any one of or any combination of high density weight members 248A-C, disposed to back 246, as shown in FIG. 18. Golf club head 200 is depicted as a muscle-back iron type club in FIG. 18, however, in accordance with this and all previous embodiments, golf club head 200 may also be a cavity-back iron type club head. Weight members 248A-C are preferably positioned behind and/or below the center of gravity of golf club head 200 to increase the moment of inertia of the club head. Golf club head 200 may include cavities located on back 246 toward the toe and the heel, designed to receive weight members 248A and 248B, respectively. Golf club head 200 may also include weight member or cup 248C disposed on back 246 along the perimeter of the sole of the club head. Weight members 248A-C preferably comprise a material having a density greater than the density of the material comprising body portion 224. In particular, weight members 248A-C may comprise tungsten.

As in previous embodiments of the present invention, the club head comprises multiple metals to optimize its performance. Body portion 224 comprises a first metal having a first density, while face insert 212 comprises a second metal having a second density. According to this aspect of the present invention, the first metal preferably has a greater density than the second metal to keep the center of gravity downward and aftward. Body portion 224 preferably comprises a high-strength metal or metal alloy, such as stainless steel, titanium or titanium alloy. More preferably, body portion 224 comprises stainless steel 17-4. Face insert 212 preferably comprises a metal or metal alloy exhibiting both high-strength and low density, such as aluminum, aluminum alloys or aluminum metal matrix composites (MMCs), such as those described above. More preferably, face insert 212 comprises an aluminum metal matrix composite or MMC, known as the M9 MMC.

The use of M9 in face insert 212 provides for a strong and lightweight hitting surface. M9 is a member of the 7000 series aluminum alloys, and typically includes certain amounts of magnesium, zinc and copper, with a small percentage of scandium precipitated into the metal matrix. More specifically, M9 contains approximately 0.4 percent scandium, the addition of which improves characteristics such as the tensile strength, yield strength and hardness of the alloy. The scandium can be present in the range of about 0.2% to about 0.8%, preferably from about 0.3% to about 0.6%, and more preferably about 0.4%. An amount of zirconium less than but comparable to the amount of scandium is also precipitated into the M9 metal matrix composite. Approximate attributes of M9 are shown in the table below.

| M9 | |
|---|---|
| MMC composition | Mg 3%<br>Zn 7%<br>Cu 2%<br>Sc + Zr 0.1-0.5%<br>Al balance |
| Density ($g/cm^3$) | 2.85 |
| Elongation (% in 2 in.) | 12 |
| Melting range (C.°) | 640-680 |

Compared to other aluminum alloys and MMCs, M9 has better strength and hardness. Moreover, M9 has a low density of about 2.85 g/cm3, making it much lighter than stainless steel, titanium and titanium alloys, and other high-strength metals. M9 reaches its peak strength after rolling and heat-treating. The following table illustrates a number of characteristics of M9 as compared to other aluminum alloys and MMCs.

| | M9 | MMC-7 | Sc-7 | 13A | M5C |
|---|---|---|---|---|---|
| Al series | 7000 | 7000 | 7000 | 6000 | 5000 |
| Hardness (HRB) | 7000 | 7000 | 7000 | 6000 | 5000 |
| Tensile strength (Ksi) | 7000 | 7000 | 7000 | 6000 | 5000 |
| Yield strength (Ksi) | 85 | 45 | 62 | 54 | 37 |

In contrast to more dense metals typically used for body construction, face insert 212 comprising M9 is very light, allowing more weight to be apportioned to the back and side perimeters of body portion 224, a preferred method of weight distribution to optimize moment of inertia and center of gravity. The strength of the M9 material is similar to that of 431 stainless steel, but with much lower density. The M9 material also has better vibration absorption than forged iron. The table below shows strength and density characteristics of M9 as compared to other high-strength metals.

| | M9 | 17-4 | 431 | 8620 | Ti 6-4 |
|---|---|---|---|---|---|
| Metal | Aluminum MMC | Stainless steel | Stainless steel | Stainless steel | Titanium alloy |
| Density ($g/cm^3$) | 2.85 | 7.75 | 7.68 | 7.80 | 4.43 |
| Hardness | 85-95 HRB | 28-38 HRC | 18-25 HRC | — | 35-45 HRC |
| Tensile strength (Ksi) | 94-98 | 140 | 125 | 85 | 140 |

-continued

| | M9 | 17-4 | 431 | 8620 | Ti 6-4 |
|---|---|---|---|---|---|
| Yield strength (Ksi) | 85 | 120 | 95 | 60 | 134 |
| Strength/Density (MPa/g/cm$^3$) | 237 | 125 | 112 | 75 | 218 |

As discussed above, M9 is rolled and subjected to heat-treating to increase its strength and hardness. After the hardening process, the average grain size of the M9 MMC is decreased from about ten micrometers to between three and five micrometers. To further enhance strength and durability, face insert 212 may be anodized. Preferably, face insert 212 is anodized using the Type I process discussed in previous embodiments, as the chromic acid bath of the Type I process is able to produce an oxidization layer on the surface of parts with complex geometries, such as face insert 212. Body portion 224 may also be anodized, particularly if body portion 224 is composed of titanium or titanium alloy.

The following description refers to FIGS. 19-45, which illustrate other embodiments of golf club heads consistent with the present disclosure that generally include a semi-hollow or completely hollow ball-striking face (referred to as a "hollow face cartridge"), wherein at least a majority of the hollow face cartridge is constructed from a titanium material. As will be described in greater detail herein, the hollow face cartridge may either be formed integrally with the club head body or formed separately therefrom and configured to be removed from and re-attached to the club head body. In some embodiments, club heads described in greater detail herein may further include a weighted back portion, either integrally formed with the club head body or formed separately and configured to be removed from and re-attached to a portion of the club head body and/or the hollow face cartridge. Thus, golf club heads consistent with the present disclosure are constructed from multiple components formed of different materials which may be interchangeable with one another. Accordingly, such construction provides greater flexibility from a design standpoint, as well as adjustability of playing characteristics of the club head due to the interchangeable nature of the different component with one another. Furthermore, as will be described in greater detail herein, the hollow titanium face cartridge construction allows for the club head to have a lower CG location (e.g., removal of heavier material from front of club head and relocating to the rear and sole) and improved MOI, thereby providing a more efficient impact with the ball, increasing ball speed and providing higher launch, as the ball impact will be relatively close to the CG location, and the CG is closer to the ground and mass can be spread across the heel and toe portions of the club head.

FIGS. 19-24 illustrate a first embodiment of a club head having a body in which a hollow face cartridge is integrally formed therewith and further includes a removable component configured to be coupled to and removed from the body via a dovetail-type interlocking configuration which generally provides for a sliding-type engagement/disengagement design for the removable component.

Figure 19:
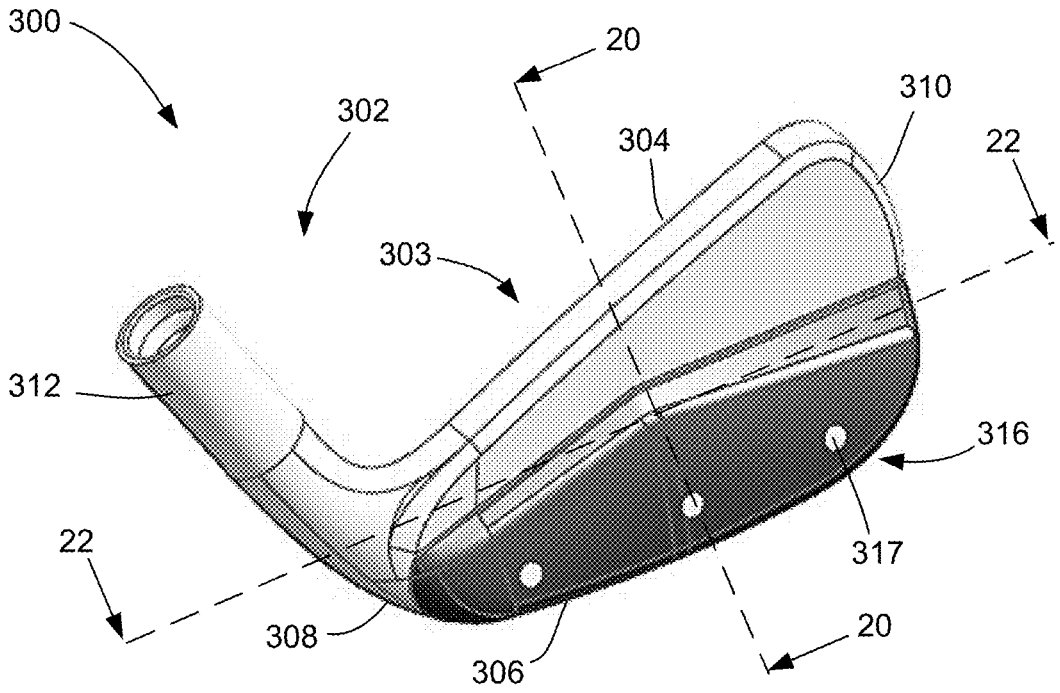
FIG. 19 is a back perspective view of one embodiment of a club head having a body and a hollow face cartridge formed integrally with one another and further including a removable component positioned on the back of the club head.
Figure 20:
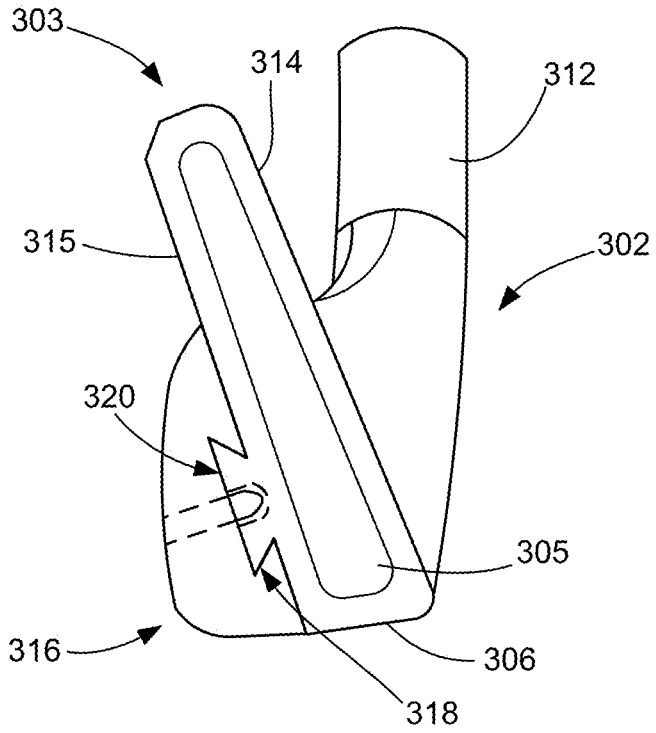
FIG. 20 is a cross-sectional view of the club head of FIG. 19 taken along lines 20-20.

Turning to FIGS. 19 and 20, a back perspective view of club head 300 and a cross-sectional view of the club head 300 are shown, respectively. The club head 300 includes body 302 having a top line 304, a sole 306, a heel 308, a toe 310, and a hosel 312 extending from the heel 308. The club head 300 further includes a hollow face cartridge 303 formed integrally with the club head body 302. The hollow face cartridge 303 generally includes at least the top line 304, sole 306, and toe 310 portions. The face cartridge 303 illustrated is completely hollow-bodied component in that a hollow interior cavity 305 is enclosed within and surrounded by the top line 304, the sole 306, the heel 308, the toe 310, as well as a front ball-striking surface 314 and an opposing rear surface 315.

The face cartridge 303 is constructed from a titanium material. Accordingly, in the embodiments in which the face cartridge is integrally formed with the club head body, such as those embodiments illustrated in FIGS. 19-24, the entire club head body, including the face cartridge, may be formed from a titanium material by way of forging or casting, for example. However, it should be noted that, in other embodiments described herein, the face cartridge may be formed separately from the club head body, such that the club head body may be formed from a different material (e.g., steel, aluminum, or the like). In such embodiments, the separate face cartridge may be made from a single sheet of titanium or multiple sheets of titanium in such as manner so as to form a semi-hollow component (e.g., three sides, including a top line, sole, and ball-striking face with/without capped ends) or a completely hollow-bodied component (e.g., hollow interior enclosed by top line, sole, backing, ball-striking face, and capped ends).

The hollow face cartridge is designed in such a way so as to maximize performance of the club face while overcoming the drawbacks of typical titanium face club heads. As generally understood, titanium material has high strength and low modulus, such that it is able to flex more than a stiffer material of the same thickness. Accordingly, the hollow face cartridge can be constructed in such as manner so as to achieve a relatively thin face portion including thin perimeter returns (similar to a cup face), thereby allowing the face and sole portions of the hollow ball-striking face to offer maximum flex, which can result in higher launch angle, as well as increasing contact time between the face and the ball during impact, which can result in less back spin to be generated, resulting in increased shot distance.

Furthermore, the hollow titanium face cartridge construction allows for the club head to have a lower CG location (e.g., removal of heavier material from front of club head and relocating to the rear and sole) that provides a more efficient impact with the ball, increasing ball speed and providing higher launch, as the ball impact will be relatively close to the CG location, and CG is closer to the ground. The hollow titanium face cartridge further has potential to realize significant dynamic loft effects (e.g., increased loft of the club head at impact) due to a significantly deeper CG location (back from the face) that is difficult to achieve in other designs of similar head dimension, which results in higher launch angle.

The club head 300 further includes a removable component 316 configured to be releasably attached to the club head body 302 and face cartridge 303 by way of an interlocking structure 318 formed on the rear surface 315 of the face cartridge 303. In particular, the removable component 316 may be configured to be removed from and re-attached to the back portion of the club head body 302. In some embodiments, the removable component 316, when attached to the body 302 and face cartridge 303, forms at least a portion of the sole 306. Accordingly, the removable component 316 is hereinafter referred to as "removable sole plate 316".

Figure 21:
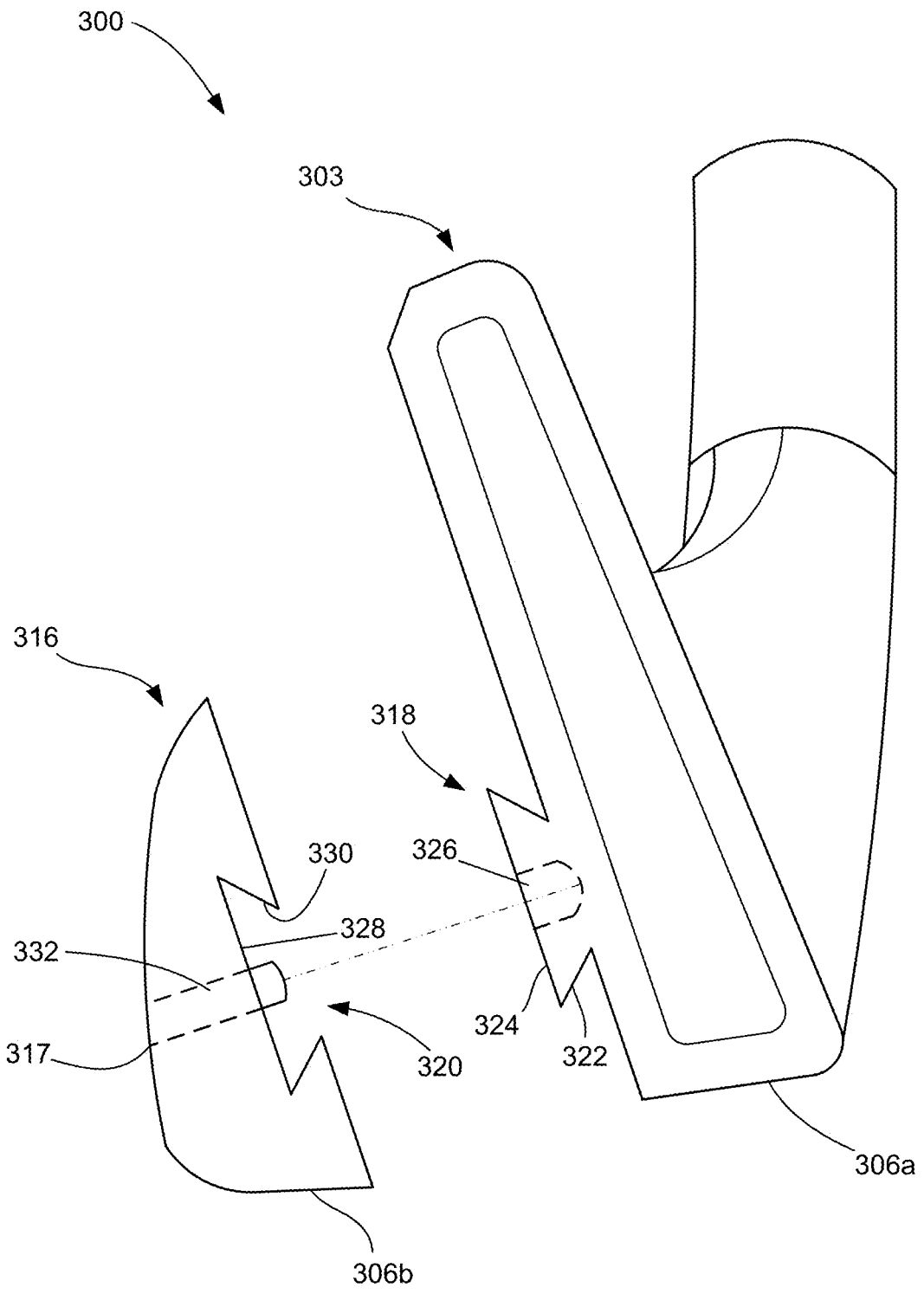
FIG. 21 is an enlarged cross-sectional view of the club head of FIG. 19 showing the removable component and club head body separated from one another illustrating the corresponding dovetail-type interlocking configurations of the removable component and the hollow face cartridge.
Figure 22:
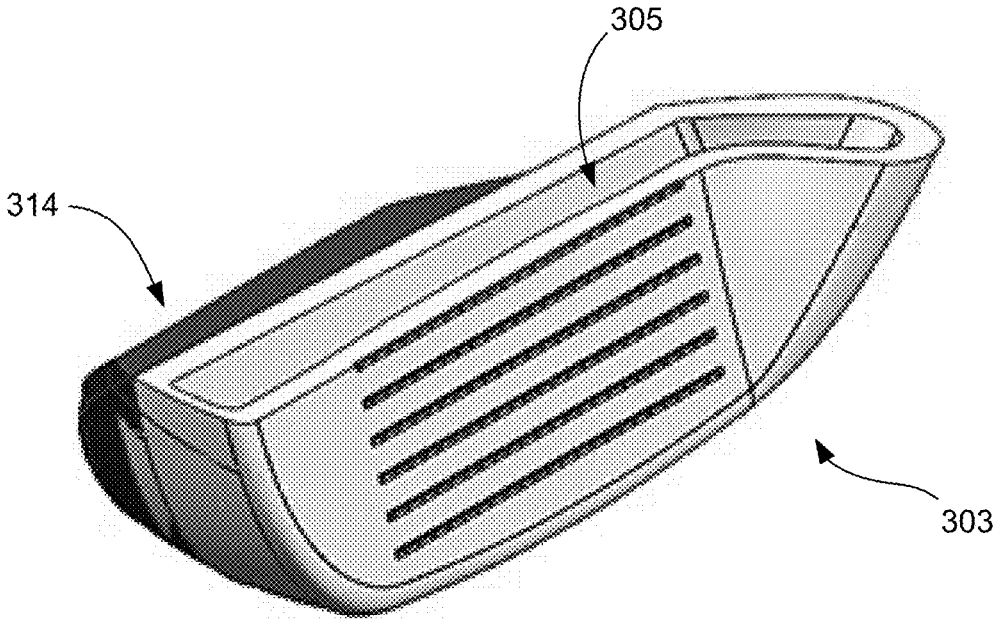
FIG. 22 is front perspective view, partly in section, of the club head of FIG. 19 taken along lines 22-22.

As shown in FIGS. 20 and 21, cross-sectional views of the club head 300 illustrate the removable sole plate 316 and club head body 302 separated from one another and further illustrates corresponding interlocking configurations of the removable sole plate 316 and the hollow face cartridge 303. As shown, the face cartridge 303 includes an interlocking structure 318 formed on a rear surface thereof and configured to interlock with a corresponding interlocking structure 320 formed on the removable sole plate 316. The interlocking structure 318 of the face cartridge 303 generally resembles a protrusion having sidewalls 322 extending from the rear surface 315 of the face cartridge 303 and terminating at a substantially planar surface 324 that extends along a length of the face cartridge 303 generally in a heel-toe direction, substantially parallel with the top line 304 and/or sole 306. The removable sole plate 316 includes, for example, a recess or channel 320 configured to receive and retain the protrusion of the interlocking structure 318 within. For example, the channel 320 may include a base portion 328 and opposing sidewalls that extend from the base portion 328 towards an open end. Upon attachment, the protrusion is interlocked with the channel providing sufficient and stable attachment between the removable sole plate 316 and the club head body, specifically the face cartridge 303. For example, as shown, the protrusion has a cross section shape complementary to the cross section shape of the channel, wherein the sidewalls 322 and planar surface 324 generally correspond to the base portion 328 and sidewalls 330 of the channel 320, such that the protrusion substantially fills the channel when the removable sole plate 316 is attached to face cartridge 303. In particular, in some embodiments, the channel comprises a generally dovetail-shaped cross section. Accordingly, the sidewalls 322 of the protrusion generally taper outwardly from the rear surface 315 of the face cartridge towards the planar surface 324, while the sidewalls 330 of the channel 320 generally taper inwardly from the base portion 328 towards the open end on the removal sole plate 316.

In some embodiments, to further strengthen the connection between the removable sole plate 316 and face cartridge 303, a fastening mechanism, such as fasteners (e.g., screws or bolts), adhesive, cam-lock assembly, or the like, may be used to fasten the removable sole plate 316 to the face cartridge 303 and ultimately to the club head body 302. For example, as shown, the removable sole plate 316 may include one or more apertures 317 for receiving a fastener therethrough. Similarly, the protrusion on the face cartridge 303 may include corresponding bores 326 for receiving and retaining a fastener 332. Accordingly, the bores 326 may have an internally threaded surface for threaded engagement with an externally threaded screw or the like.

Figure 23:
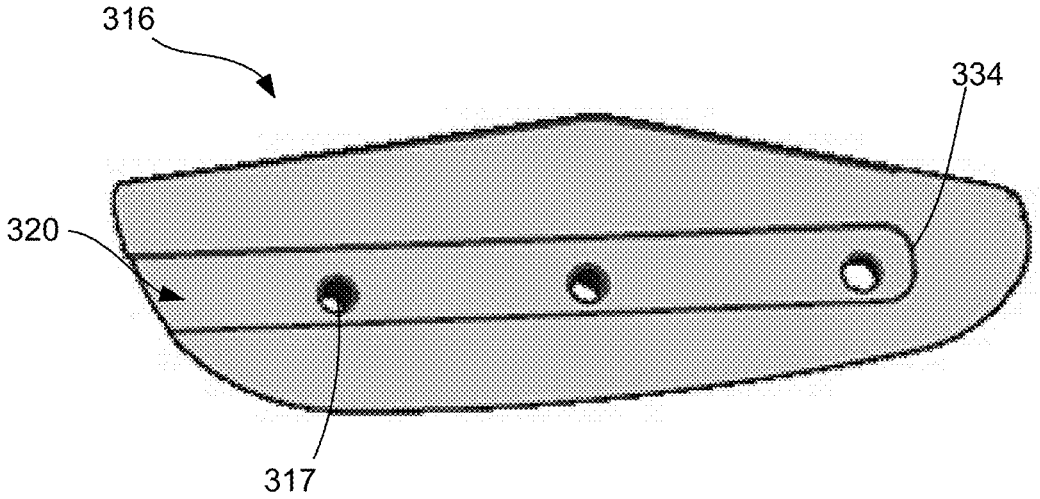
FIG. 23 is plan view of the removable component illustrating the channel for receiving the interlocking structure of the hollow face cartridge.
Figure 24:
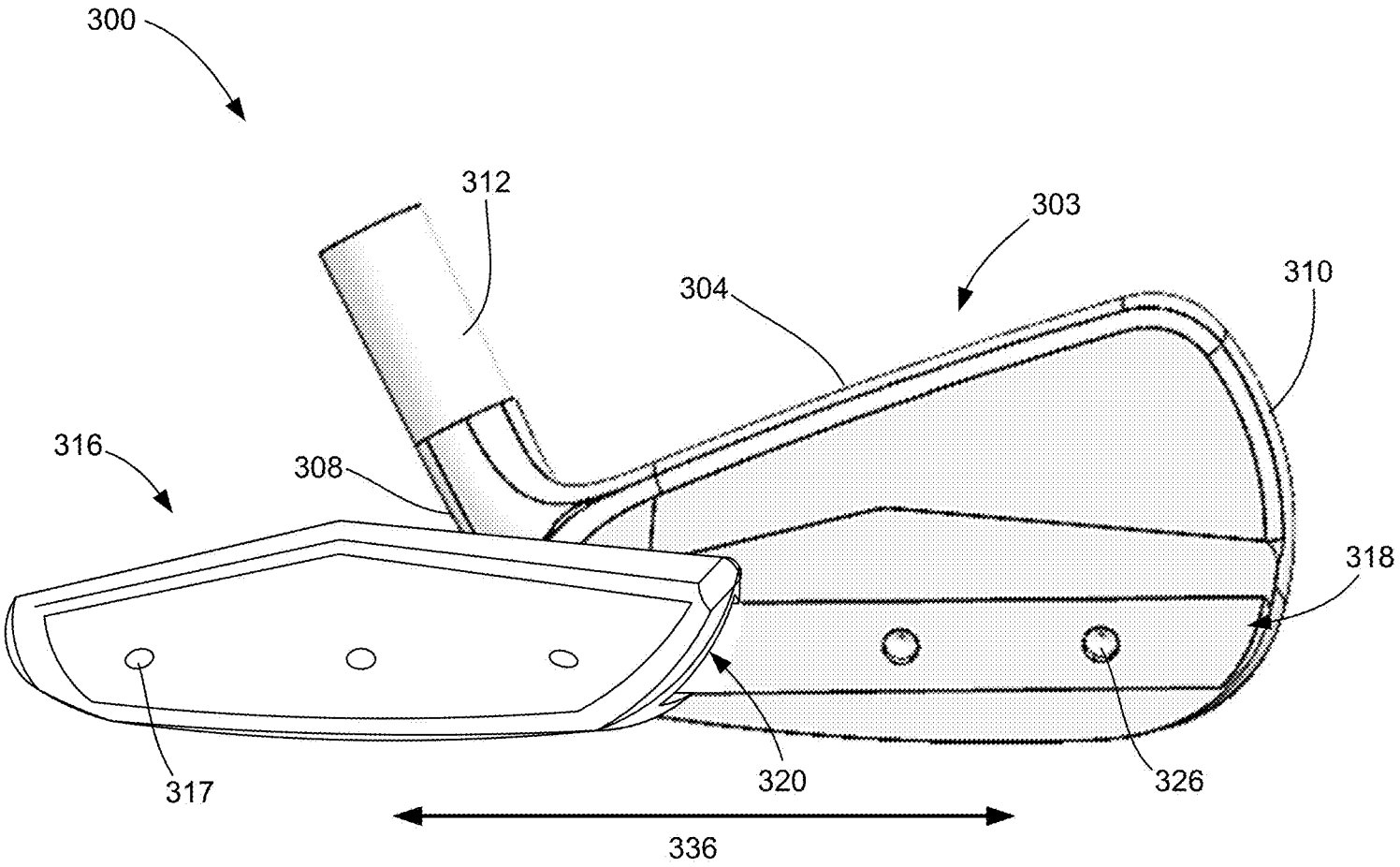
FIG. 24 is plan back view of the golf club head of FIG. 19 illustrating the dovetail-type interlocking and slidable engagement between the removable component and the interlocking structure of the hollow face cartridge.

FIG. 23 is a plan view of the removable sole plate 316 illustrating the channel 320 for receiving the interlocking structure 318 of the hollow face cartridge 303. As shown, the channel 320 may have an open end corresponding to the toe end 310 of the club head body 302 and face cartridge 303 and a closed end having a stop feature 334 corresponding to the heel end 308 of the club head body 302 and face cartridge 303. The open end and closed end of the channel 320 allows for the sole plate 316 to be attached to and removed from the face cartridge 303 in specific directions. For example, as shown in FIG. 24, a back view of the golf club head 300 illustrates the dovetail-type interlocking and slidable engagement between the removable sole plate 316 and the hollow face cartridge 303. The sole plate 316 may be removed from and reattached to the interlocking structure 318 of the face cartridge 303 via a sliding arrangement. For example, the protrusion of the interlocking structure 318 of the face cartridge 303 and the channel 320 on the sole plate are configured to slide relative to one another generally in a heel-to-toe direction, as indicated by arrow 336, either when first attaching the sole plate 316 or when removing the sole plate 316 after unfastening screws from engagement with bores 326. The open end of the channel 320 allows for the sole plate 316 to be first coupled to the protrusion of the interlocking structure 318 of the face cartridge 303 by sliding the sole plate 316 in a direction toward the heel 310. The closed end with stop feature 334 of the channel 320 is positioned such that, a player need only slide the sole plate 316 in the toe direction until resistance is felt (i.e., the stop feature 334 comes into contact with a heel-end of the protrusion), at which point the sole plate 316 is in the correct position, where the apertures 317 and corresponding bores 326 are aligned, as well as the perimeters are aligned with one another between the sole plate 316 and the club head body 302 and face cartridge 303. Thus, the stop feature 334 prevents the sole plate 316 from completely sliding past the correct position on the face cartridge 303. A player need only then fasten screws or the like, so as to complete attachment of the sole plate 316. In order to remove the sole plate 316, a player need only unfasten screws and simply slide the sole plate in a heel direction, at which point the sole plate 316 can be completely removed from the club head 300.

It should be noted that, in some embodiments, the interlocking structures of the removable sole plate and face cartridge may be reversed, such that the removable sole plate may include the protrusion while the face cartridge includes the corresponding channel to receive the protrusion.

The removable sole plate 316 is generally made from a material that is different from at least one of the body 302 and face cartridge 303. In particular, the removable sole plate 316 may be formed from a heavier or denser material, such as tungsten, so as to provide concentrated weight in the rear and sole of the club head to provide a lower CG and further distribute mass across the perimeter of the club head from heel to toe, so as to improve MOI. Accordingly, in some embodiments, the removable sole plate may generally include, for example, a removable weight made of the second metal that is denser and/or heavier than the first metal (e.g., formed of tungsten or the like) and forms a back of the club head body and a portion of the sole (e.g., a sole plate).

The removable sole plate may be interchangeable with other removable sole plates to thereby allow adjustability of playing characteristics of the club head. For example, each of a plurality of different interchangeable sole plates may include a different material composition or arrangement to thereby provide adjustment of mass properties, or other properties, of the golf club head when coupled to the club head body. For example, different sole plates may be used to adjust a variety of different club head characteristics, including, but not limited to, center of gravity (CG), moment of inertia (MOI), sole bounce, sole width, overall club head weight, and the like, which can impact, among other things, launch angle, ball speed, and ball spin. Accordingly, a player may use the interchangeable sole plates to adjust the club head playing characteristics to meet their needs for any given shot.

Figure 25:
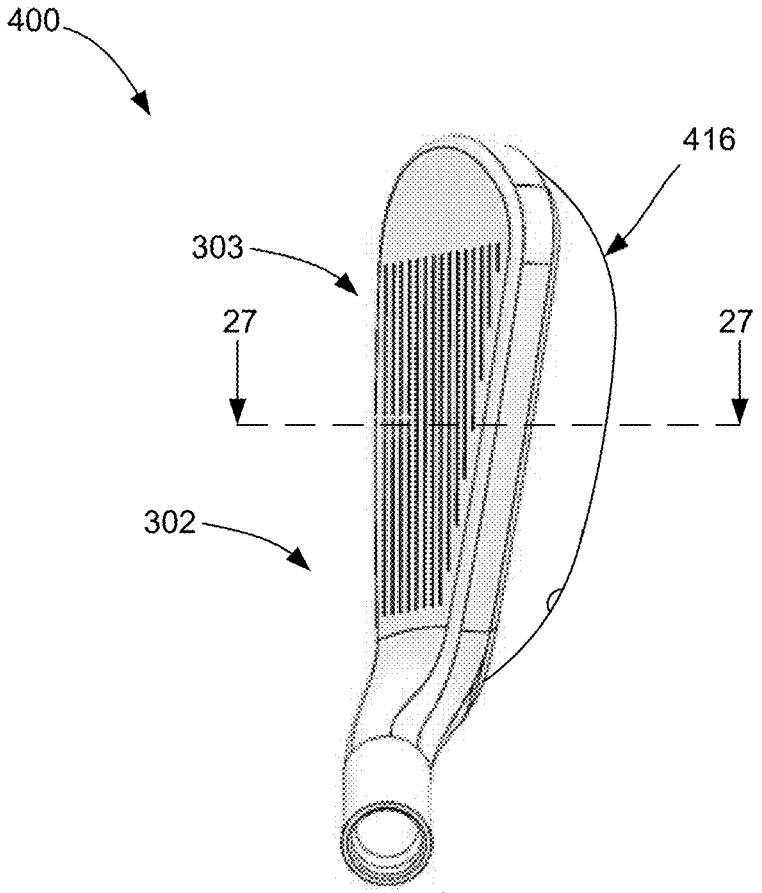
FIG. 25 is a top view of another embodiment of a club head having a body and a hollow face cartridge formed integrally with one another and further including another embodiment of a removable component positioned on the back of the club head and providing a wide sole muscle back design.
Figure 26:
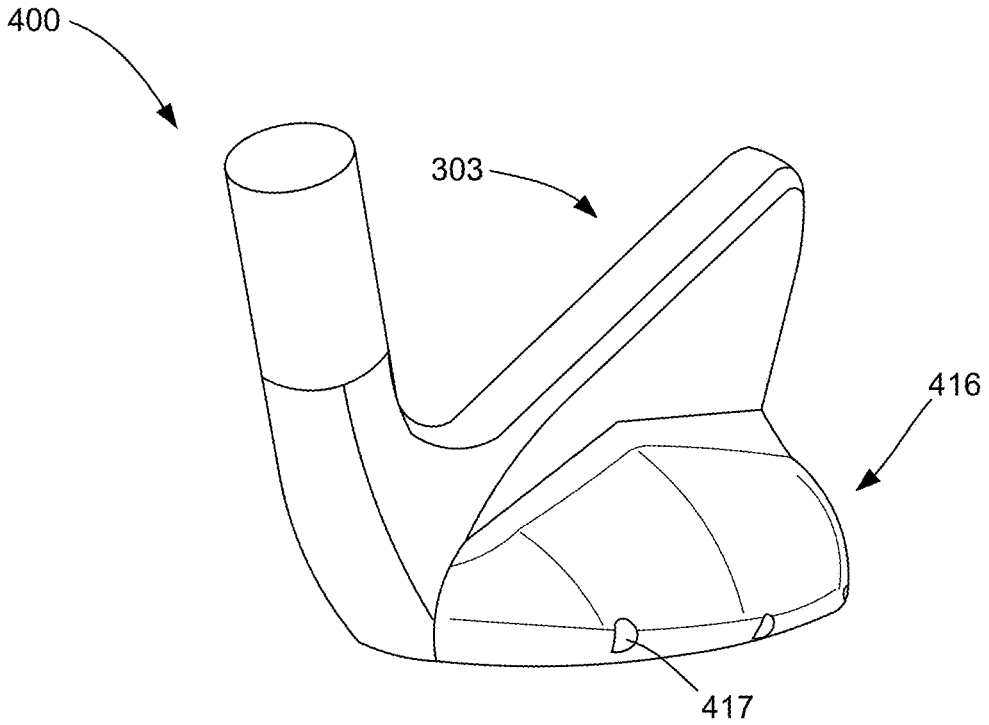
FIG. 26 is a back perspective view of the club head of FIG. 25.
Figure 27:
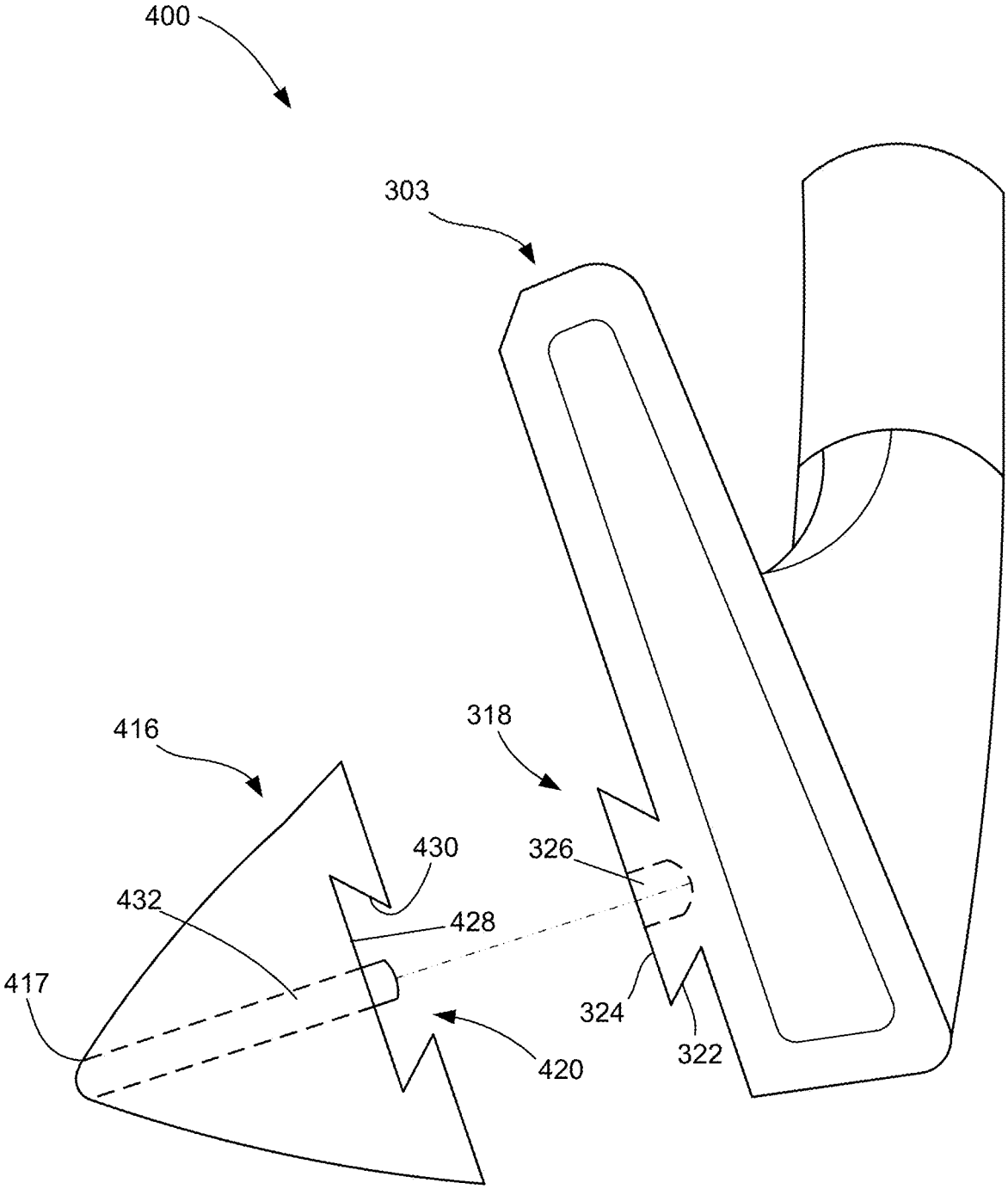
FIG. 27 is a cross-sectional view of the club head of FIG. 25 taken along lines 27-27.
Figure 28:
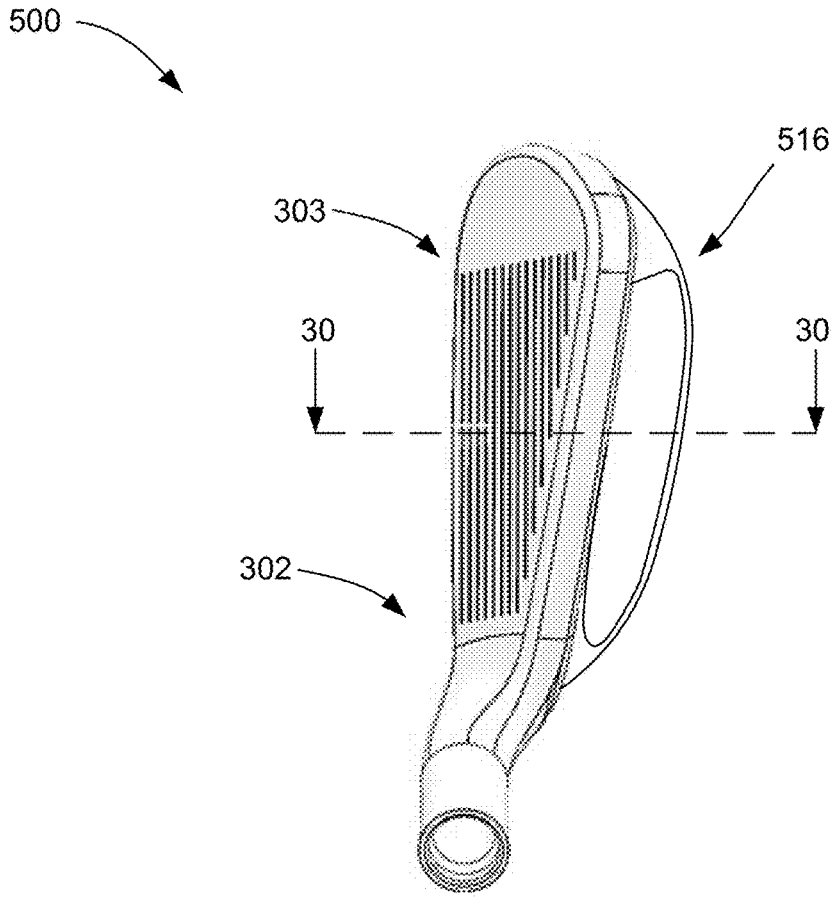
FIG. 28 is a top view of another embodiment of a club head having a body and a hollow face cartridge formed integrally with one another and further including another embodiment of a removable component positioned on the back of the club head and providing a wide sole cavity back design.
Figure 29:
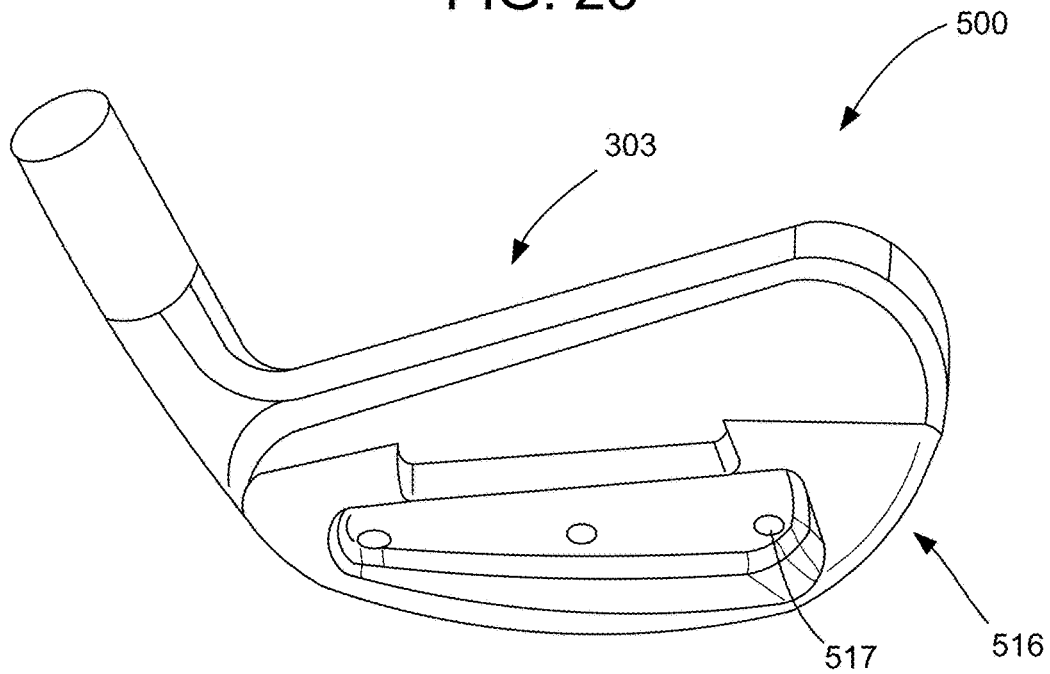
FIG. 29 is a back perspective view of the club head of FIG. 28.
Figure 30:
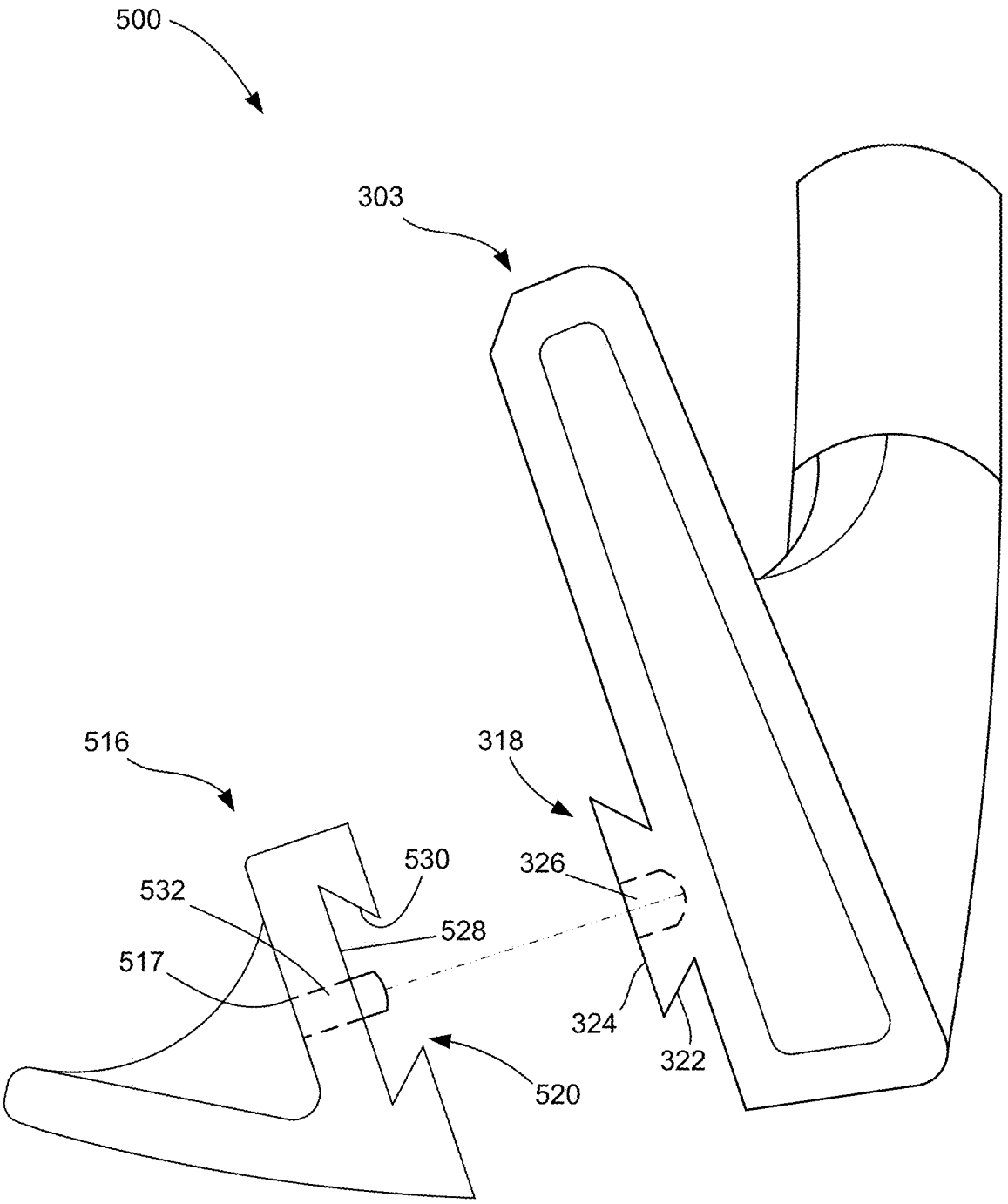
FIG. 30 is a cross-sectional view of the club head of FIG. 28 taken along lines 29-29.

FIGS. 25-30 show alternative embodiments of removable sole plates 416, 516 configured to be removed from and re-attached to club head body 302 such that sole plates 316, 416, and 516 are interchangeable with one another and can provided adjustment of playing characteristics of the club head. In particular, FIGS. 25-27 illustrate a removable sole plate 416 providing a wide sole muscle back design and FIGS. 28-30 illustrate a removable sole plate 516 providing a wide sole cavity back design.

Referring to FIGS. 25-27, a club head 400 is shown, having club head body 302 and the hollow face cartridge 303 formed integrally with the body 302. Accordingly, the club head body 302 and face cartridge 303 are similarly configured as previously described herein with respect to the club head 300 illustrated in FIGS. 19-24. The interlocking structure 318 on the rear surface 315 of the face cartridge 303 may provide a universal connection for a plurality of interchangeable removable sole plates to be removed from and re-attached to the club head body 302. For example, the sole plate 416 may include a similar channel arrangement as the channel 320 of sole plate 316. In particular, sole plate 416 may include a recess or channel 420 configured to receive and retain the protrusion of the interlocking structure 318 within. For example, the channel 420 may include a base portion 428 and opposing sidewalls that extend from the base portion 428 towards an open end. Upon attachment, the protrusion is interlocked with the channel providing sufficient and stable attachment between the removable sole plate 416 and the club head body, specifically the face cartridge 303. For example, as shown, the protrusion has a cross section shape complementary to the cross section shape of the channel, wherein the sidewalls 322 and planar surface 324 generally correspond to the base portion 428 and sidewalls 430 of the channel 420, such that the protrusion substantially fills the channel when the removable sole plate 416 is attached to face cartridge 303. In particular, in some embodiments, the channel comprises a generally dovetail-shaped cross section. Accordingly, the sidewalls 322 of the protrusion generally taper outwardly from the rear surface 315 of the face cartridge towards the planar surface 324, while the sidewalls 430 of the channel 420 generally taper inwardly from the base portion 428 towards the open end on the removal sole plate 416.

In some embodiments, to further strengthen the connection between the removable sole plate 416 and face cartridge 303, a fastening mechanism, such as fasteners (e.g., screws or bolts), adhesive, cam-lock assembly, or the like, may be used to fasten the removable sole plate 416 to the face cartridge 303 and ultimately to the club head body 302. For example, as shown, the removable sole plate 416 may include one or more apertures 417 for receiving a fastener therethrough. Similarly, the protrusion on the face cartridge 303 may include corresponding bores 326 for receiving and retaining a fastener 432. Accordingly, the bores 326 may have an internally threaded surface for threaded engagement with an externally threaded screw or the like.

Referring to FIGS. 28-30, a club head 500 is shown, having club head body 302 and the hollow face cartridge 303 formed integrally with the body 302. Accordingly, the club head body 302 and face cartridge 303 are similarly configured as previously described herein with respect to the club head 300 illustrated in FIGS. 19-24. The interlocking structure 318 on the rear surface 315 of the face cartridge 303 may provide a universal connection for a plurality of interchangeable removable sole plates to be removed from and re-attached to the club head body 302. For example, the sole plate 516 may include a similar channel arrangement as the channel 320 of sole plate 316. In particular, sole plate 516 may include a recess or channel 520 configured to receive and retain the protrusion of the interlocking structure 318 within. For example, the channel 520 may include a base portion 528 and opposing sidewalls that extend from the base portion 528 towards an open end. Upon attachment, the protrusion is interlocked with the channel providing sufficient and stable attachment between the removable sole plate 516 and the club head body, specifically the face cartridge 303. For example, as shown, the protrusion has a cross section shape complementary to the cross section shape of the channel, wherein the sidewalls 322 and planar surface 324 generally correspond to the base portion 528 and sidewalls 530 of the channel 520, such that the protrusion substantially fills the channel when the removable sole plate 516 is attached to face cartridge 303. In particular, in some embodiments, the channel comprises a generally dovetail-shaped cross section. Accordingly, the sidewalls 322 of the protrusion generally taper outwardly from the rear surface 315 of the face cartridge towards the planar surface 324, while the sidewalls 530 of the channel 520 generally taper inwardly from the base portion 528 towards the open end on the removal sole plate 516.

In some embodiments, to further strengthen the connection between the removable sole plate 516 and face cartridge 303, a fastening mechanism, such as fasteners (e.g., screws or bolts), adhesive, cam-lock assembly, or the like, may be used to fasten the removable sole plate 516 to the face cartridge 303 and ultimately to the club head body 302. For example, as shown, the removable sole plate 516 may include one or more apertures 517 for receiving a fastener therethrough. Similarly, the protrusion on the face cartridge 303 may include corresponding bores 326 for receiving and retaining a fastener 532. Accordingly, the bores 326 may have an internally threaded surface for threaded engagement with an externally threaded screw or the like.

The different sole plate designs (e.g., wide sole muscle back, wide sole cavity back, etc.) may provide different playing characteristics of the club head. For example, each of a plurality of different interchangeable sole plates may include a different material composition or arrangement to thereby provide adjustment of mass properties, or other properties, of the golf club head when coupled to the club head body. For example, different sole plates may be used to adjust a variety of different club head characteristics, including, but not limited to, center of gravity (CG), moment of inertia (MOI), sole bounce, sole width, overall club head weight, and the like, which can impact, among other things, launch angle, ball speed, and ball spin. Accordingly, a player may use the interchangeable sole plates to adjust the club head playing characteristics to meet their needs for any given shot.

Figure 31:
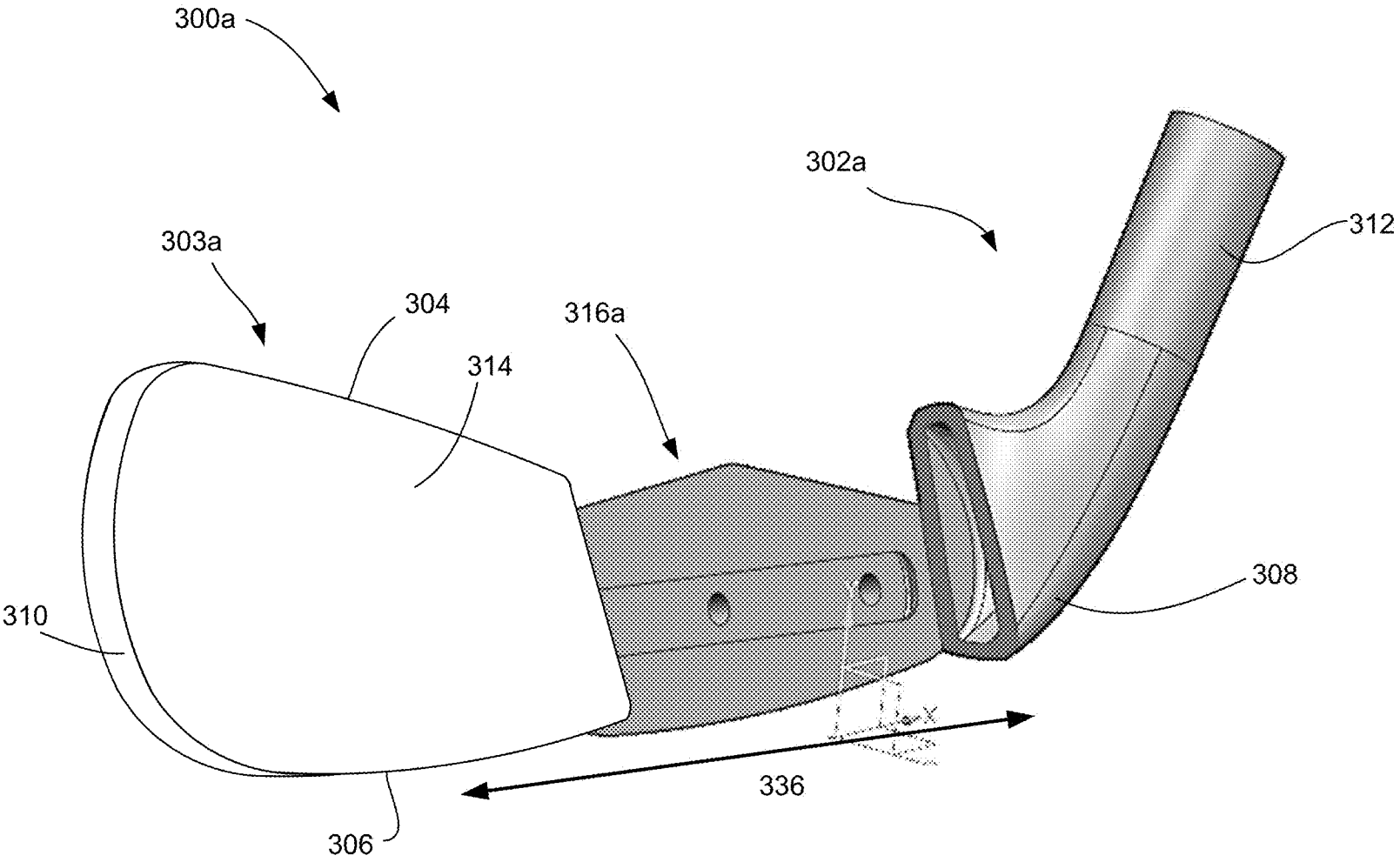
FIG. 31 is a front perspective view of another embodiment of a club head having a body and a removable hollow face cartridge configured to be releasably coupled to the club head body via a dovetail-type interlocking and slidable engagement.

FIG. 31 is a front perspective view of an embodiment of a club head 300*a* in which a hollow face cartridge 303*a* is formed separately from a club head body 302*a*. As shown, the hollow face cartridge 303*a* is configured to be removably coupled to the club head body 302*a* via a dovetail-type interlocking and slidable engagement between a portion of the face cartridge 303*a* and the club head body 302*a*, similar to the interlocking engagement between the removable sole plate 316 and face cartridge 303 previously described herein and shown in FIGS. 19-24.

As shown in FIG. 31, the club head body 302*a* may include at least a portion of the heel 308 and the hosel 312 extending therefrom, as well as a mounting portion 316*a* upon which the face cartridge 303*a* can be removed from and re-attached to. The mounting portion 316*a* may generally serve as a rear portion of the club head 300*a* and further form a portion of the sole, similar to the removable sole plate 316 of FIGS. 19-24. Accordingly, the club head body 302*a* may be arranged in such a way such that a majority of weight is concentrated in the mounting portion 316*a* so as to lower the CG and further allow for improved perimeter weighting. The face cartridge 303*a* may include the interlocking structure on a rear surface thereof, similarly arranged and configured as the interlocking structure 318 previously described herein.

Accordingly, the interlocking structure on the rear surface of the face cartridge 303*a* may include at least a protrusion extending from the rear surface configured to interlock with a recess defined on a front surface of the mounting portion 316*a*, wherein the channel is shaped to further enhance the connection between the two components, such as a dovetail cross-section. Accordingly, the mounting portion 316*a* may generally resemble the sole plate 316 of FIGS. 19-24, but, rather than being removable, the mounting portion 316*a* is generally fixed to the club head body 302*a*. Rather, in the illustrated embodiment, the face cartridge 303*a* is configured to be removed from and re-attached to the mounting portion 316*a* and the club head body 302*a* in a dovetail-type interlocking and slidable engagement. For example, the protrusion of the interlocking structure of the face cartridge 303*a* and the channel on the mounting portion 316*a* are configured to slide relative to one another generally in a heel-to-toe direction, as indicated by arrow 336, either when first attaching the face cartridge 303*a* or when removing the face cartridge 303*a* after unfastening screws or the like. Accordingly, in order to attach the face cartridge 303*a* to the body 302*a*, a player need only slide the face cartridge 303*a* in a heel direction once the protrusion of the interlocking structure of the face structure is engaged with the corresponding channel on the mounting portion 316*a* and then fasten screws or the like to releasably fix the face cartridge 303*a* in place. In order to remove the face cartridge 303*a*, a player need only unfasten screws or the like and slide the face cartridge 303*a* in a toe direction.

In this embodiment in which the face cartridge is formed separately from the body, the club head body 302*a* may be formed from a different material than titanium, such as, for example, steel, aluminum, or the like. In such embodiments, the separate face cartridge 303*a* may be made from a single sheet of titanium or multiple sheets of titanium in such as manner so as to form a semi-hollow component (e.g., three sides, including a top line, sole, and ball-striking face with/without capped ends) or a completely hollow-bodied component (e.g., hollow interior enclosed by top line, sole, backing, ball-striking face, and capped ends), as shown.

The removable face cartridge may be interchangeable with other removable face cartridges to thereby allow adjustability of playing characteristics of the club head. For example, each of a plurality of different interchangeable face cartridges may include a different design which provides different playing characteristics. For example, a first face cartridge may be designed to provide a soft feel in lieu of distance, while a second face cartridge may be designed to provide increase distance in lieu of feel. Furthermore, face cartridges may have different loft settings, or other physical attributes. Accordingly, a player may use the interchangeable face cartridges plates to adjust the club head playing characteristics to meet their needs for any given shot. Furthermore, construction of a hollow face cartridge that is separate from the club head body allows for more options as far as club head design and assembly, as well as greater latitude in the type of manufacturing used to create the cartridge, as the remainder of the club head body is not involved.

As previously described, to further strengthen the connection between the face cartridge 303*a* and the mounting portion 316*a*, a fastening mechanism, such as a screw or bolt, or the like, may be used to fasten the face cartridge 303*a* to the mounting portion 316*a*. In previous examples, such as the club head 300 shown in FIG. 21, the fastener may extend through an aperture of the sole plate and then into an internally threaded bore defined on the rear surface of the face cartridge (e.g., bore 326 formed on the protrusion), at which point, the screw and be tightened so as to releasably fix components in place. In some embodiments, the club head may include a tension/compression fastening assembly which provides for the removable face cartridge (or the removable sole plate) to be securely fastened to the club head body to increase club head stiffness and further improve sound frequency and/or vibration characteristics.

Figure 32A:
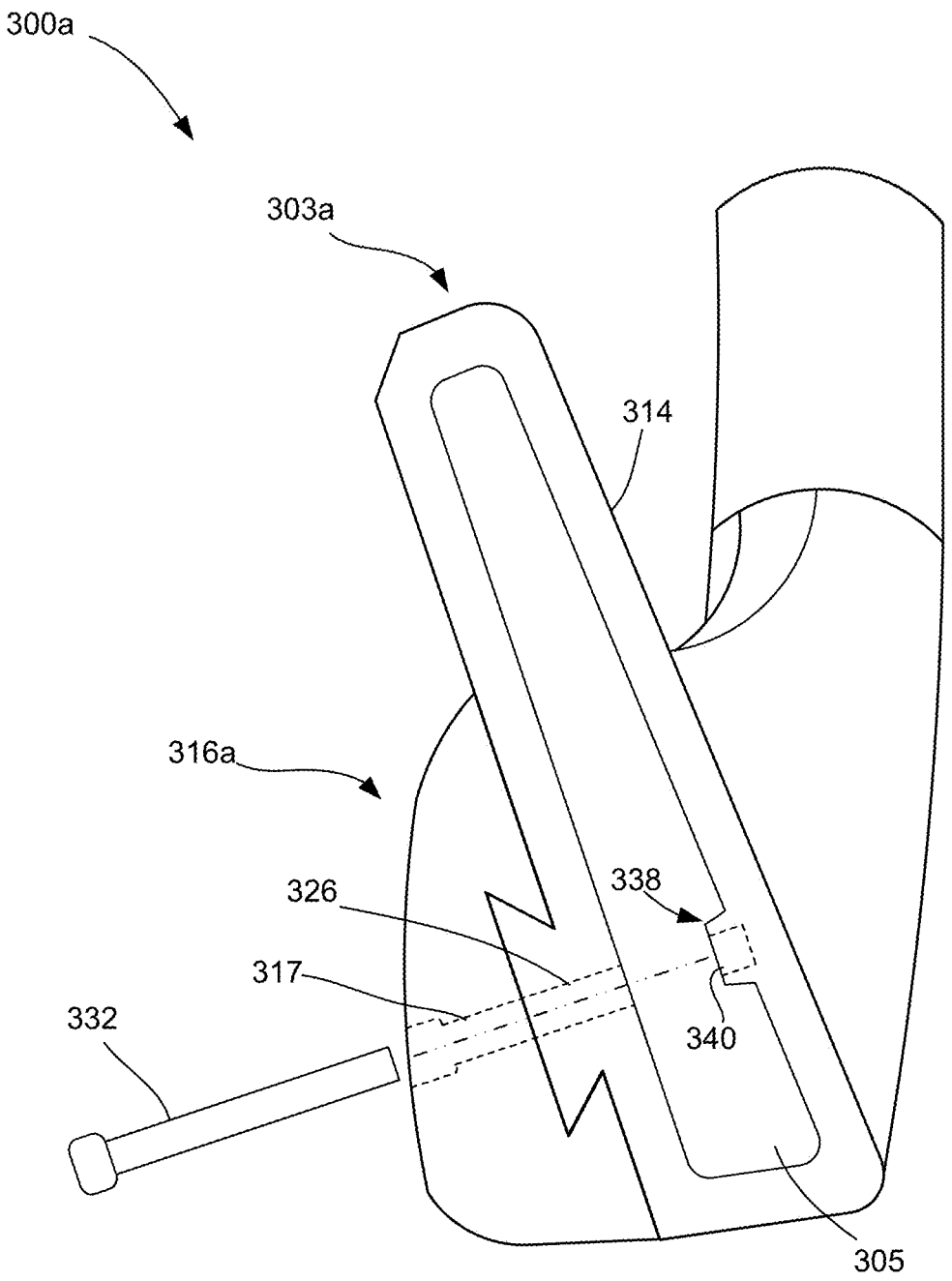
FIGS. 32A and 32B are enlarged cross-sectional views of the club head of FIG. 31 showing the club head body and the removable hollow face cartridge coupled to one another via the dovetail-shaped interlocking design and further illustrating a tension/compression fastening assembly for strengthen the securement of the face cartridge to the body.
Figure 32B:
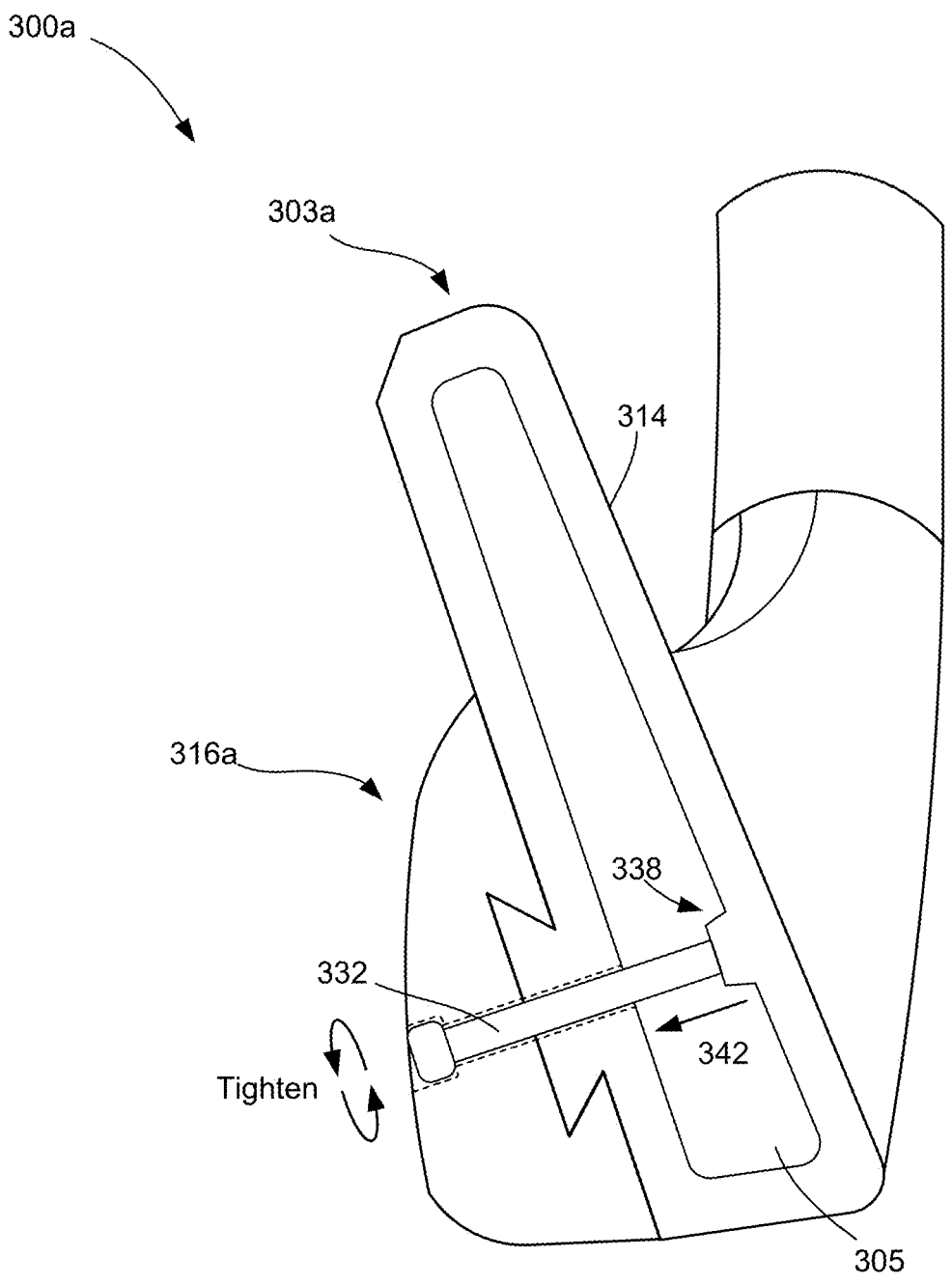

For example, FIGS. 32A and 32B are enlarged cross-sectional views of the club head 300*a* illustrating a tension/compression fastening assembly. In particular, the hollow face cartridge may include a boss 338 defined on an interior surface of the hollow interior cavity 305 of the face cartridge 303*a*. As shown, the boss 338 is generally formed on a surface opposing the front ball-striking surface 314 of the face cartridge 303*a*. The boss 338 includes an internally threaded bore 340 configured to receive and retain a corresponding externally threaded portion of a screw or bolt 332 via a threaded engagement. As shown in FIG. 32B, the screw 332 may pass entirely through the aperture 317 formed on the mounting portion 316*a* and further pass entirely through a bore 326 extending through a thickness of the protrusion formed on the rear surface of the face cartridge 303*a*. When the face cartridge 303*a* is in engagement with the mounting portion 316*a* (e.g., via the corresponding dovetail-shaped interlocking structures (channel 320 on mounting portion 316*a* and protrusion on face cartridge 303*a* engaging one another), the aperture 317, bore 326, and threaded bore 340 of the boss 338 are substantially aligned with one another. Thus, an externally threaded distal end of the screw 332 can pass entirely through aperture 317, bore 326, and into engagement with the bore 340.

Upon tightening the screw 332 into threaded engagement with the bore 340 of the boss 338, the face cartridge 303*a* can be drawn towards the mounting portion 316*a*, as indicated by arrow 342, so as to releasably lock and secure the face cartridge 303*a* to the club head body 302*a* with sufficient strength to prevent movement of the face cartridge 303*a* during swinging of the club head 300*a* or after multiple ball strikes. This tension/compression assembly allows for a stronger securement of the face cartridge 303*a* to the club head body 302*a* and further results in improved club head stiffness, which may further improve sound frequency of the club head.

As generally understood, every golf club produces a distinct sound and feel when it is used to strike a golf ball. The sound and feel are produced by the vibration behavior of the golf club head, a result of the design of the golf club head. Golf club head designs are analyzed and samples are tested to characterize the vibration characteristics of a particular design in an attempt to determine whether the sound and feel produced by the golf club head will be acceptable to the average golfer. It is generally understood that the lower the vibration frequency, the more unappealing the resultant sound and/or feel of a golf club head. Similarly, it is generally understood that increasing the natural vibration frequency of a club head will provide a more appealing sound and/or feel upon impact.

The tension/compression fastening assembly described herein may generally result in an increased natural frequency of the club head so as to provide a more appealing sound and/or feel upon ball impact, thereby improving the overall sound characteristics of the club head. In particular, as a result of tightening the screw 332 to the bore 340 of the boss 338, club head stiffness is increased, which may generally result in an increase in the natural vibration frequency of the club head, thereby improving sound attenuation and/or feel upon ball impact. The engagement between the screw 332 and boss 338 may further provide vibration damping, so as to further improve sound and/or feel of the club head.

It should be noted that, although the tension/compression fastening assembly is shown with the removable face cartridge, the tension/compression fastening assembly design can also be implemented in other club head embodiments described herein, including, for example, club head designs in which the face cartridge is integrally formed with the club head body and configured to be coupled to a removable sole plate.

Figure 33:
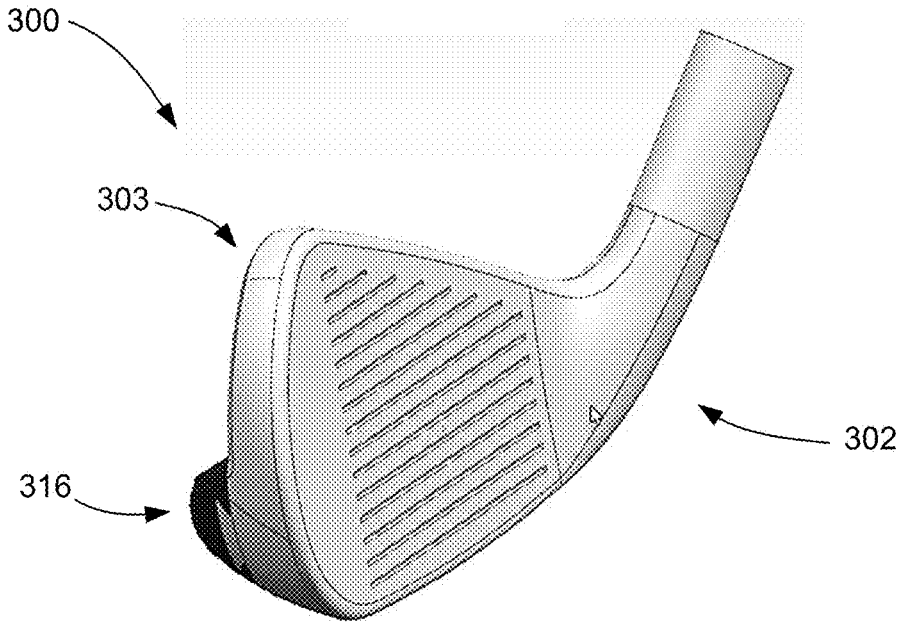
FIG. 33 is a front perspective view of a club head having a hollow face cartridge, such as the club head of FIG. 19 or FIG. 31.
Figure 34:
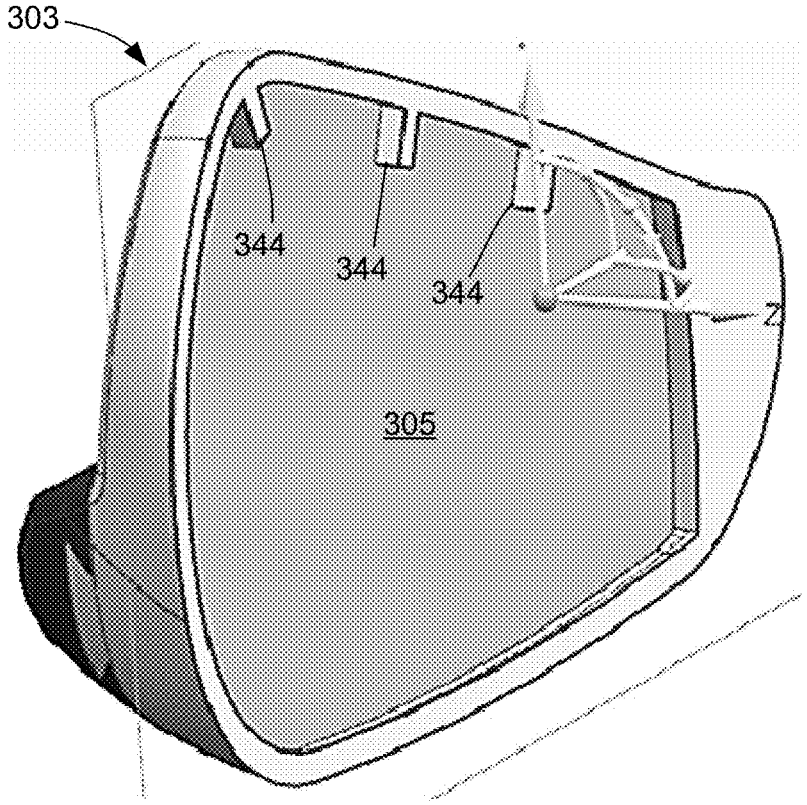
FIG. 34 is a front perspective view, partly in section, illustrating the hollow interior cavity and placement of one or more elements (e.g., ribs) for providing sound and/or vibration tuning characteristics for the club head.

FIG. 33 is a front perspective view of a club head having a hollow face cartridge, such as the club head of FIG. 19 or FIG. 31. FIG. 34 is a front perspective view, partly in section, illustrating the hollow interior cavity 305 and placement of one or more elements, such as ribs 344, for example, for providing sound and/or vibration tuning characteristics for the club head. As shown, the hollow interior cavity 305 of the hollow face cartridge 303 may include one or more elements for providing at least one of sound tuning and vibration damping of the club head. For example, as illustrated, the face cartridge 303 may include one or more ribs 344 positioned within the hollow interior cavity 305 and arranged along a perimeter of the face cartridge 303. However, it should be noted that the ribs 344 may be arranged in any desired pattern and may extend from any one of the interior surfaces of the hollow interior cavity (e.g., extending only from a rear interior surface, a front interior surface, top line interior surface, sole interior surface, extending from and contacting multiple interior surfaces, intersecting with one another, lattice structure of ribs, etc.). The ribs 344 may be arranged in such as manner so as to successfully attenuate sound and/or vibration so as to ultimately provide an appealing resultant sound and/or feel of a golf club head upon impact with a golf ball. Additionally, or alternatively, the face cartridge may include a damping material within the hollow interior cavity, such as rat glue, or other damping material (e.g., polymer) configured to be inserted and adhered to one or more interior surfaces of the hollow interior cavity 305 of the face cartridge 303.

Figure 35:
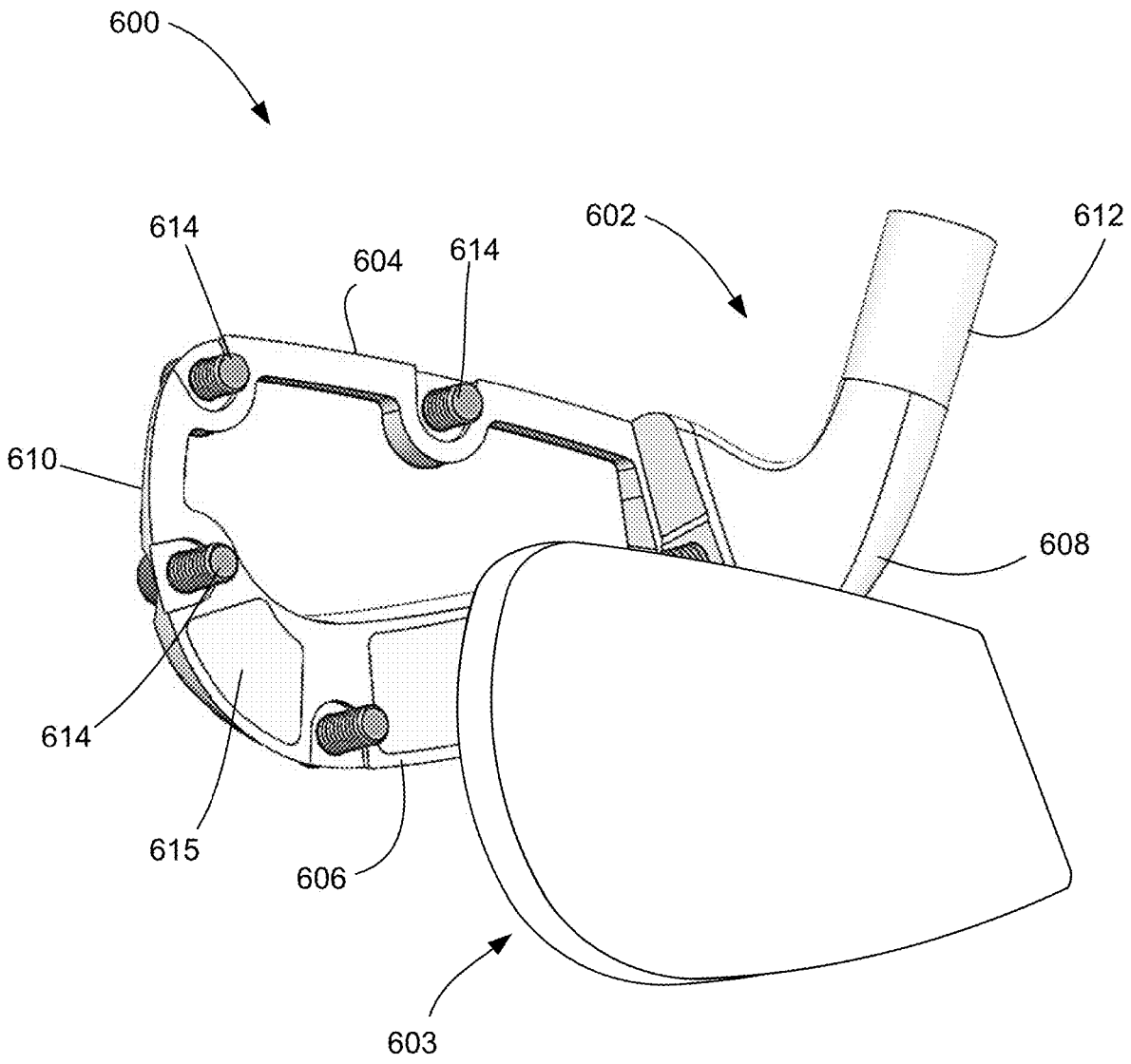
FIG. 35 is a front perspective view of another embodiment of a club head having a body and a removable hollow face cartridge configured to be releasably coupled to the club head body via multiple fasteners about a perimeter of the face cartridge.

FIG. 35 is a front perspective view of another embodiment of a club head 600 having a body 602 and a removable hollow face cartridge 603 configured to be releasably coupled to the club head body 602 via multiple fasteners 614, for example, that are arranged about a perimeter of the face cartridge 603. For example, as shown, the club head body 602 may be similarly arranged as the club head body 302*a* of FIG. 31 in that the body 602 includes a rear mounting portion or frame that includes at least a top line 604, sole 606, heel 608, toe 610, and hosel extending from the heel 608. The rear mounting frame or portion may include a front surface upon which the separately formed face cartridge 603 may be positioned and releasably attached by way of fasteners 614 arranged about the perimeter of the face. In some embodiments, the rear mounting portion or frame may further include pockets or recess for receiving and retaining weights 615 or the like within, so as to allow for manipulation of the mass properties of the club head 600 and further allow for adjustment to CG and MOI, for example.

Figure 36:
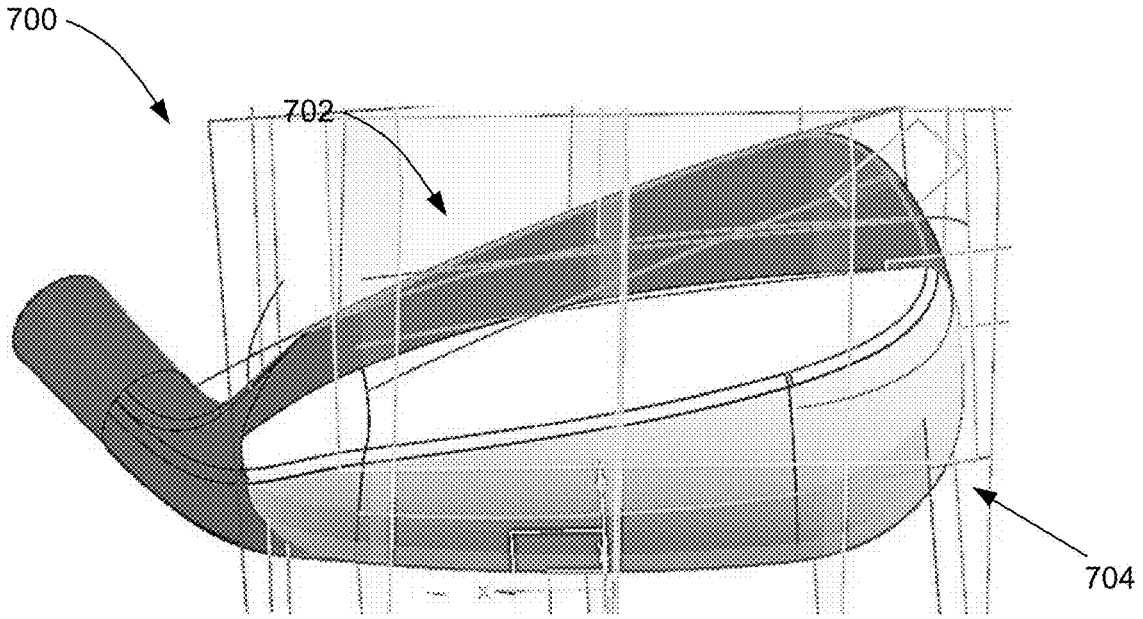
FIG. 36 is a back perspective view of another embodiment of a club head having a body and a hollow face cartridge formed integrally with one another and further including an underslung sole component positioned on the back of the club head and providing a low CG to the club head.
Figure 37:
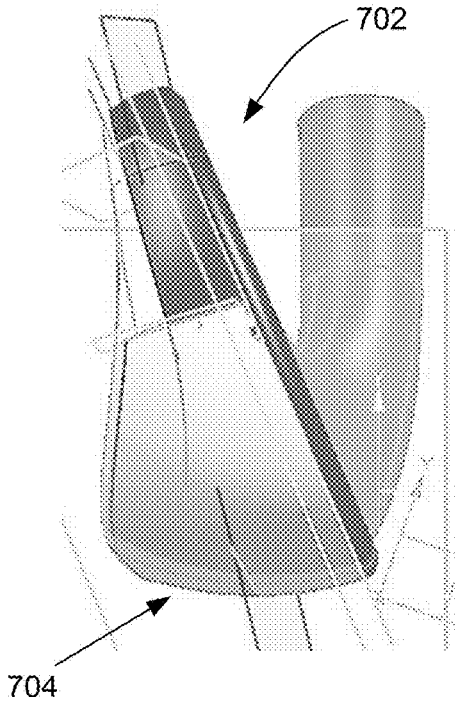
FIG. 37 is a toe-side view of the club head of FIG. 36.
Figure 38:
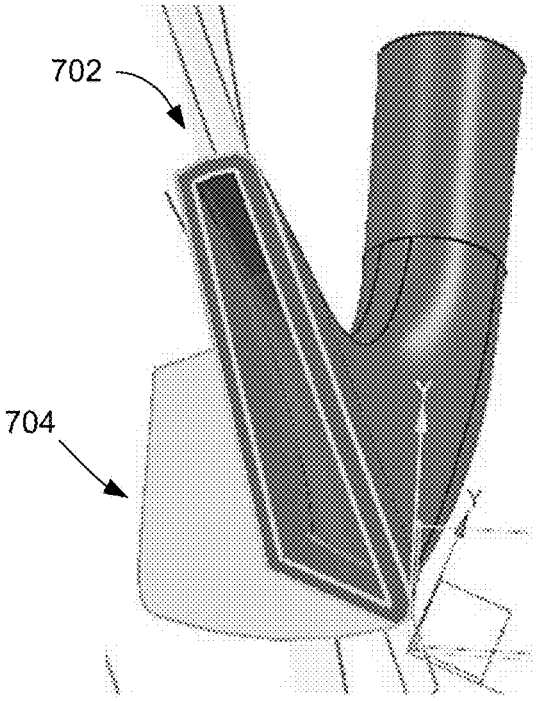
FIG. 38 is a cross-sectional view of the club head of FIG. 37.

FIGS. 36 and 37 are back perspective and toe-side views, respectively, of another embodiment of a club head 700 having a body 702 and a hollow face cartridge 703 formed integrally with one another and further including an underslung sole component 704 positioned on the back of the club head body 702. The underslung sole component 704 may generally provide a low CG to the club head, in that the component 704 may generally be formed from a material that is different than the titanium material from which the body and face cartridge are formed (such as tungsten). A cross-sectional view of the club head 700 is shown in FIG. 38, illustrating an angled sole portion of the hollow face cartridge 703 which allows for the face cartridge 703 to sit on top of the underslung sole component 704. Such a design allows for a portion of the heavier underslung sole component 704 to sit lower in the club head so as to provide for a lower CG.

Figure 39:
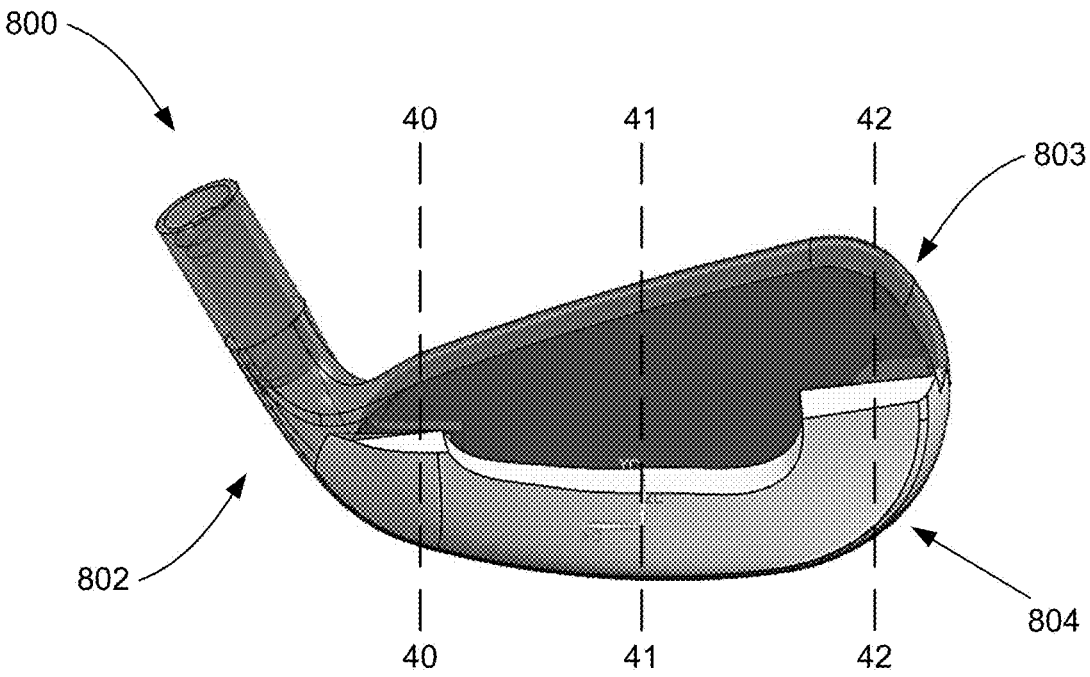
FIG. 39 is a back plan view of another embodiment of a club head having a body and a hollow face cartridge formed integrally with one another and further including an underslung sole component positioned on the back of the club head and providing a low CG to the club head. The hollow face cartridge has a variable front-to-back width along a length of the cartridge in a heel-to-toe direction.
Figure 40:
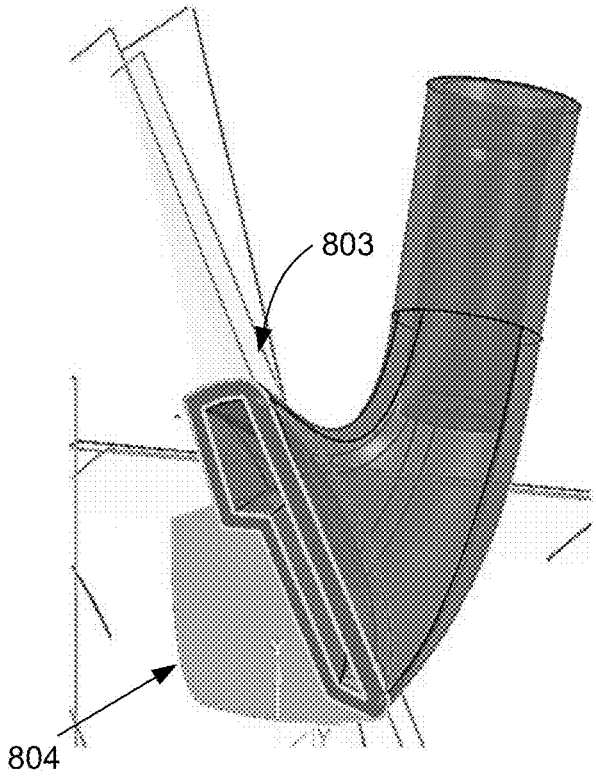
FIG. 40 is a cross-sectional view of the club head of FIG. 39 taken along lines 40-40 adjacent the heel of the club head.
Figure 41:
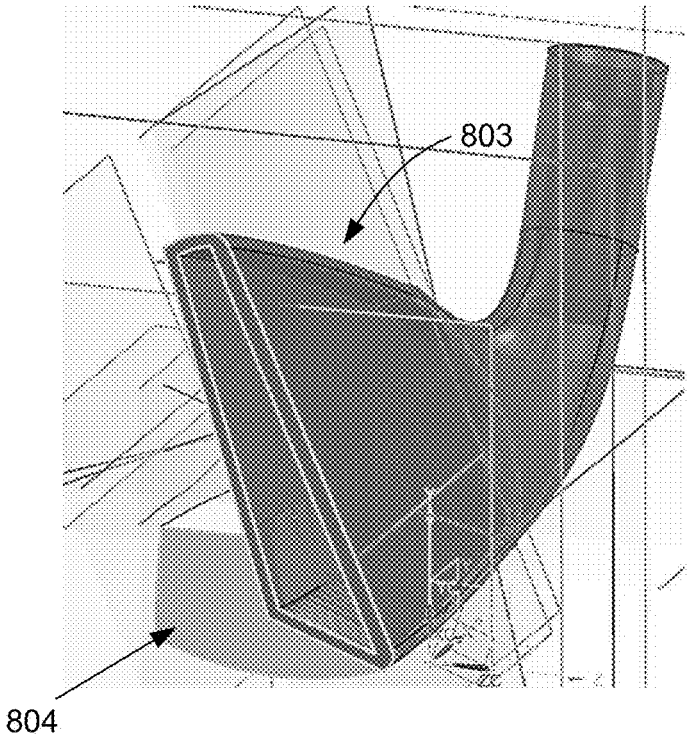
FIG. 41 is cross-sectional view of the club head of FIG. 39 taken along lines 41-41 proximately adjacent the center of the face cartridge.
Figure 42:
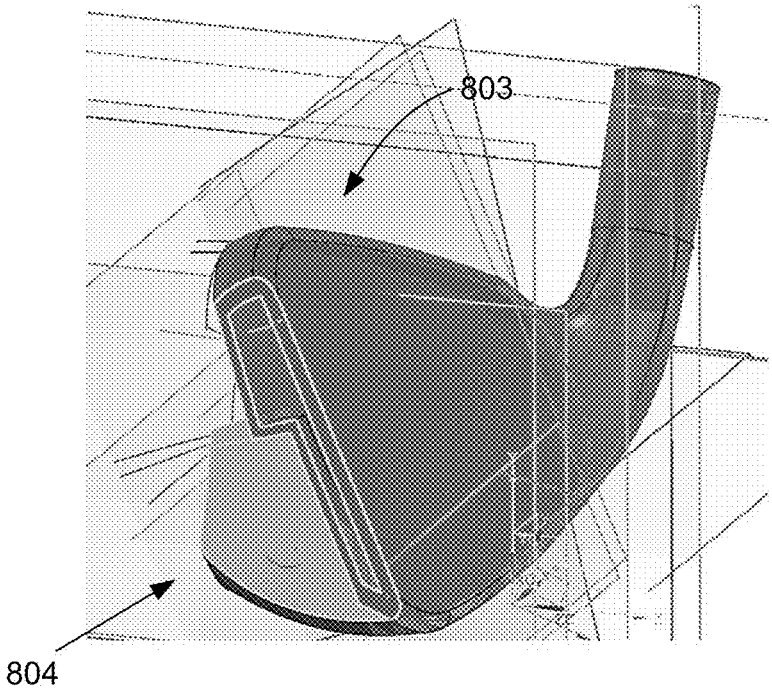
FIG. 42 is a cross-sectional view of the club head of FIG. 39 taken along lines 42-42 adjacent the toe of the club head.

FIG. 39 is a back plan view of another embodiment of a club head 800 having a body 802 and a hollow face cartridge 803 formed integrally with one another and further including an underslung sole component 804 positioned on the back of the club head body 802 and providing a low CG to the club head 800. Cross-sectional views of the club head 800 at the heel, a center portion between the heel and toe, and at the toe are shown in FIGS. 40-42, respectively. As can be seen, the hollow face cartridge 803 has a variable front-to-back width (e.g., width of the interior cavity between front ball-striking surface and the rear surface) along a length of the cartridge 803 in a heel-to-toe direction. For example, a front-to-back width of the face cartridge 803 may be largest at a central location (FIG. 41) than front-to-back widths at the heel (FIG. 40) and the toe (FIG. 42). This variability (e.g., tapering of front-to-back widths) along the length of the face cartridge from heel to toe may allow for maximizing forgiveness of the club head, in that more weight will need to be placed into the heel and toe areas of the design to increase MOI. In particular, by reducing front-to-back widths in the heel and toe areas, the sole component 804 can have increased thickness in such areas, thereby increasing mass in the heel and toe.

Figure 43:
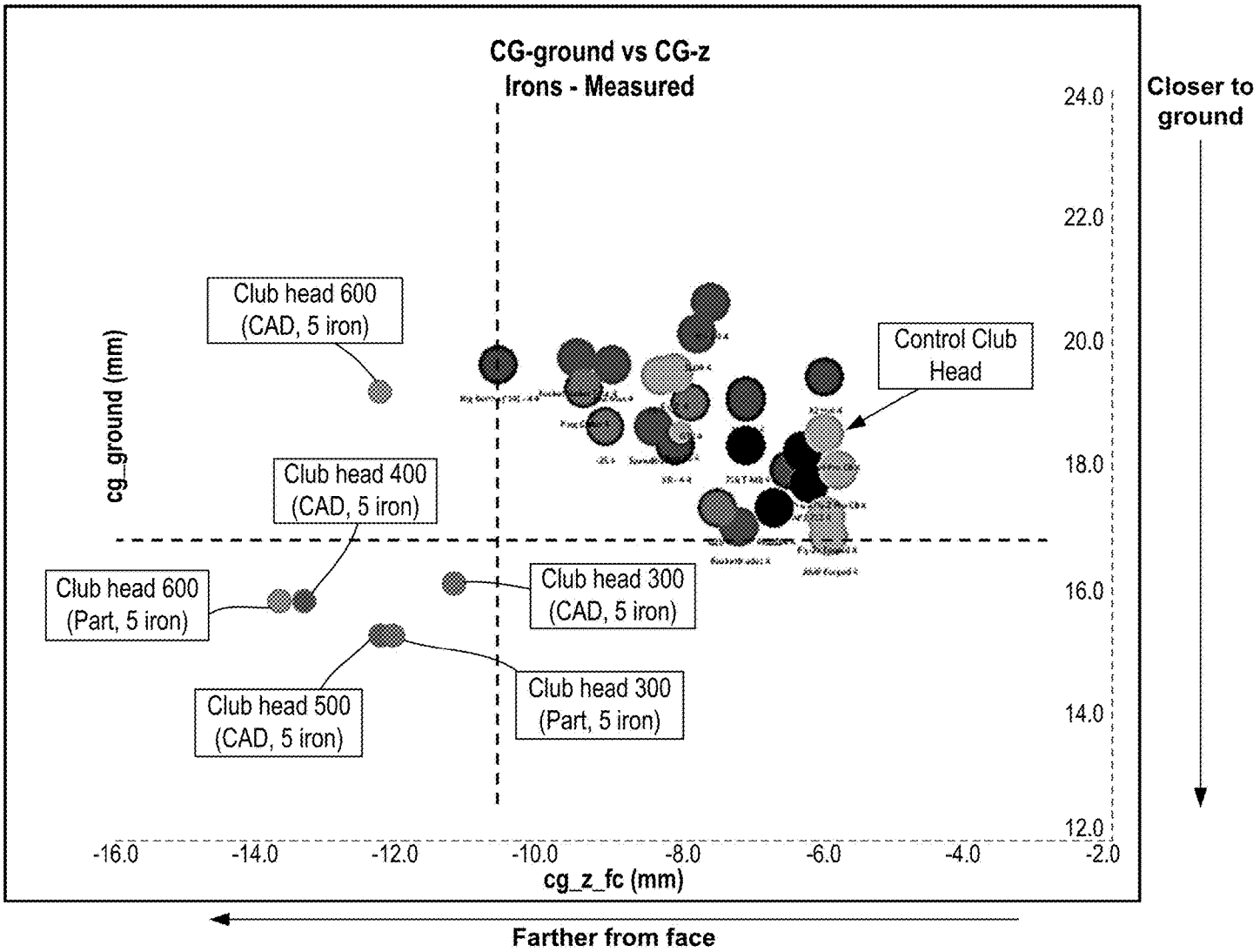
FIG. 43 illustrates a plot of CG locations of a large sampling of golf club heads, including the golf club heads consistent with the present disclosure.
Figure 44:
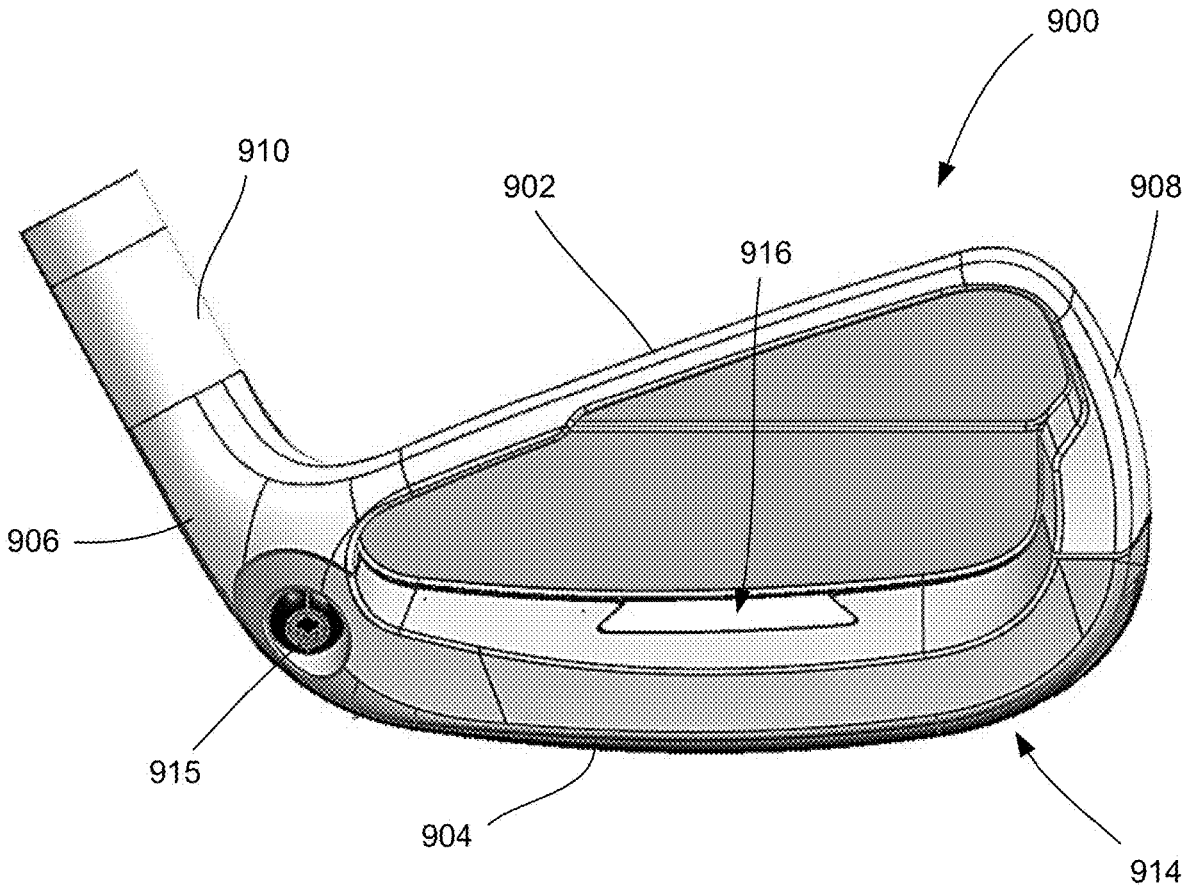
FIG. 44 is a back plan view of another embodiment of a golf club head having a removable component positioned on the back of the club head and forming at least a portion of the sole of the club head body.
Figure 45:
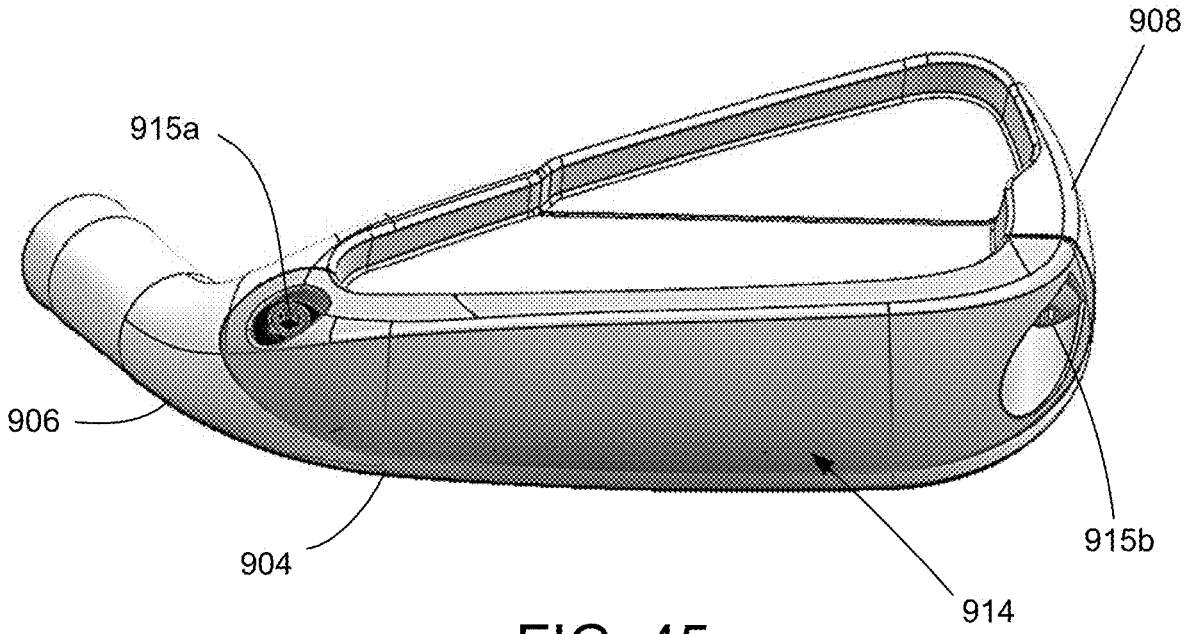
FIG. 45 is a perspective view of the golf club head of FIG. 44 illustrating the removable component forming a portion of the sole when attached to the club head body.
Figure 46:
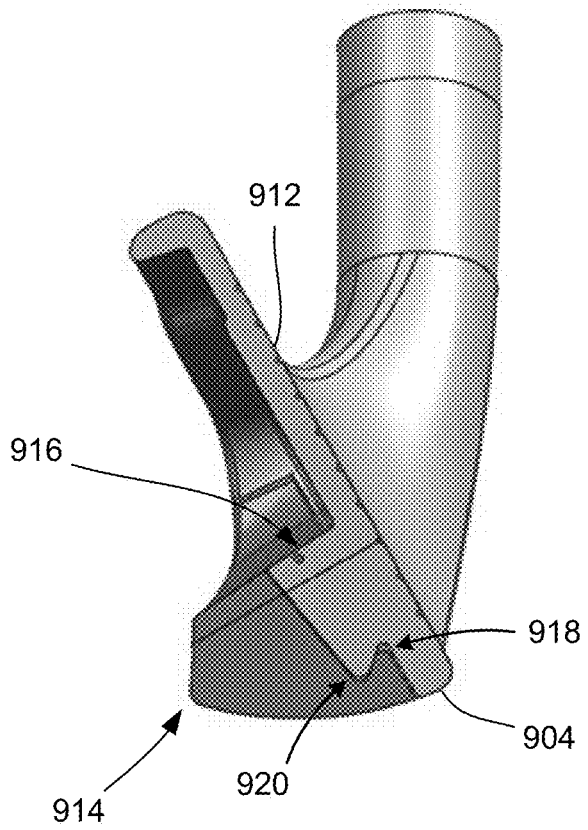
FIG. 46 is a cross-sectional view of the golf club head of FIG. 44 illustrating corresponding interlocking structures of the removable component and the club head body.

FIG. 43 illustrates a plot of CG locations of a large sampling of golf club heads, including the golf club heads consistent with the present disclosure, including club heads 300, 400, 500, and 600, as well as a control club head having a forged body and face (non-hollow face insert).

As shown in FIG. 43, the hollow titanium face cartridge construction allows a large amount of the overall weight to be placed in the rear of the head, which results in CG locations that are not possible using conventional constructions of a similar head dimension. For example, FIG. 40 illustrates the plots of CG locations of a large sample size of 4 iron golf clubs of various club head construction, including the hollow titanium club head construction of heads 300, 400, 500, and 600, and various iterations thereof. The dashed vertical line represents the maximum limit of how far a CG location is back from the club face and the dashed horizontal line represents the limit of how low to the ground a CG location is. As can be seen, all of the test club heads 300, 400, 500, and 600 had CG locations to the left of the dashed vertical line, illustrating that such designs provide a CG much further back from the club face than tested club heads without the hollow titanium face cartridge design. Furthermore, at least club heads 300, 400, and 500 provide a CG lower to the ground than tested club heads without the hollow titanium face cartridge design.

The following table illustrates a number of characteristics of club head 300 (illustrated in FIGS. 19-24) and club head 400 (illustrated in FIGS. 25-27) as compared to one another and compared to a standard forged iron having a solid ball-striking face which include different sole. Each club head was built to similar specifications, including stock shafts and loft/lie matched (4 irons).

| | Forged Iron | Club Head 300 | Club Head 400 |
|---|---|---|---|
| Ball Speed (Avg.) | 118.1 | 119.1 | 120.5 |
| (Std. Dev.) | (1.9) | (1.7) | (1.9) |
| Launch Angle (Avg.) | 16.26 | 17.12 | 17.32 |
| (Std. Dev.) | (0.80) | (0.98) | (0.97) |
| Back Spin (Avg.) | 3696 | 3824 | 3680 |
| (Std. Dev.) | (264) | (519) | (453) |
| Side Spin (Avg.) | −160 | −332 | −419 |
| (Std. Dev.) | (279) | (297) | (378) |
| Dispersion (Avg.) | 0.0 | −8.1 | −6.1 |
| (Std. Dev.) | (9.4) | (7.9) | (11.7) |
| Carry (Avg.) | 175.0 | 177.1 | 179.3 |
| (Std. Dev.) | (3.4) | (3.8) | (4.2) |

FIGS. 44-47 illustrate another embodiment of an interlocking engagement between a golf club head a removable sole plate which generally provides a pivoting-type engagement and disengagement design for the removable component, as opposed to the sliding-type engagement previously described herein. As shown, the club head 900 generally includes a club head body having a top line 902, a sole 904, a heel 906, a toe 908, and a hosel 910 extending from the heel 906. The club head further includes a face 912. It should be noted that, although the face 912 is shown as being solid, the face 912 may further be embodied as a hollow titanium face cartridge consistent with the present disclosure. The club head further includes a removable component (referred to as "removable sole plate 914") configured to be removed from and re-attached to the club head body at least by way of one or more fasteners 915*a*, 915*b*, as well as engagement between an interlocking structure 916 formed on a rear surface of the club head body and a recess 920 formed on the sole plate 914.

Figure 47:
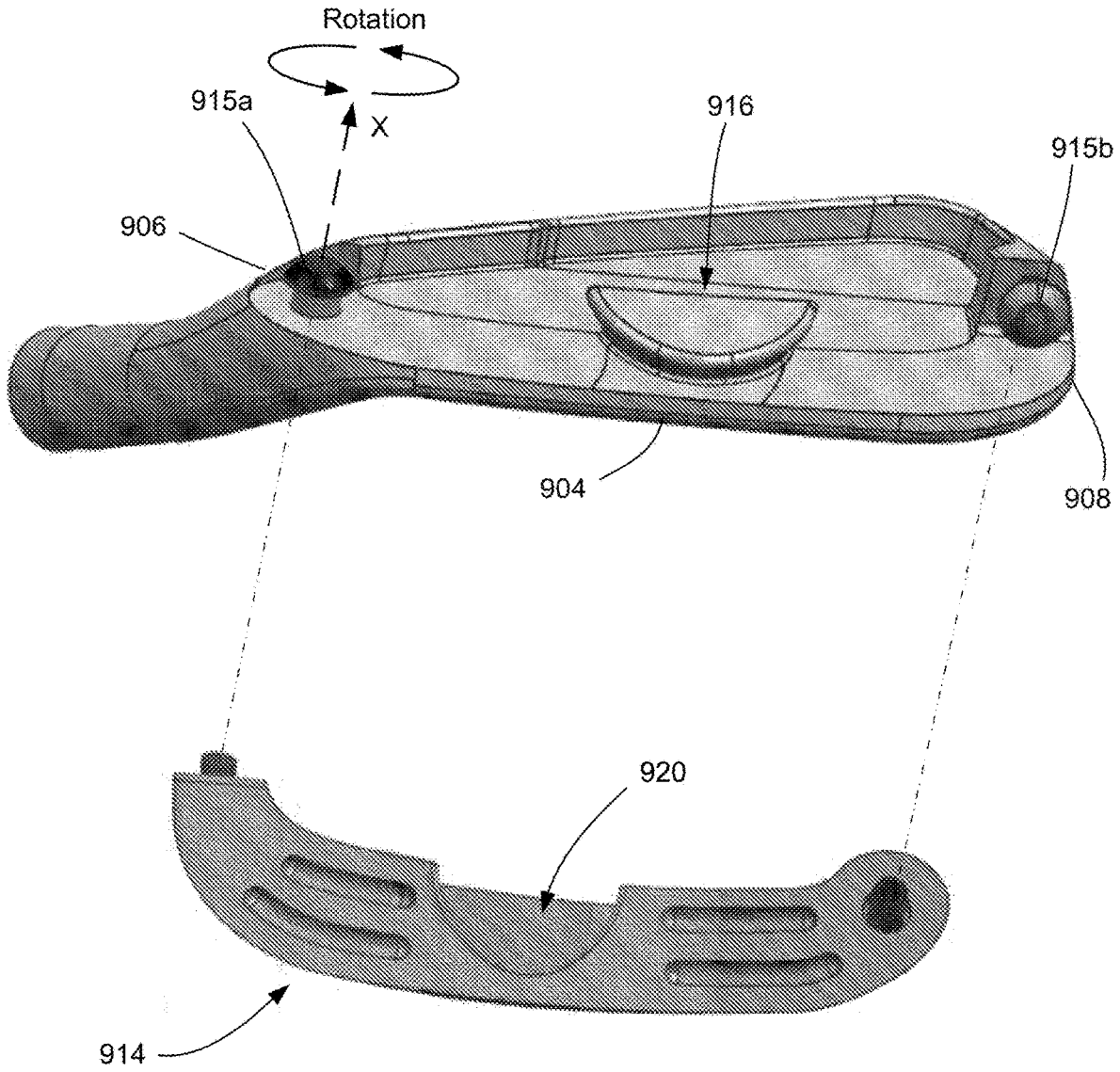
FIG. 47 shows the removable component and club head body separated from one another illustrating the corresponding interlocking structures of the removable component and the club head body and the fasteners at heel and toe positions which generally provide pivoting-type disengagement/engagement of the removable component.

For example, the removable sole plate 914 may include a first end configured to be coupled to a heel-side portion of the club head body and a second end configured to be coupled to a toe-side portion of the club head body via fasteners 915*a* and 915*b*, respectively. The placement/arrangement of the fasteners 915*a*, 915*b* allows for the sole plate to pivot into and out of engagement with the club head body, specifically allowing for engagement/disengagement of the protrusion 918 of the interlocking structure 916 of the club head body 902 with the corresponding recess 920 of the sole plate 914. For example, when attaching the sole plate 914 to the club head body 902, a player may first fasten fastener 915*a*, which couples the first end of the sole plate 914 to the heel-side portion of the club head body 902. The player may then pivot the sole plate 914 about a first longitudinal axis of rotation X of the fastener 915*a* such that the remainder of the sole plate 914, including the second end thereof, moves in a direction towards the top line 902 until the protrusion 918 is received within the recess 920, thereby placing the second end of the sole plate 914 into proper alignment with the toe-side portion of the club head body. The player need only fasten fastener 915*b* so as to releasably fix the second end of the sole plate 914 to the body. In order to remove the sole plate 914, a player need only unfasten fastener 915*b*, then rotate the sole plate 912 about the first longitudinal axis X of fastener 915*a* in a direction away from the top line 902 and towards the sole 904, thereby disengaging the protrusion 918 from the recess 920, and then unfasten fastener 915*a*. Similarly to the fastener 915*a*, the fastener 915*b* defines a second axis of rotation. The first axis of rotation of fastener 915*a* is nonparallel with respect to the second axis of rotation of fastener 915*b*. Referring specifically to FIG. 47, the first axis of rotation of fastener 915*a* is orthogonal or offset by 90 degrees with respect to the second axis of rotation of fastener 915*b*. Further, when the club is at address, the first longitudinal axis of rotation X of the fastener 915*a* extends through the face 912, whereas the second axis of rotation of the fastener 915*b* extends into the ground. It should be noted that any of the sole plates previously described herein may include the pivoting-type design described with respect to FIGS. 44-47.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

We claim:

1. A golf club head, comprising:

a body comprising a heel and a toe;

a sole plate configured to be attached to the body, wherein the sole plate comprises a recess;

a first fastener configured on a first end of the sole plate and a heel-side portion of the body, the first fastener defining a first axis of rotation;

a second fastener configured on a second end of the sole plate and a toe-side portion of the body, the second fastener defining a second axis of rotation; and an interlocking structure formed on a rear surface of the body and disposed entirely between the first fastener and the second fastener, wherein the sole plate is configured to pivot about the first axis of rotation to bring the recess of the sole plate into engagement with the interlocking structure to align the sole plate with the body, wherein the first axis of rotation and the second axis of rotation are nonparallel, and wherein the second axis of rotation extends into a ground surface when the golf club head is at address.

2. The golf club head of claim 1, wherein the recess is positioned on a top portion of the sole plate.

3. The golf club head of claim 2, wherein the interlocking structure includes a protrusion extending from the rear surface of the body.

4. The golf club head of claim 3, wherein the protrusion extending from the rear surface of the body mates with the recess of the sole plate to attach the sole plate to the body.

5. The golf club head of claim 1, wherein the sole plate comprises a different material than the body.

6. The golf club head of claim 1, wherein the body further comprises a sole, a face, and a hosel extending from the heel.

7. The golf club head of claim 1, wherein the golf club head is an iron-type club head.

8. The golf club head of claim 1, wherein the second axis of rotation is offset by 90 degrees with respect to the first axis of rotation.

9. A golf club head, comprising:

a body comprising a heel and a toe;

a removable sole plate comprising an aperture on a first end of the removable sole plate and a recess, wherein the removable sole plate is configured to be removed from and re-attached to the body;

an interlocking structure formed on a rear surface of the body, wherein the recess of the removable sole plate engages with the interlocking structure to align the removable sole plate with the body;

a first fastener extending through the aperture of the removable sole plate and configured on a heel-side portion of the body, the first fastener defining a first axis of rotation; and a second fastener configured on a second end of the sole plate and a toe-side portion of the body, the second fastener defining a second axis of rotation, wherein the removable sole plate is pivotable about the first axis of rotation, wherein the first fastener allows for the removable sole plate to pivot into and out of engagement with the interlocking structure, wherein the first axis of rotation and the second axis of rotation are nonparallel, and wherein the second axis of rotation extends into a ground surface when the golf club head is at address.

10. The golf club head of claim 9, wherein the second axis of rotation is offset by 90 degrees with respect to the first axis of rotation.

11. The golf club head of claim 10, wherein the first fastener is positioned on the rear surface of the body and the second fastener is positioned on a bottom surface of the body.

12. The golf club head of claim 9, wherein the recess of the removable sole plate is positioned in a top portion of the removable sole plate.

13. The golf club head of claim 12, wherein the removable sole plate further includes a plurality of grooves extending through at least one surface of the removable sole plate.

14. The golf club head of claim 9, wherein the interlocking structure includes a protrusion extending from the rear surface of the body.

15. The golf club head of claim 14, wherein the protrusion extending from the rear surface of the body mates with and is received by the recess of the removable sole plate to attach the removable sole plate to the body.

16. The golf club head of claim 9, wherein the removable sole plate comprises a different material than the body.

17. A golf club head, comprising:

a body comprising a heel and a toe;

a removable sole plate configured to be removed from and re-attached to the body;

an interlocking structure formed on a rear surface of the body;

a first fastener configured on a first end of the removable sole plate and a heel-side portion of the body, the first fastener defining a first axis of rotation; and a second fastener configured on a second end of the removable sole plate and a toe-side portion of the body, the second fastener defining a second axis of rotation, wherein the removable sole plate is pivotable about the first axis of rotation, wherein the fastener allows for the removable sole plate to pivot into and out of engagement with the interlocking structure, wherein the first axis of rotation and the second axis of rotation are nonparallel, and wherein the second axis of rotation extends into a ground surface when the golf club head is at address.

18. The golf club head of claim 17, wherein the removable sole plate comprises a different material than the body.

19. The golf club head of claim 17, wherein a protrusion extending from the rear surface of the body mates with and is received by a recess formed on the removable sole plate to attach the removable sole plate to the body.

20. The golf club head of claim 17, wherein the second axis of rotation is offset by 90 degrees with respect to the first axis of rotation.

* * * * *